US007484501B2

(12) United States Patent
Amano et al.

(10) Patent No.: US 7,484,501 B2
(45) Date of Patent: Feb. 3, 2009

(54) FUEL VAPOR TREATMENT APPARATUS

(75) Inventors: Noriyasu Amano, Gamagori (JP); Shinsuke Takakura, Kariya (JP); Masao Kanoh, Gamagori (JP); Terutoshi Shiokawa, Chiryu (JP)

(73) Assignees: DENSO Corporation (JP); Nippon Soken, Inc. (JP)

( * ) Notice: Subject to any disclaimer, the term of this patent is extended or adjusted under 35 U.S.C. 154(b) by 97 days.

(21) Appl. No.: 11/808,771

(22) Filed: Jun. 12, 2007

(65) Prior Publication Data

US 2007/0295313 A1 Dec. 27, 2007

(30) Foreign Application Priority Data

Jun. 12, 2006 (JP) ..... 2006-162770
Dec. 12, 2006 (JP) ..... 2006-334991

(51) Int. Cl.
*F02M 33/04* (2006.01)

(52) U.S. Cl. ..... 123/520

(58) Field of Classification Search ..... 123/516, 123/518, 519, 520
See application file for complete search history.

(56) References Cited

U.S. PATENT DOCUMENTS 6,971,375 B2 12/2005 Amano et al.
7,318,425 B2 * 1/2008 Kano et al. ..... 123/520
7,409,947 B2 * 8/2008 Koyama ..... 123/520
2006/0042605 A1 3/2006 Amano et al.
2006/0225713 A1 10/2006 Kano et al.
2008/0092858 A1 * 4/2008 Satoh et al. ..... 123/520

FOREIGN PATENT DOCUMENTS

JP 05-018326 1/1993
JP 06-101534 4/1994

* cited by examiner

*Primary Examiner*—Thomas N Moulis
(74) *Attorney, Agent, or Firm*—Nixon & Vanderhye PC

(57) ABSTRACT

A fuel vapor treatment apparatus includes a first canister purges fuel vapor into an intake passage of an engine through a purge passage, which communicates with a first detection passage having a throttle. A second canister is located on an opposite side of the purge passage with respect to the throttle, and communicates with the first detection passage. A gas flow generating unit generates gas flow by reducing pressure in a second detection passage communicating with the second canister. A pressure detecting unit detects pressure correlated with the throttle and the gas flow generating unit. An exhaust detecting unit detects exhaust of fuel vapor from the second canister to the second detection passage. A purge control unit controls purge of fuel vapor from the purge passage to the intake passage in accordance with detection results of the pressure detecting unit and the exhaust detecting unit.

73 Claims, 45 Drawing Sheets

| | | | CANISTER CLOSE VALVE | PASSAGE VALVE | PASSAGE SW VALVE | PURGE VALVE |
|---|---|---|---|---|---|---|
| MAIN PROCESS | CONCENT. DETECT | S201 ($P_t$) | OPEN | CLOSE | I | CLOSE |
| | | S204 (ΔPair) | OPEN | OPEN | I | CLOSE |
| | | S208 (ΔPgas) | OPEN | OPEN | II | CLOSE |
| | PURGE | S306 (1st PURGE) | OPEN | OPEN | II | OPEN |
| | | S312 (2nd PURGE) | OPEN | CLOSE | I | OPEN |
| FIRST CANISTER OPEN COND. | | | OPEN | CLOSE | I | CLOSE |

I : 1st COND.

II : 2nd COND.

FIG. 18

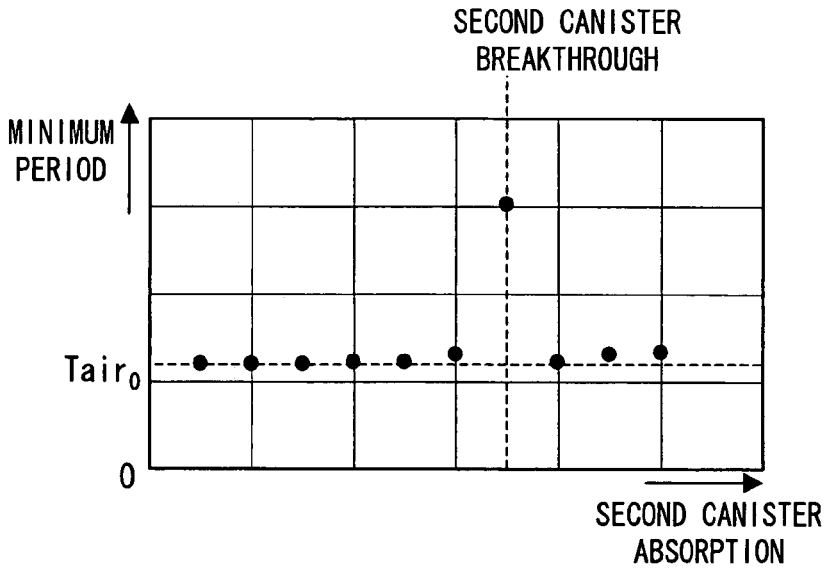

FIG. 20

| | | | CANISTER CLOSE VALVE | FIRST PASSAGE VALVE | PASSAGE SW VALVE | PURGE VALVE | SECOND PASSAGE VALVE |
|---|---|---|---|---|---|---|---|
| MAIN PROCESS | CONCENT. DETECT | S601 ($P_t$) | OPEN | CLOSE | I | CLOSE | OPEN |
| | | S604 (ΔPair) | OPEN | OPEN | I | CLOSE | OPEN |
| | | S608 (ΔPgas) | OPEN | OPEN | II | CLOSE | OPEN |
| | PURGE | S706 (1st PURGE) | OPEN | OPEN | II | OPEN | OPEN |
| | | S712 (2nd PURGE) | OPEN | CLOSE | I | OPEN | OPEN |
| FIRST CANISTER OPEN COND. | | | OPEN | CLOSE | I | CLOSE | ※ |

I : 1st COND.
II : 2nd COND.

※ { SECOND CANISTER BREAK. FLAG ON : CLOSE
SECOND CANISTER BREAK. FLAG OFF : OPEN

| | | | CANISTER CLOSE VALVE | PASSAGE VALVE | PASSAGE SW VALVE | PURGE VALVE |
|---|---|---|---|---|---|---|
| MAIN PROCESS | CONCENT. DETECT | S1201 ($P_t$) | OPEN | CLOSE | I | CLOSE |
| | | S1205 (ΔPair) | OPEN | OPEN | I | CLOSE |
| | | S1209 (ΔPgas) | OPEN | OPEN | II | CLOSE |
| | PURGE | S1306 (1st PURGE) | OPEN | OPEN | II | OPEN |
| | | S1312 (2nd PURGE) | OPEN | CLOSE | I | OPEN |
| FIRST CANISTER OPEN COND. | | | OPEN | CLOSE | I | CLOSE |

I : 1st COND.
II : 2nd COND.

FIG. 41

| | | | CANISTER CLOSE VALVE | PASSAGE VALVE | PASSAGE SW VALVE | PURGE VALVE | FLOW CONTROL VALVE | ATM VALVE |
|---|---|---|---|---|---|---|---|---|
| MAIN PROCESS | CONCENT. DETECT | S1901 ($P_t$) | OPEN | CLOSE | I | CLOSE | OPEN | CLOSE |
| | | S1904 (ΔPair) | OPEN | OPEN | I | CLOSE | OPEN | CLOSE |
| | | S1908 (ΔPgas) | OPEN | OPEN | II | CLOSE | OPEN | CLOSE |
| | PURGE | S2006 (1st PURGE) | OPEN | OPEN | II | OPEN | CLOSE | OPEN |
| | | S2012 (2nd PURGE) | OPEN | CLOSE | I | OPEN | CLOSE | CLOSE |
| FIRST CANISTER OPEN COND. | | | OPEN | CLOSE | I | CLOSE | CLOSE | CLOSE |

I : 1st COND.
II : 2nd COND.

FIG. 42

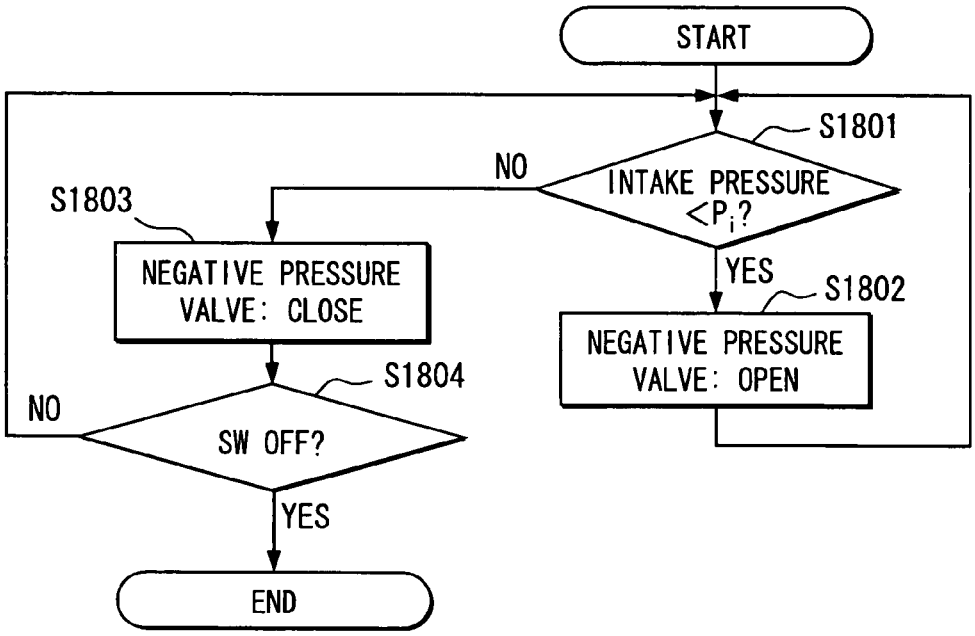

FIG. 45

| | | | CANISTER CLOSE VALVE | PASSAGE VALVE | PASSAGE SW VALVE | PURGE VALVE |
|---|---|---|---|---|---|---|
| MAIN PROCESS | CONCENT. DETECT | S2201 ($P_t$) | OPEN | CLOSE | I | CLOSE |
| | | S2204 (ΔPair) | OPEN | OPEN | I | CLOSE |
| | | S2207 (ΔPgas) | OPEN | OPEN | II | CLOSE |
| | PURGE | S2306 (CANISTERS) | OPEN | OPEN | II | OPEN |
| FIRST CANISTER OPEN COND. | | | OPEN | CLOSE | I | CLOSE |

I : 1st COND.

II : 2nd COND.

FIG. 53

| | | | CANISTER CLOSE VALVE | PASSAGE VALVE | PASSAGE SW VALVE | PURGE VALVE |
|---|---|---|---|---|---|---|
| MAIN PROCESS | CONCENT. DETECT | S2201 ($P_t$) | OPEN | CLOSE | I | CLOSE |
| | | S2204 (ΔPair) | OPEN | OPEN | I | CLOSE |
| | | S2207 (ΔPgas) | OPEN | OPEN | II | CLOSE |
| | PURGE | S2406 (1st PURGE) | OPEN | OPEN | II | OPEN |
| | | S2410 (2nd PURGE) | OPEN | CLOSE | I | OPEN |
| FIRST CANISTER OPEN COND. | | | OPEN | CLOSE | I | CLOSE |

I : 1st COND.

II : 2nd COND.

FUEL VAPOR TREATMENT APPARATUS

CROSS REFERENCE TO RELATED APPLICATIONS

This application is based on and incorporates herein by reference Japanese Patent Applications No. 2006-162770 filed on Jun. 12, 2006 and No. 2006-334991 filed on Dec. 12, 2006.

FIELD OF THE INVENTION

The present invention is related to a fuel vapor treatment apparatus.

BACKGROUND OF THE INVENTION

Conventionally, a fuel vapor treatment apparatus includes a canister accommodating an absorbent for temporarily absorbing fuel vapor produced in a fuel tank. The fuel vapor is removed from the canister as needed, so that the removed fuel vapor is purged into an internal combustion engine through an intake passage together with intake air. According to JP-A-H5-18326 and JP-A-H6-101534, an amount to fuel vapor purged to an intake passage is enhanced by detecting concentration of fuel vapor, which is to be purged into the intake passage, in advance. In such a fuel vapor treatment apparatus, mixture gas containing fuel vapor flows into the intake passage through a purge passage. The fuel vapor treatment apparatus controls the purge operation of fuel vapor by detecting a flow amount or a density of air in a passage, which opens to the atmosphere, in addition to detecting a flow amount or a density of the mixture gas in the purge passage.

In the fuel vapor treatment apparatus disclosed in JP-A-H5-18326 or JP-A-H6-101534, negative pressure in the intake passage is applied to each passage, so that the flow amount or the density is detected while flowing mixture gas or air into each passage. In each of these structures, when pulsation occurs in negative pressure in the intake passage, the flow amount and the density fluctuate. Consequently, the purge control cannot be accurately conducted on the basis of the detection of the flow amount or the density. When negative pressure in the intake passage is small, the mixture or air decreases in each passage. As a result, it is difficult to detect the flow amount or density.

It is conceivable to reduce pressure in a detection passage, which includes a throttle, using a gas flow generating unit to individually generate air flow and gas flow, so as to control the purge operation on the basis of detection pressure, which corresponds to the throttle and the gas flow generating unit. In such a fuel vapor treatment apparatus, detection pressure becomes stable, and the amount of air or gas through the detection passage can be sufficiently generated. Therefore, pressure can be properly detected, so that the purge operation can be accurately controlled. Thus, the air/fuel ratio in the engine can be protected against influence caused by the purge operation.

However, when the amount of fuel vapor absorbed in the canister exceeds an absorbing capacity of the canister, breakthrough occurs in the canister. When breakthrough occurs in the canister, fuel vapor is exhausted from the canister into an open passage, through which fuel vapor is exhausted to the atmosphere. For example, pressure of air passing through the throttle may be detected in a condition where the atmosphere passage communicates with the detection passage. In this operation, fuel vapor exhausted to the open passage may pass through the throttle, and consequently, the fuel vapor may flow into the gas flow generating unit. In this case, the characteristic of the gas flow generating unit may change. The gas flow generating unit may be a pump having an exhaust port communicating with the open passage. In this case, fuel vapor exhausted to the open passage may flow into the pump. Consequently, the P–Q characteristic of the pump may change. Thus, accuracy of pressure detection, or accuracy of controlling the purge operation may decrease.

A fuel vapor treatment apparatus may further include a second canister, in addition to a first canister for absorbing fuel vapor produced in the fuel tank. The second canister is provided in the detection passage between the throttle and the gas flow generating unit for absorbing fuel vapor.

In this fuel vapor treatment apparatus, the second canister absorbs fuel vapor flowing into the detection passage in a condition where pressure is detected. Therefore, fuel vapor can be restricted from flowing into the gas flow generating unit. Therefore, when a pump is provided as the gas flow generating unit, as shown in FIG. 2, the detection pressure $\Delta Pgas$, in a condition where only fuel vapor passes through the throttle, is equal to shutoff pressure Pt of the pump. The detection pressure $\Delta Pair$ in a condition where only air passes through the throttle is equal to pressure in the intersection between the a $\Delta P$–Q characteristic curve Cair of the throttle and the P–Q characteristic curve Cpmp of the pump. Therefore, as shown in FIG. 2, a detection gain G, which is a difference between the detection pressure $\Delta Pgas$, $\Delta Pair$, becomes large. Thus, accuracy of controlling the purge operation can be enhanced.

However, even in the structure, in which the second canister is additionally provided, breakthrough may occur in the second canister. When breakthrough occurs in the second canister, the second canister exhausts fuel vapor into the gas flow generating unit, as the gas flow generating unit generates gas flow. Consequently, fuel vapor may be drawn into the gas flow generating unit. As a result, the characteristic of the gas flow generating unit changes. Consequently, accuracy of detection pressure and accuracy of controlling the purge operation may decrease. Furthermore, the gas flow generating unit may be a pump having an exhaust port opening to the atmosphere. In this structure, the pump draws fuel vapor, and the fuel vapor is exhausted to the atmosphere. As a result, the fuel vapor causes air pollution.

SUMMARY OF THE INVENTION

The present invention addresses the above disadvantage. According to one aspect of the present invention, a fuel vapor treatment apparatus includes a first canister for removably absorbing fuel vapor produced in a fuel tank. The fuel vapor treatment apparatus further includes a purge passage through which fuel vapor removed from the first canister is purged into an intake passage of an engine. The fuel vapor treatment apparatus further includes a first detection passage communicating with the purge passage, the first detection passage having a throttle midway therethrough. The fuel vapor treatment apparatus further includes a second canister located on an opposite side of the purge passage with respect to the throttle. The second canister communicates with the first detection passage for removably absorbing fuel vapor flowing from the purge passage into the second canister through the first detection passage. The fuel vapor treatment apparatus further includes a second detection passage communicating with the second canister. The fuel vapor treatment apparatus further includes a gas flow generating unit for generating gas flow by reducing pressure in the second detection passage. The fuel vapor treatment apparatus further includes a pressure detecting unit for detecting pressure correlated with the throttle and the gas flow generating unit. The fuel vapor treatment apparatus further includes an exhaust detecting unit for detecting exhaust of fuel vapor from the second canister to the second detection passage. The fuel vapor treatment apparatus further includes a purge control unit for controlling purge of fuel vapor from the purge passage to the intake passage in accordance with a detection result of the pressure detecting unit and a detection result of the exhaust detecting unit.

According to another aspect of the present invention, a fuel vapor treatment apparatus includes a canister for removably absorbing fuel vapor produced in a fuel tank. The fuel vapor treatment apparatus further includes a purge passage through which fuel vapor removed from the canister is purged into an intake passage of an engine. The fuel vapor treatment apparatus further includes a detection passage having a throttle midway therethrough. The fuel vapor treatment apparatus further includes a gas flow generating unit for generating gas flow by reducing pressure in the detection passage. The fuel vapor treatment apparatus further includes a pressure detecting unit for detecting pressure correlated with the throttle and the gas flow generating unit. The fuel vapor treatment apparatus further includes an open passage communicating with both an atmosphere and the canister. The fuel vapor treatment apparatus further includes an atmosphere passage communicating with the open passage. The fuel vapor treatment apparatus further includes a passage switching unit for switching between the purge passage and the atmosphere passage to be communicated with the detection passage. The fuel vapor treatment apparatus further includes an exhaust detecting unit for detecting exhaust of fuel vapor from the canister to the open passage. The fuel vapor treatment apparatus further includes a purge control unit for controlling purge of fuel vapor from the purge passage to the intake passage in accordance with a detection result of the pressure detecting unit and a detection result of the exhaust detecting unit.

According to another aspect of the present invention, a fuel vapor treatment apparatus includes a canister for removably absorbing fuel vapor produced in a fuel tank. The fuel vapor treatment apparatus further includes a purge passage through which fuel vapor removed from the canister is purged into an intake passage of an engine. The fuel vapor treatment apparatus further includes a detection passage communicating with the purge passage, the detection passage having a throttle midway therethrough. The fuel vapor treatment apparatus further includes a gas flow generating unit for generating gas flow by reducing pressure in the detection passage. The gas flow generating unit has an exhaust port for exhausting gas drawn from the detection passage. The fuel vapor treatment apparatus further includes a pressure detecting unit for detecting pressure correlated with the throttle and the gas flow generating unit. The fuel vapor treatment apparatus further includes an open passage communicating with an atmosphere, the canister, and the exhaust port. The fuel vapor treatment apparatus further includes an exhaust detecting unit for detecting exhaust of fuel vapor from the canister to the open passage. The fuel vapor treatment apparatus further includes a purge control unit for controlling purge of fuel vapor from the purge passage to the intake passage in accordance with a detection result of the pressure detecting unit and a detection result of the exhaust detecting unit.

According to another aspect of the present invention, a fuel vapor treatment apparatus includes a first canister for removably absorbing fuel vapor produced in a fuel tank. The fuel vapor treatment apparatus further includes a purge passage through which fuel vapor removed from the first canister is purged into an intake passage of an engine. The fuel vapor treatment apparatus further includes a first detection passage communicating with the purge passage, the first detection passage having a throttle midway therethrough. The fuel vapor treatment apparatus further includes a second canister located on an opposite side of the purge passage with respect to the throttle. The second canister communicates with the first detection passage for removably absorbing fuel vapor flowing from the purge passage into the second canister through the first detection passage. The fuel vapor treatment apparatus further includes a second detection passage communicating with the second canister. The fuel vapor treatment apparatus further includes a gas flow generating unit for generating gas flow by reducing pressure in the second detection passage. The fuel vapor treatment apparatus further includes a pressure detecting unit for detecting pressure correlated with the throttle and the gas flow generating unit in a condition where the gas flow generating unit reduces pressure in the second detection passage. The fuel vapor treatment apparatus further includes a purge control unit for controlling purge of fuel vapor from the purge passage to the intake passage in accordance with a detection result of the pressure detecting unit. The fuel vapor treatment apparatus further includes an estimating unit for estimating an amount of fuel vapor absorbed in the second canister. The fuel vapor treatment apparatus further includes an allow/prohibit determining unit for allowing the gas flow generating unit to reduce pressure in the second detection passage, and prohibiting the gas flow generating unit from reducing pressure in the second detection passage, in accordance with an estimation result of the estimating unit.

BRIEF DESCRIPTION OF THE DRAWINGS

The above and other objects, features and advantages of the present invention will become more apparent from the following detailed description made with reference to the accompanying drawings. In the drawings:

FIG. 18 is a graph showing a relationship between a minimum period, needed until the first pressure becomes constant, and an amount of fuel vapor absorbed in the second canister of the fuel vapor treatment apparatus, according to the third embodiment;

FIG. 20 is a table showing operations of components of the fuel vapor treatment apparatus according to the fourth embodiment;

FIG. 41 is a table showing operations of components of the fuel vapor treatment apparatus according to the tenth embodiment;

FIG. 42 is a flow chart showing an accumulating process according to the tenth embodiment;

FIG. 45 is a table showing operations of components of the fuel vapor treatment apparatus according to an eleventh embodiment;

FIG. 53 is a table showing operations of components of the fuel vapor treatment apparatus according to a twelfth embodiment;

DETAILED DESCRIPTION OF PREFERRED EMBODIMENTS

First Embodiment

Figure 1:
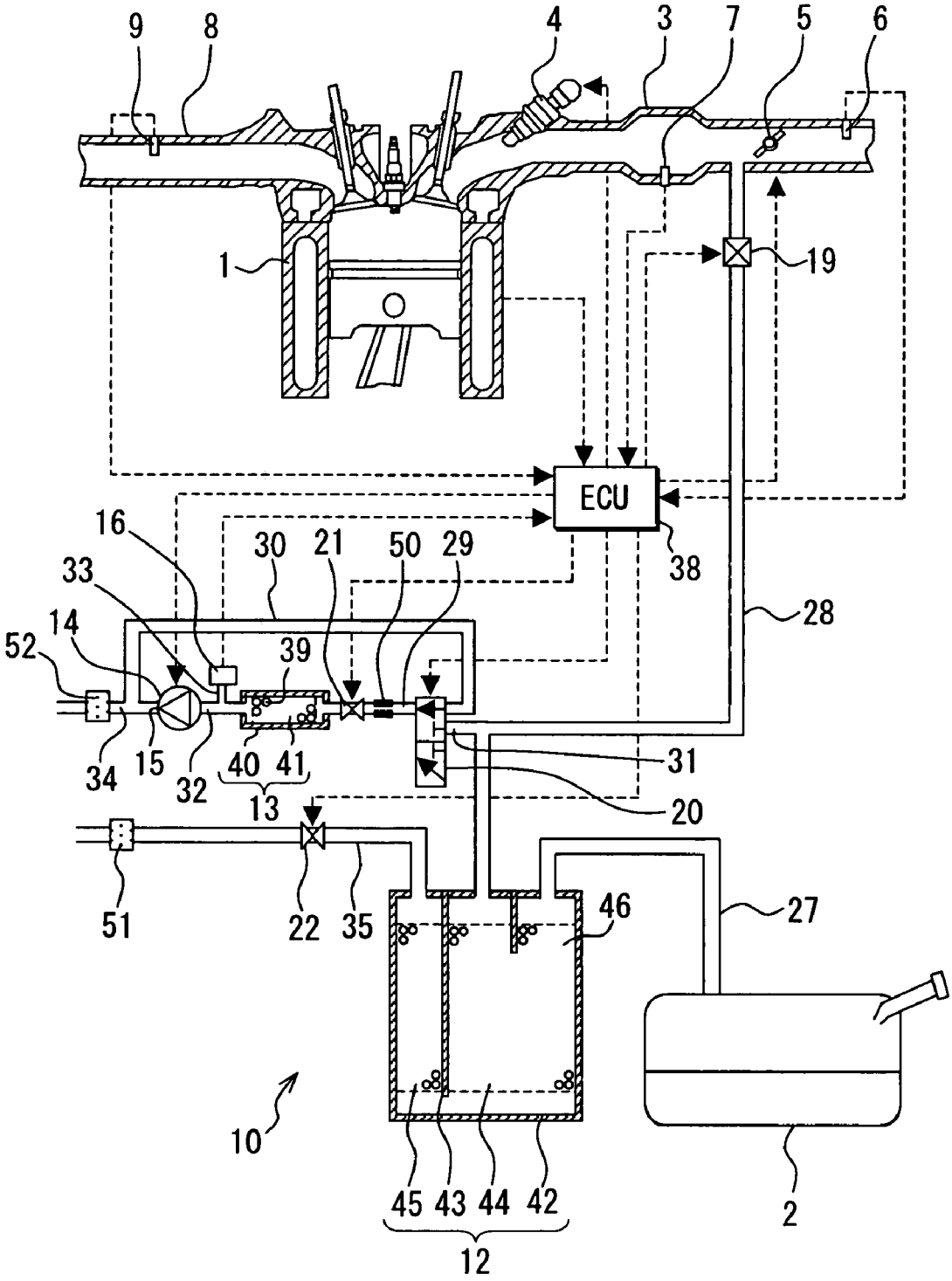
FIG. 1 is a schematic view showing a fuel vapor treatment apparatus according to a first embodiment.
Figure 2:
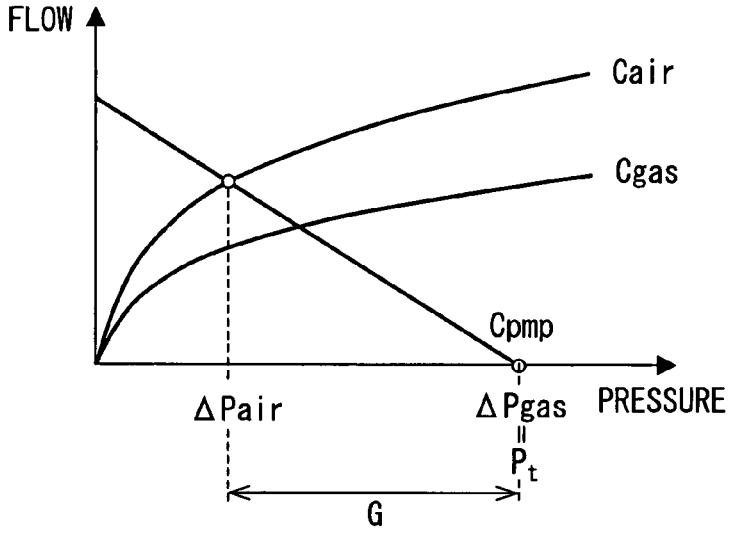
FIG. 2 is a graph showing a detection gain.

As shown in FIG. 1, in this example, a fuel vapor treatment apparatus 10 is applied to an internal combustion engine of a vehicle.

The engine 1 is, for example, a gasoline engine for generating power by using fuel such as gasoline received in a fuel tank 2. The engine 1 has an intake passage 3 provided with, for example, a fuel injection device 4, a throttle device 5, an airflow sensor 6, and an intake pressure sensor 7. The fuel injection device 4 controls an amount of fuel injection. The throttle device 5 controls an amount (intake amount) of intake air. The airflow sensor 6 detects the intake amount. The intake pressure sensor 7 detects pressure (intake pressure) of intake air. The engine 1 has an exhaust passage 8 provided with, for example, an air/fuel ratio sensor 9 for detecting an air/fuel ratio.

The fuel vapor treatment apparatus 10 processes fuel vapor, which is produced in the fuel tank 2, thereby supplying the processed fuel vapor to the engine 1. The fuel vapor treatment apparatus 10 includes multiple canisters 12, 13, a pump 14, a pressure sensor 16, multiple valves 19-22, multiple passages 27-35, and an electronic control unit (ECU) 38.

A first canister 12 has a case 42 divided by a partition wall 43 into two absorbing portions 44, 45. Each of the absorbing portions 44, 45 is filled with an absorbent 46 formed of active charcoal, or the like. The absorbing portion (main-absorbing portion) 44 communicates with an introduction passage 27 communicating with the fuel tank 2. In this structure, fuel vapor is produced in the fuel tank 2, and flows into the main-absorbing portion 44 through the introduction passage 27, so that the fuel vapor is removably absorbed to the absorbent 46 in the main-absorbing portion 44. The main-absorbing portion 44 further communicates with a purge passage 28 connecting with the intake passage 3. A purge valve 19, which has a solenoid actuator, is provided midway through the purge passage 28. The purge valve 19 opens and closes, i.e. communicates and blocks the purge passage 28 to control communication between the first canister 12 and the intake passage 3. The purge valve 19 opens, so that negative pressure in the intake passage 3 is applied from the downstream of the throttle device 5 to the main-absorbing portion 44 through the purge passage 28. The negative pressure is applied to the main-absorbing portion 44, so that vapor fuel is desorbed, i.e. removed from the absorbent 46 of the main-absorbing portion 44. The desorbed vapor fuel is mixed with air, and is introduced into the purge passage 28. Thus, fuel vapor contained in the mixture gas is purged into the intake passage 3. The fuel vapor is purged into the intake passage 3 through the purge passage 28, so that the fuel vapor is burned together with fuel, which is injected by the fuel injection device 4, in the engine 1.

A sub-absorbing portion 45 of the first canister 12 communicates with the main-absorbing portion 44 through a space in the case 42. When the purge valve 19 opens, negative pressure in the intake passage 3 is applied to the sub-absorbing portion 45 through the purge passage 28 and the main-absorbing portion 44. The sub-absorbing portion 45 connects with an open passage 35. A canister close valve 22, which includes a solenoid actuator, is provided midway through the open passage 35. The open passage 35 communicates with the atmosphere on the opposite side of the sub-absorbing portion 45 with respect to the canister close valve 22. When the canister close valve 22 opens, the sub-absorbing portion communicates with the atmosphere through the open passage 35. A filter 51 is provided between an open end of the open passage 35 and the canister close valve 22.

A passage switch valve 20 is mechanically connected with one end of an atmosphere passage 30 opening to the atmosphere through an exhaust passage 34. The passage switch valve 20 is further mechanically connected with one end of a first detection passage 29. The passage switch valve 20 includes a two-position solenoid actuator. A branch passage 31 braches from a mainstream of the purge passage 28 between the main-absorbing portion 44 and the purge valve 19. The passage switch valve 20 is further mechanically connected with the branch passage 31. The passage switch valve 20 switches communication of the first detection passage 29 with one of the atmosphere passage 30 and the branch passage 31 of the purge passage 28. The atmosphere passage 30 communicates with the first detection passage 29 in a first condition. In this first condition, air is capable of flowing from the atmosphere passage 30 into the first detection passage 29. The branch passage 31 communicates with the first detection passage 29 in a second condition. In this second condition, mixture gas containing fuel vapor is capable of flowing from the purge passage 28 into the first detection passage 29.

The pump 14 is, for example, an electric vane pump. The pump 14 has an inlet port communicating with the one end of a second detection passage 32. The pump 14 has an exhaust port 15 communicating with one end of the exhaust passage 34. The exhaust passage 34 opens to the atmosphere on the opposite side of the pump 14 with respect to a communicating portion connecting with the atmosphere passage 30. The exhaust port 15 of the pump 14 regularly opens to the atmosphere through the exhaust passage 34. When the pump 14 is operated, the pump 14 draws gas to reduce pressure in the second detection passage 32, thereby generating gas flow through the second detection passage 32, simultaneously with exhausting gas into the exhaust passage 34 through the exhaust port 15. When the pump 14 is stopped, the pump 14 communicates the second detection passage 32 with the exhaust passage 34 therethrough. A filter 52 is provided between an open end of the exhaust passage 34 and the pump 14.

The second canister 13 has a case 40 receiving an absorbing portion 41 filled with an absorbent 39 formed of active charcoal, or the like. The absorbent 39 of the second canister 13 has a volume, which is less than a total volume of the absorbent 46 of the first canister 12. An end of the first detection passage 29 on the opposite side of the passage switch valve 20 with respect to a throttle 50 communicates with an end of the second detection passage 32 on the opposite side of the pump 14 through the absorbing portion 41. When the pump 14 is operated in a condition where mixture gas exists in the first detection passage 29, negative pressure is applied from the second detection passage 32 to the first detection passage 29 through the second canister 13. Thus, mixture gas flows into the absorbing portion 41 of the second canister 13, so that fuel vapor contained in the mixture gas is removably absorbed to the absorbent 39 of the absorbing portion 41. When the purge valve 19 opens and the passage switch valve 20 is in the second condition, negative pressure in the intake passage 3 is applied to the first detection passage 29 through the purge passage 28 and the branch passage 31. In this condition, air flows from the atmosphere passage 30 into the pump 14, so that fuel vapor is removed from the absorbent 39. Fuel vapor is removed from the absorbent 39, and the removed fuel vapor is purged into the intake passage 3 through the first detection passage 29 and the purge passage 28.

The throttle 50 is provided midway through the first detection passage 29 for reducing the passage area of the first detection passage 29. A passage valve 21, which has a solenoid actuator, is provided midway through the first detecting passage 29 between the second canister 13 and the throttle 50. The passage valve 21 opens and closes to control communication between the end of the first detection passage 29 on the side of the passage switch valve 20 and the end of the first detection passage 29 on the side of the second canister 13. When the passage valve 21 closes, the passage valve 21 blocks the first detection passage 29 between the throttle 50 and the second canister 13. When the passage valve 21 opens, the passage valve 21 communicates the first detection passage 29 therethrough. Thus, the passage valve 21 blocks and communicates the first detection passage 29 between the throttle 50 and the second canister 13.

The pressure sensor 16 communicates with a connection passage 33 branching from the second detection passage 32 between the second canister 13 and the pump 14. The pressure sensor 16 detects differential pressure between pressure, which is applied from the second detection passage 32 through the connection passage 33, and the atmospheric pressure. When the pump 14 is operated and the passage valve 21 opens, pressure detected using the pressure sensor 16 is substantially equivalent to differential pressure between both ends of the throttle 50. When the passage valve 21 closes, the passage valve 21 blocks the first detection passage 29 on the suction side of the pump 14. In this condition, pressure detected using the pressure sensor 16 is substantially equivalent to shutoff pressure of the pump 14. Thus, the pressure sensor 16 is capable of detecting pressure generated using the throttle 50 and the pump 14. That is, the pressure sensor 16 is capable of detecting pressure correlated with the throttle 50 and the pump 14.

The ECU 38 is mainly constructed of a microcomputer including a CPU and a memory. The ECU 38 is electrically connected with the pump 14, the pressure sensor 16, and the valves 19-22 of the fuel vapor treatment apparatus 10. The ECU 38 is further electrically connected with components 4-7, 9 of the engine 1. The ECU 38 controls the pump 14 and the valves 19-22 in accordance with, for example, detection signals of sensors 16, 6, 7, 9. In addition, the ECU 38 controls the pump 14 and the valves 19-22 in accordance with, for example, temperature of cooling water of the engine 1, temperature of hydraulic oil of the vehicle, rotation speed of the engine 1, a throttle position of an accelerator of the vehicle, and an ON/OFF condition of an ignition switch. The ECU 38 further controls operations of the engine 1 such as an injection amount of the fuel injection device 4, the throttle position of the throttle device 5, and an ignition timing of the engine 1.

Figure 3:
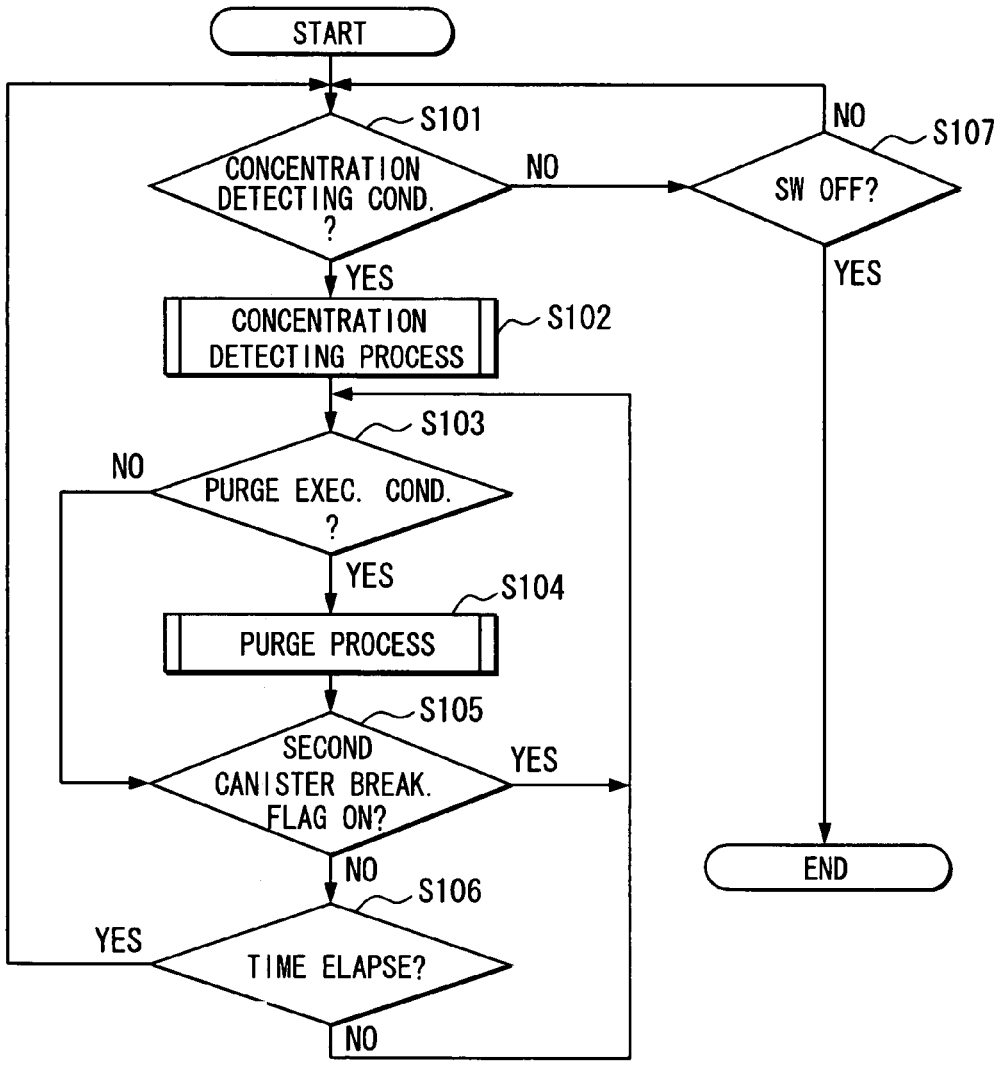
FIG. 3 is a flow chart showing a main process according to the first embodiment.

Next, a main process of the fuel vapor treatment apparatus 10 is described with reference to FIG. 3. The ECU 38 starts the main process when the engine 1 is started by turning the ignition switch ON.

In step S101, the ECU 38 evaluates whether a concentration detecting condition is satisfied. The concentration detecting condition is satisfied when a vehicle state quantity is in a predetermined range. The vehicle state quantity may include the temperature of cooling water of the engine 1, the temperature of hydraulic oil of the vehicle, the rotation speed of the engine 1, and the like. For example, the concentration detecting condition is set such that the concentration detecting condition is satisfied immediately after starting the engine 1. The concentration detecting condition is prestored in the memory of the ECU 38.

When step S101 makes a positive determination, the routine proceeds to step S102. In step 8102, the ECU 38 executes a concentration detecting process. In this concentration detecting process, the ECU 38 detects a fuel vapor concentration in the purge passage 28 in a condition where the purge valve 19 closes, and subsequently, the routine proceeds to step S103. Here, the ECU 38 evaluates whether a purge executing condition is satisfied. The purge executing condition is satisfied when the vehicle state quantity is in a predetermined range, which is different from the above predetermined range when the concentration detecting condition is satisfied. For example, the purge executing condition is set such that the purge executing condition is satisfied when warming of the engine 1 is completed after the cooling water temperature of the engine 1 becomes equal to or greater than predetermined temperature. The purge executing condition is prestored in the memory of the ECU 38.

When step S103 makes a positive determination, the routine proceeds to step S104. In step S104, the ECU 38 executes a purge process. In this purge process, fuel vapor is purged into the intake passage 3 through the purge passage 28 in a condition where the purge valve 19 opens. When a purge terminating condition is satisfied, the routine proceeds to step S105. The purge terminating condition is satisfied when the vehicle state quantity is in a predetermined range, which is different from the above predetermined range when either the concentration detecting condition or the purge executing condition is satisfied. For example, the purge terminating condition is set such that the purge terminating condition is satisfied when the vehicle decelerates in a condition where the throttle position of the accelerator becomes equal to or less the a predetermined position. The purge terminating condition is prestored in the memory of the ECU 38.

When step S103 makes a negative determination, the routine proceeds directly to step S105. In step S105, the ECU 38 evaluates whether a second canister breakthrough flag is ON to indicate that breakthrough occurs in the second canister 13. When step S105 makes a positive determination, the routine returns to step S103. When step S105 makes a negative determination, the routine proceeds to step S106. In this operation, the ECU 38 prohibits execution of the concentration detecting process in a period where the second canister breakthrough flag is ON.

In step S106, the ECU 38 evaluates whether a predetermined time elapses after completion of the concentration detecting process in step S102. When step S106 makes a positive determination, the routine returns to step S101. When step S106 makes a negative determination, the routine returns to step S103. The predetermined time, which serves as a threshold in step S106, is set in consideration of both transition of the fuel vapor concentration and requirement of accuracy of the concentration. The predetermined time is prestored in the memory of the ECU 38.

As above, the process executed when step S101 makes a positive determination is described. As follows, the process following step S107 executed when step S101 makes a negative determination is described.

Figures 4, 5:
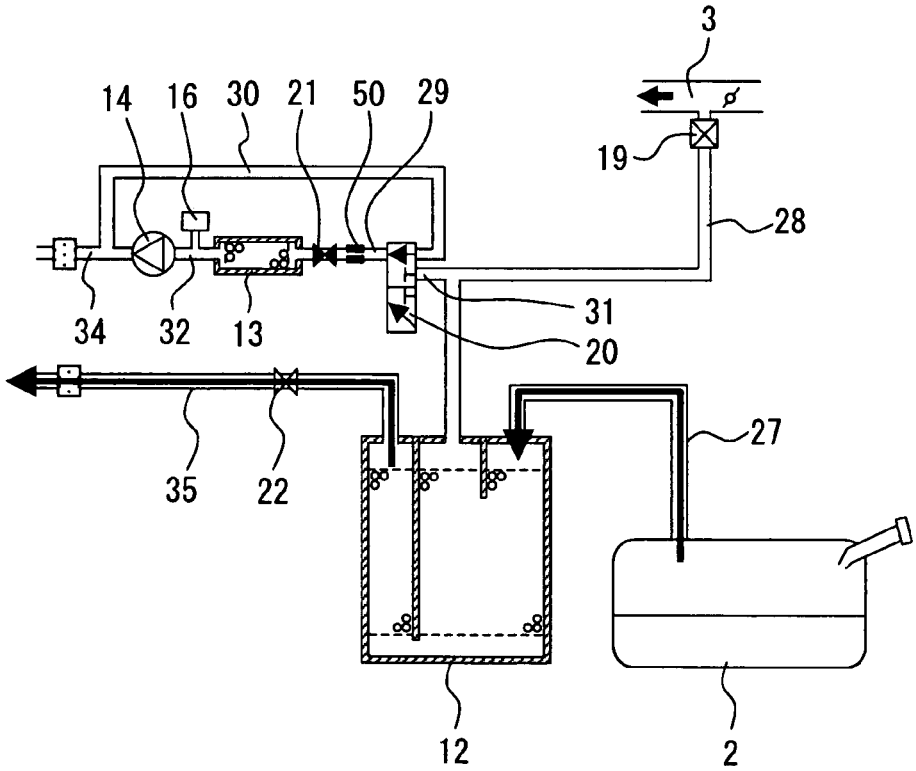
FIG. 4 is a table showing operations of components of the fuel vapor treatment apparatus according to the first embodiment.
FIG. 5 is a schematic view showing an operation of the fuel vapor treatment apparatus according to the first embodiment.

In step S107, the ECU 38 evaluates whether the ignition switch is turned OFF. When step S107 makes a negative determination, the routine returns to step S101. When step S107 makes a positive determination, the routine is terminated. After completion of the main process, the ECU 38 operates the valves 19-22, as defined by FIG. 4, in the fuel vapor treatment apparatus 10, so that the ECU 38 establishes a first canister open condition where the first canister 12 opens to the atmosphere, as shown in FIG. 5.

Figure 6:
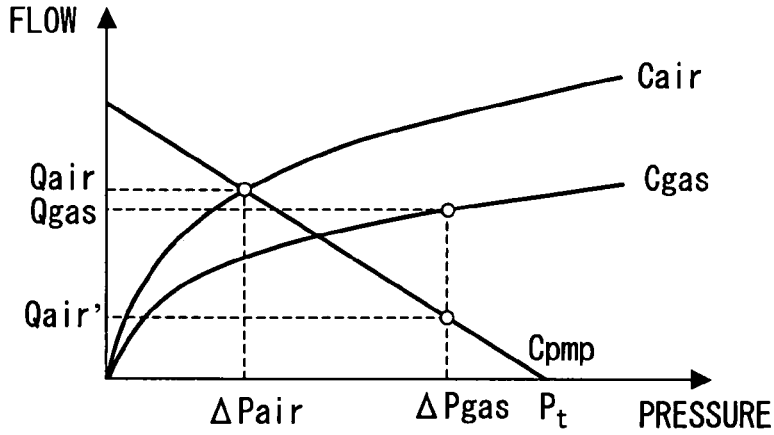
FIG. 6 is a graph showing a relationship between pressure and flow for an explanation of a concentration detecting process of the fuel vapor treatment apparatus, according to the first embodiment.

As follows, the concentration detecting process in step S102 is described in detail. The pump 14 is, for example, a vane pump causing internal leakage. In such a structure of the pump 14, internal leakage occurring in the pump 14 changes corresponding to a load applied to the pump 14. As shown in FIG. 6, a P−Q characteristic curve Cpmp of the pump 14 is defined by the following first order equation (1). In this equation (1), each K1, K2 is a constant intrinsic to the pump 14.

$$Q=K1\cdot P+K2 \tag{1}$$

The shutoff pressure of the pump 14 is Pt. When the pump 14 is shutoff, pressure P becomes Pt and a flow amount Q becomes substantially 0. According to these relationships and the equation (1), the following equation (2) can be obtained.

$$k2=-K1\cdot Pt \tag{2}$$

In the fuel vapor treatment apparatus 10, pressure loss of the gas flow is negligibly small throughout the first detection passage 29 on the side of the second canister 13, the second canister 13, and the second detection passage 32 with respect to the throttle 50. Therefore, when the passage valve 21 opens, the pressure P of the pump 14 is substantially equivalent to differential pressure ΔP between both ends of the throttle 50. When the pressure loss is not negligible, preferably, the ECU 38 prestores the pressure loss, and the ECU 38 corrects the differential pressure ΔP in accordance with the prestored pressure loss, as appropriate.

When the passage valve 21 opens and only air passes through the throttle 50, the air directly passes through the second canister 13 toward the pump 14. In this condition, a flow amount Qair of air, which passes through the second canister 13, is substantially equivalent to a flow amount Q of air drawn into the pump 14. Therefore, the flow amount Qair of air, which passes through the throttle 50, and differential pressure ΔPair satisfy the following equation (3) obtained from the equations (1), (2).

$$Q\text{air}=K1\cdot(\Delta P\text{air}-Pt) \quad (3)$$

When the passage valve 21 opens and mixture gas containing fuel vapor passes through the throttle 50, fuel vapor is absorbed through the second canister 13, and consequently, only air flows out of the second canister 13. In this condition, a flow amount Qair' of air, which is contained in the mixture gas, is substantially equivalent to the flow amount Q of air drawn into the pump 14. Therefore, the flow amount Qair' of air, when mixture gas passes through the throttle 50, and differential pressure ΔPgas satisfy the following equation (4) obtained from the equations (1), (2).

$$Q\text{air}'=K1\cdot(\Delta P\text{gas}-Pt) \quad (4)$$

The flow amount of Qair', the total flow amount Qgas of mixture gas passing through the throttle 50, and a fuel vapor concentration D (%) satisfy the following equation (5).

$$Q\text{air}'=Q\text{gas}\cdot(1-D/100) \quad (5)$$

The following equation (6) is obtained from the equation (5).

$$D=100\cdot(1-Q\text{air}'/Q\text{gas}) \quad (6)$$

The following equation (7) defines a ΔP−Q characteristic curve of gas passing through the throttle 50, using a density ρ of the gas passing through the throttle 50.

$$Q=K3\cdot(\Delta P/\rho)^{1/2} \quad (7)$$

In this equation (7), K3 is a constant intrinsic to the throttle 50. The throttle 50 has a through hole having the diameter d. The throttle 50 has a flow coefficient α. The diameter d and the flow coefficient α have a relationship defined by the following equation (8).

$$K3=\alpha\cdot\pi\cdot d^2/4\cdot 2^{1/2} \quad (8)$$

The following equation (9) defines a ΔP−Q characteristic curve Cair shown in FIG. 6, using a density pair of air.

$$Q\text{air}=K3\cdot(\Delta P\text{air}/\rho\text{air})^{1/2} \quad (9)$$

The following equation (10) defines a ΔP−Q characteristic curve Cgas shown in FIG. 6, using the density ρgas of mixture gas.

$$Q\text{gas}=K3\cdot(\Delta P\text{gas}/\rho\text{gas})^{1/2m} \quad (10)$$

Fuel vapor contains hydrocarbon (HC) in a density ρhc. The following equation (11) defines a relationship among the density ρgas of mixture gas, the density ρhc of HC, and the fuel vapor concentration D (%) in mixture gas.

$$D=100\cdot(\rho\text{air}-\rho\text{gas})/(\rho\text{air}-\rho hc) \quad (11)$$

The following equation (12) is obtained from the equations (3), (4) by eliminating the constant K1.

$$Q\text{air}/Q\text{air}'=(\Delta P\text{air}-Pt)/(\Delta P\text{gas}-Pt) \quad (12)$$

The following equation (13) is obtained from the equations (9), (10) by eliminating the constant K3.

$$Q\text{air}/Q\text{gas}=\{(\Delta P\text{air}/\Delta P\text{gas})\cdot(\rho\text{gas}/\rho\text{air})\}^{1/2} \quad (13)$$

The following equation (14) is obtained from the equations (12), (13) by eliminating the flow amount Qair.

$$Q\text{air}'/Q\text{gas}=(\Delta P\text{gas}-Pt)/(\Delta P\text{air}-Pt)\cdot\{(\Delta P\text{air}/\Delta P\text{gas})\cdot(\rho\text{gas}/\rho\text{air})\}^{1/2} \quad (14)$$

The following equation (15) is obtained from the equation (11).

$$\rho\text{gas}=\rho\text{air}-(\rho\text{air}-\rho hc)\cdot D/100 \quad (15)$$

The following equation (16) is obtained from the equations (14), (15), and (6).

$$D=100\cdot[1-P1\cdot\{P2\cdot(1-\rho\cdot D)\}^{1/2}] \quad (16)$$

The following equations (17), (18), and (19) respectively define P1, P2, and ρ in the equation (16).

$$P1=(\Delta P\text{gas}-Pt)/(\Delta P\text{air}-Pt) \quad (17)$$

$$P2=\Delta P\text{air}/\Delta P\text{gas} \quad (18)$$

$$\rho=(\rho\text{air}-\rho hc)/(100\cdot\rho\text{air}) \quad (19)$$

The following second order equation (20) is obtained by multiplying each term of the equation (16) by itself.

$$D^2+100\cdot(100\cdot P1^2\cdot P2\cdot\rho-2)\cdot D+100^2\cdot(1-P1^2\cdot 2)=0 \quad (20)$$

The following solution (21) is obtained from the equation (20).

$$D=50\cdot\{-M1\pm(M1^2-4\cdot M2)^{1/2}\} \quad (21)$$

The following equations (22), (23) define M1, M2 in the solution (21).

$$M1=100\cdot P1^2\cdot P2\cdot\rho-2 \quad (22)$$

$$M2=1-P1^2\cdot P2 \quad (23)$$

One of the solution (21) of the second order equation (20) being out of the range between 0 and 100 cannot hold true. Therefore, the other of the solution (21) within the range between 0 and 100, as defined by the following equation (24), can be obtained for calculating the fuel vapor concentration D.

$$D=50\cdot\{-M1-(M1^2-4\cdot M2)^{1/2}\} \quad (24)$$

In the equation (24) of the fuel vapor concentration D, the variables ρair, ρhc included in M1, M2 are predetermined as physical constants. In this embodiment, the ECU 38 stores the variables ρair, ρhc as a part of the equation (24). When the ECU 38 calculates the fuel vapor concentration D on the basis of the equation (24), the variables of the differential pressure ΔPair, ΔPgas, and the shutoff pressure Pt of the pump 14, included in M1, M2, are needed. As described above, the differential pressure ΔPair, ΔPgas is substantially equivalent to pressure detected using the pressure sensor 16. Therefore, in the concentration detecting process in step S102, the ECU 38 obtains the differential pressure ΔPair, ΔPgas, and the shutoff pressure Pt using the pressure sensor 16, so that the ECU 38 calculates the fuel vapor concentration D in accordance with these variables.

Figure 7:
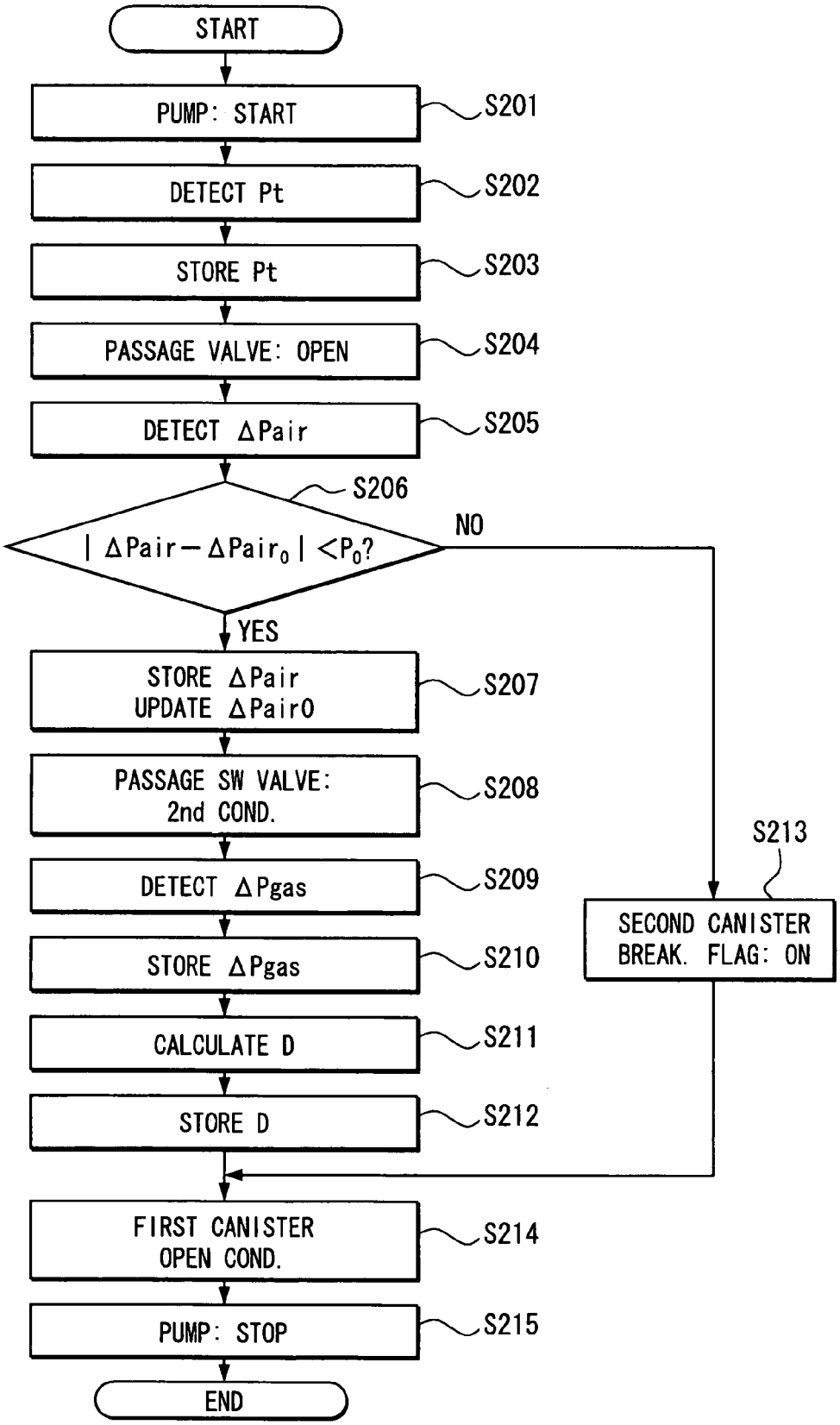
FIG. 7 is a flow chart showing a concentration detecting process according to the first embodiment.

Next, the concentration detecting process is described with reference to FIG. 7. Referring to FIG. 4, when the ECU 38 starts the concentration detecting process, the ECU 38 establishes the first canister open condition where the purge valve 19 and the passage valve 21 are closed, the passage switch valve 20 is in the first condition, and the canister close valve 22 is opened.

Figure 8:
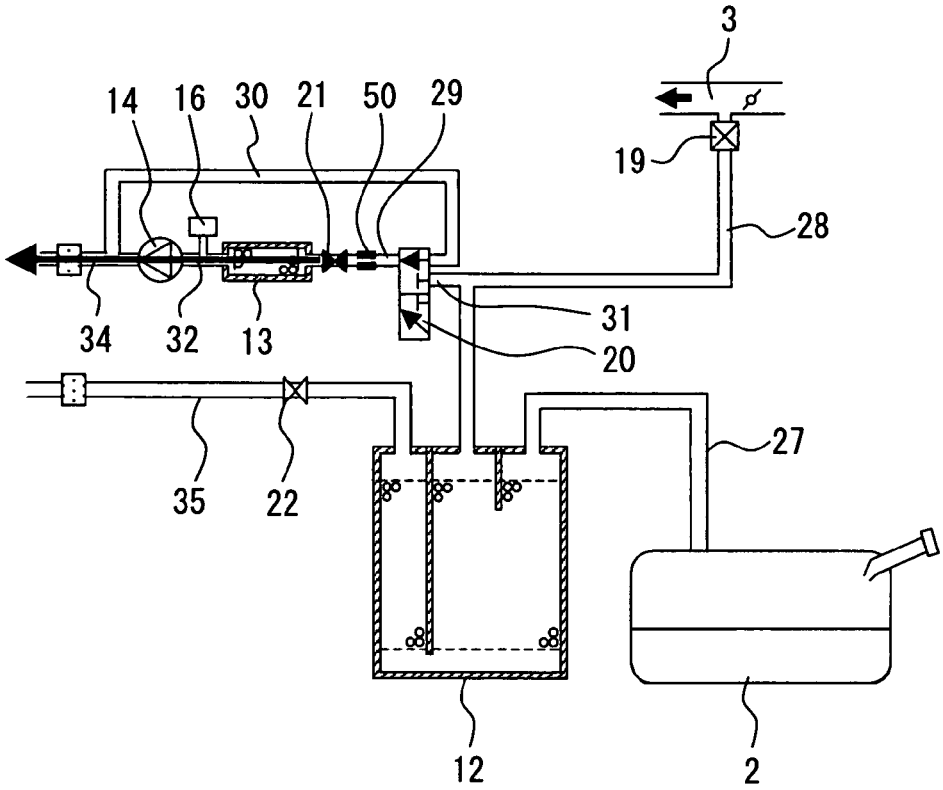
FIG. 8 is a schematic view showing an operation of the fuel vapor treatment apparatus according to the first embodiment.
Figure 9:
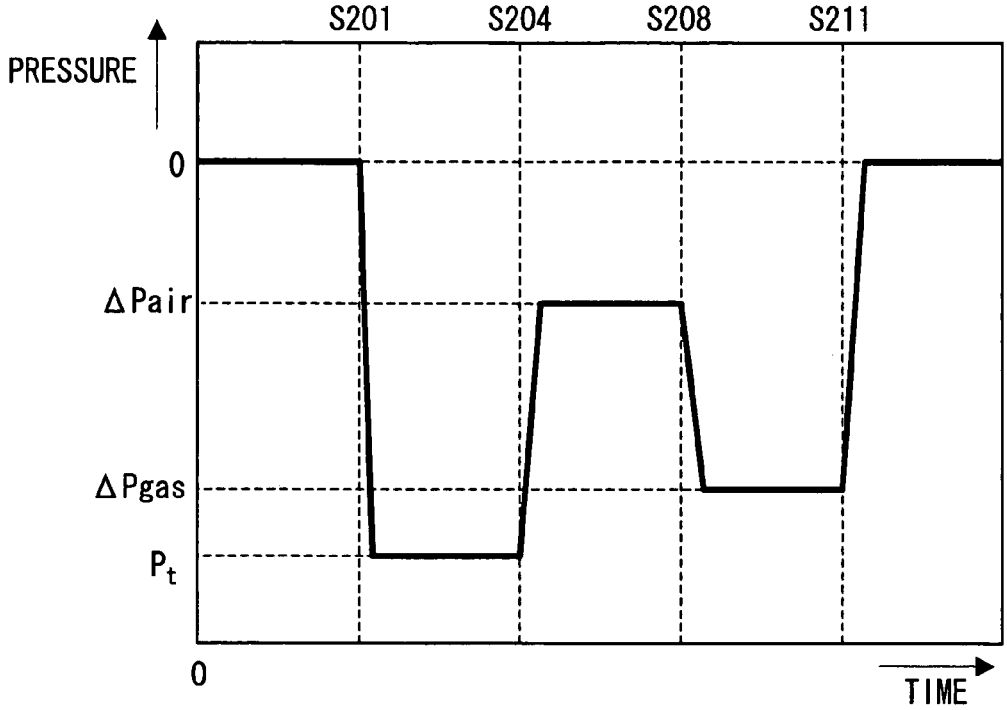
FIG. 9 is a time chart showing pressure changing in the concentration detecting process of the fuel vapor treatment apparatus according to the first embodiment.

In step S201, the ECU 38 starts operation of the pump 14 to reduce pressure in the second detection passage 32. In this condition, the valves 19-22 are in the first canister open condition, as shown in FIG. 4, in the beginning of the concentration detecting process. As shown in FIG. 8, in this condition, the first detection passage 29 is blocked. Therefore, as shown in FIG. 9, the pressure detected using the pressure sensor 16 changes to the shutoff pressure Pt of the pump 14. In step S202, when the detection pressure of the pressure sensor 16 becomes constant, the ECU 38 obtains the detection pressure as the shutoff pressure Pt. In step S203, the ECU 38 stores the shutoff pressure Pt.

Figure 10:
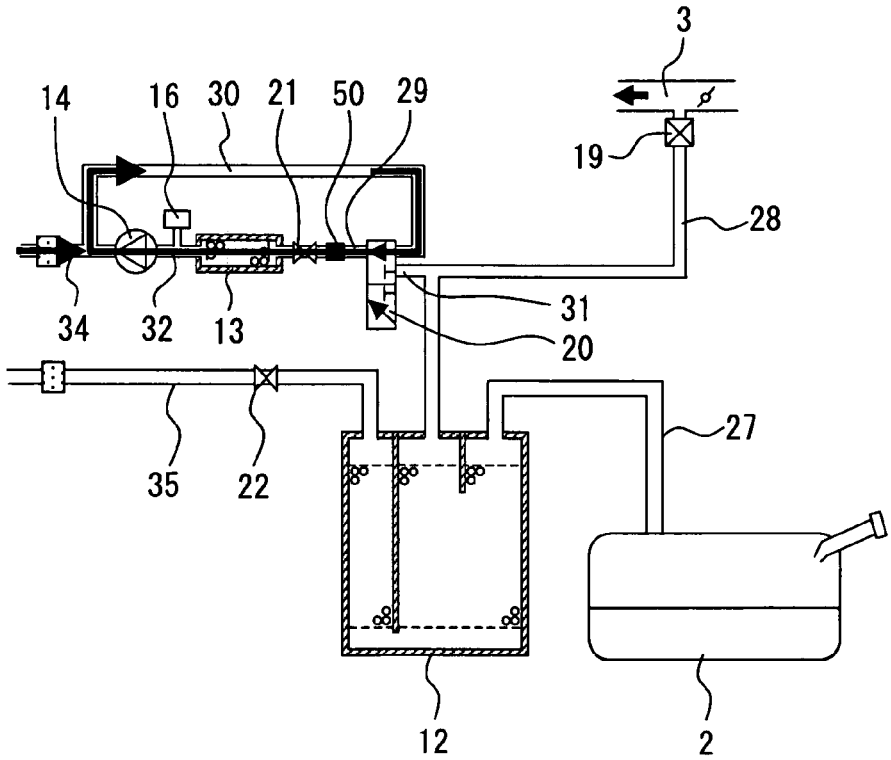
FIG. 10 is a schematic view showing an operation of the fuel vapor treatment apparatus according to the first embodiment.

In step S204, the ECU 38 opens the passage valve 21 while maintaining operation of the pump 14. Thus, the valves 19-22 are in the condition shown in FIG. 4. The second detection passage 32, which is reduced in pressure using the pump 14, communicates with the first detection passage 29 and the atmosphere passage 30 through the second canister 13. In this condition, as shown in FIG. 10, air flows from the atmosphere passage 30, and the air passes through the throttle 50. As shown in FIG. 9, the detection pressure of the pressure sensor 16 changes to the predetermined differential pressure ΔPair. In step S205, when the detection pressure of the pressure sensor 16 becomes constant, the ECU 38 obtains the detection pressure as first pressure ΔPair.

In step S206, the ECU 38 evaluates whether difference between the first pressure ΔPair and predetermined first pressure reference ΔPair0 is less than an allowable threshold P0. Thus, the ECU 38 detects fuel vapor exhausted from the second canister 13 into the second detection passage 32.

Figure 11:
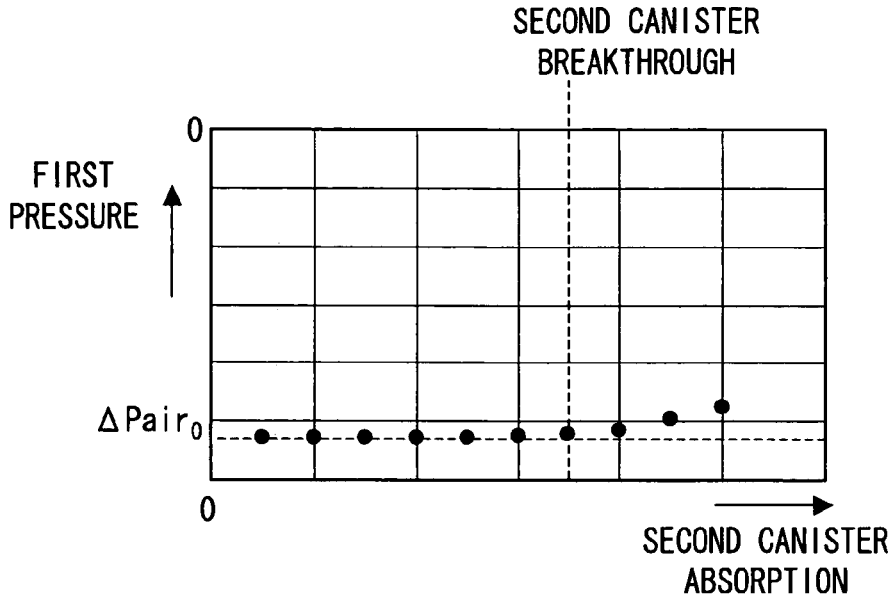
FIG. 11 is a graph showing a relationship between first pressure and an amount of fuel vapor absorbed in a second canister of the fuel vapor treatment apparatus, according to the first embodiment.

Specifically, when breakthrough occurs in the second canister 13 and air passes through the second canister 13 by executing step S204, fuel vapor absorbed to the second canister 13 is exhausted into the second detection passage 32 together with the air passing through the second canister 13. When the exhausted fuel vapor is drawn into the pump 14 having a structure such as a vane pump, internal leakage of the pump 14 changes in dependence upon viscosity of mixture gas drawn into the pump 14. Correspondingly, the P–Q characteristic also changes. Consequently, as shown in FIG. 11, when the amount (second canister absorption) of fuel vapor absorbed in the second canister 13 increases to cause breakthrough in the second canister 13, the first pressure ΔPair increases from the first pressure reference ΔPair0 toward the atmospheric pressure. Accordingly, the ECU 38 cannot accurately calculate the fuel vapor concentration in accordance with the P–Q characteristic.

Therefore, in step S206, the ECU 38 compares difference between the first pressure ΔPair and the first pressure reference ΔPair0 with the allowable threshold P0. The first pressure reference ΔPair0 is a predicted value of the first pressure ΔPair in a condition where fuel vapor is not exhausted from the second canister 13. In this comparison, when the difference between the first pressure ΔPair and the first pressure reference ΔPair0 is less than the allowable threshold P0, the ECU 38 determines the second canister 13 to be in an absorbable condition. Thus, the ECU 38 determines to be capable of properly calculating the fuel vapor concentration by accurately detecting the first pressure ΔPair. Thus, the routine proceeds to step S207. When the difference between the first pressure ΔPair and the first pressure reference ΔPair0 is equal to or greater than the allowable threshold P0, the ECU 38 determines that breakthrough occurs in the second canister 13 to exhaust fuel vapor therefrom. Thus, the ECU 38 determines to be incapable of properly calculating the concentration. Thus, the routine proceeds to step S213.

The ECU 38 obtains multiple values of the first pressure ΔPair, which are determined to be normal in previous step S206, from the latest one in order, so that the ECU 38 calculates the first pressure reference ΔPair0 by averaging the multiple values of the first pressure ΔPair. The number of the values of the first pressure ΔPair may be five, for example. In this operation, the ECU 38 is capable of obtaining the first pressure reference ΔPair0 in conformity to the latest P–Q characteristic. Thus, even when the P–Q characteristic varies from an initial characteristic thereof due to aging of the pump 14, the ECU 38 is capable of obtaining the first pressure reference ΔPair0 in consideration of influence caused by the variation in P–Q characteristic. The allowable threshold P0 is set in consideration of requirement of accuracy of the fuel vapor concentration D, detection accuracy of the pressure sensor 16, and the like, in addition to factors such as noise and an ambient condition causing variation in the calculation. The allowable threshold P0 is prestored in the memory of the ECU 38.

When step S206 makes a positive determination, the routine proceeds to step S207. In step S207, the ECU 38 stores the first pressure ΔPair, which is accurately detected, in the memory. In addition, in step S207, the ECU 38 updates the averaged multiple values by using the present accurately calculated first pressure ΔPair, thereby calculating the latest first pressure reference ΔPair0. The ECU 38 stores the first pressure reference ΔPair0 in the memory.

Figure 12:
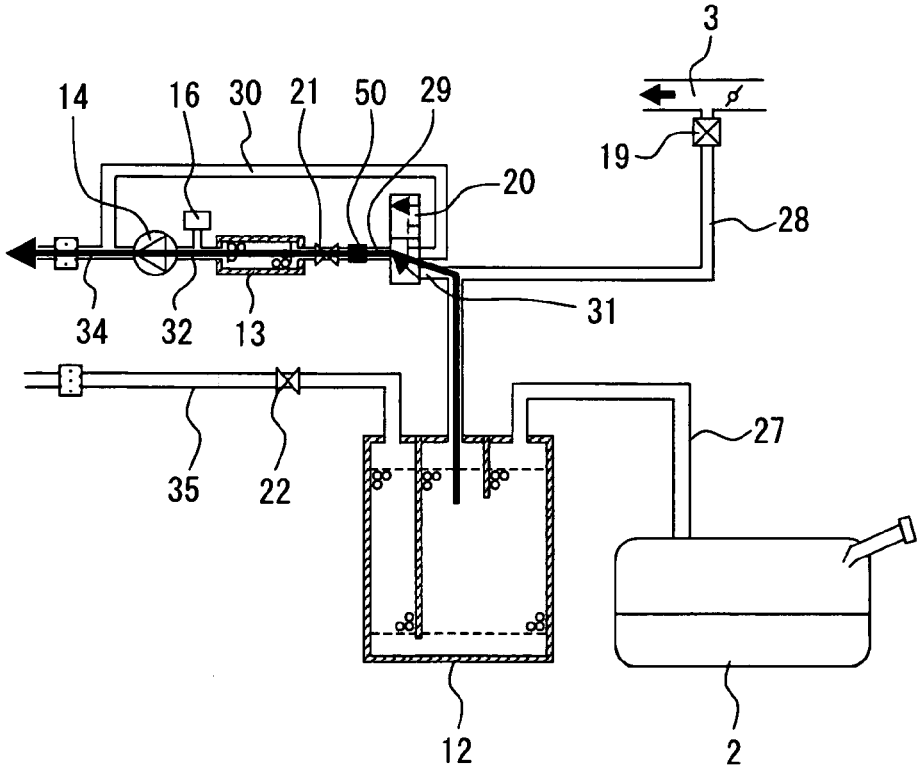
FIG. 12 is a schematic view showing an operation of the fuel vapor treatment apparatus according to the first embodiment.

In step S208, the ECU 38 switches the passage switch valve 20 to be in the second condition. Thus, the valves 19-22 are in the condition shown in FIG. 4. In this second condition, as shown in FIG. 12, mixture gas containing fuel vapor flows from the branch passage 31 of the purge passage 28 into the first detection passage 29. As shown in FIG. 9, the detection pressure of the pressure sensor 16 changes to the differential pressure ΔPgas corresponding to the fuel vapor concentration D. In step S209, when the detection pressure of the pressure sensor 16 becomes constant, the ECU 38 obtains the detection pressure as the second pressure ΔPgas. In step S210, the ECU 38 stores the second pressure ΔPgas in the memory.

In step S211, the ECU 38 calculates the fuel vapor concentration D by substituting the variables Pt, ΔPair, Δgas, which are stored in the memory, into the equation (24). In step S212, the ECU 38 stores the calculated fuel vapor concentration D in the memory, and subsequently, the routine proceeds to step S214.

In step S214, the ECU 38 operates the valves 19-22 to be in the first canister open condition, as shown in FIG. 4. In step S215, the ECU 38 stops the pump 14. Thus, the routine is terminated.

As above, the process, when step S206 makes a positive determination, is described. When step S206 makes a negative determination, the routine proceeds to step S213. In step S213, the ECU 38 turns a second canister breakthrough flag ON and stores the second canister breakthrough flag in the memory. Subsequently, the routine proceeds to step S214. In this operation, when breakthrough occurs in the second canister 13, the ECU 38 closes the passage valve 21 in step S214. Thus, fuel vapor in the second canister 13 can be restricted from being exhausted to the atmosphere through the atmosphere passage 30. Furthermore, when breakthrough occurs in the second canister 13, the ECU 38 stops the pump 14 in step S215 subsequent to step S214. Thus, fuel vapor in the second canister 13 can be restricted from being drawn into the pump 14 and being exhausted to the atmosphere.

Figure 13:
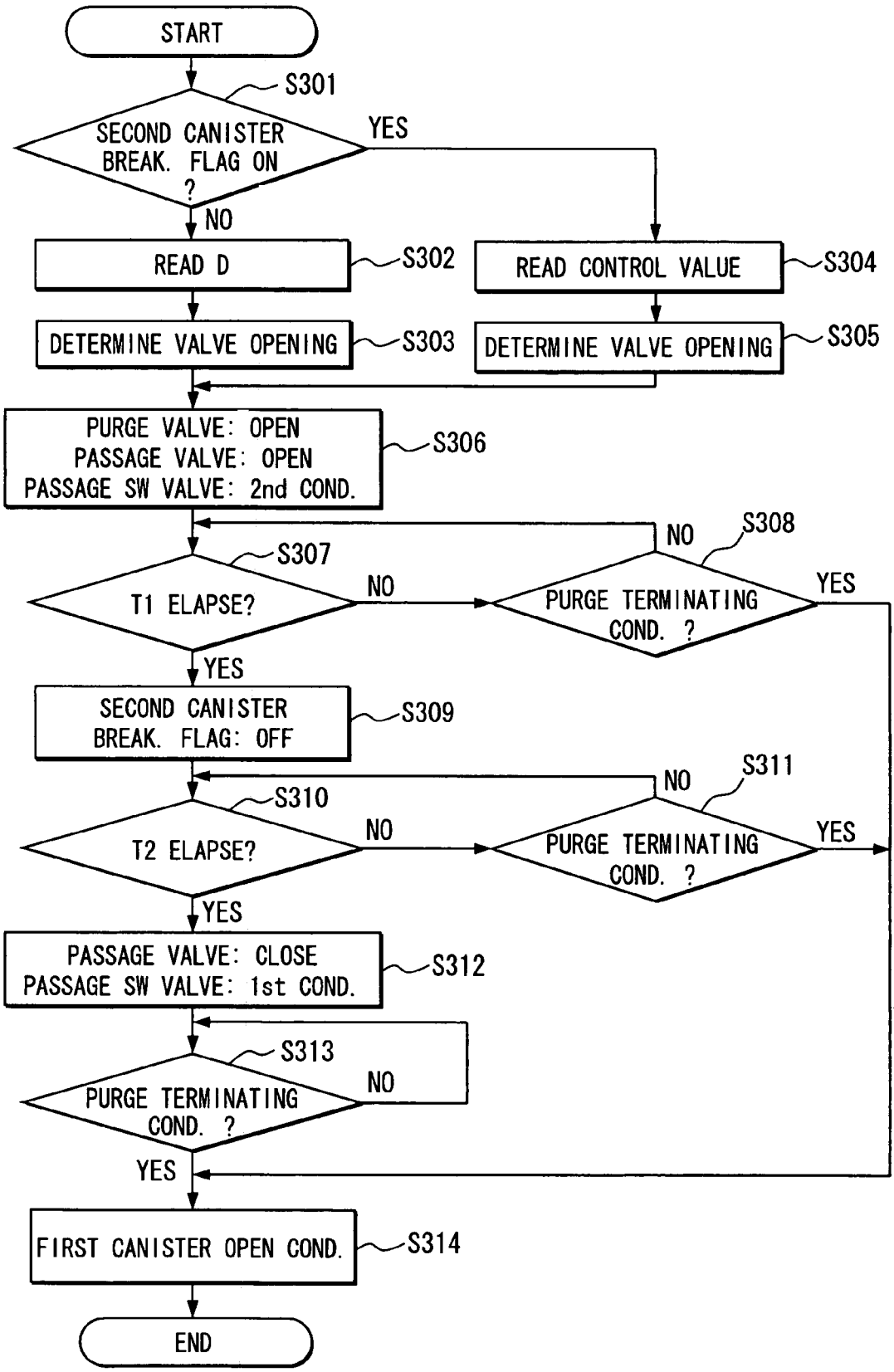
FIG. 13 is a flow chart showing a purge process according to a first embodiment.

As follows, the purge process in step S104 is described in detail with reference to FIG. 13. The valves 19-22 are in the first canister open condition, as shown in FIG. 4, in the beginning of the purge process.

In step S301, the ECU 38 evaluates whether the second canister breakthrough flag is ON. When the second canister breakthrough flag is OFF so that step S301 makes a negative determination, the ECU 38 determines to permit a purge control in accordance with the fuel vapor concentration D. Thus, the routine proceeds to step S302. In step S302, the ECU 38 reads the fuel vapor concentration D, which is stored in the memory in the immediately preceding concentration detecting process. In step S303, the ECU 38 determines opening (valve opening) of the purge valve 19 in accordance with the fuel vapor concentration D, which is read from the memory, and the vehicle state quantity such as the throttle position.

When the second canister breakthrough flag is ON so that step S301 makes a positive determination, the ECU 38 determines to prohibit the purge control in accordance with the fuel vapor concentration D. Thus, the routine proceeds to step S304. In step S304, the ECU 38 reads a purge control value, which is stored in the memory. In step S305, the ECU 38 determines the valve opening in accordance with the purge control value, which is read from the memory, and the vehicle state quantity. In this operation, when breakthrough occurs in the second canister 13, the ECU 38 determines the valve opening by ignoring the fuel vapor concentration D, which is obtained in accordance with the detection pressure ΔPair, ΔPgas, and Pt of the pressure sensor 16. For example, the purge control value is set such that the valve opening becomes maximum in a range in which the valve opening does not exert effect to the air/fuel ratio. The purge control value is prestored in the memory of the ECU 38.

The valve opening, which is determined in steps S303, S305, is an initial value of a first purge process. The ECU 38 controls the valve opening in the subsequent purge process, in accordance with the vehicle state quantity and the air/fuel ratio detected using the air/fuel ratio sensor 9, as needed.

Figure 14:
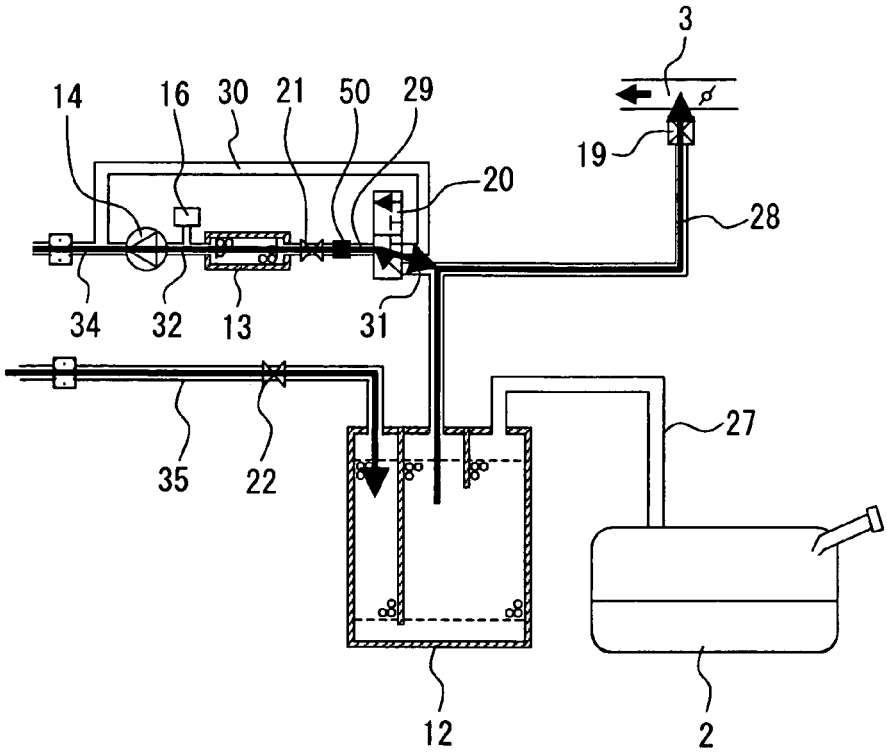
FIG. 14 is a schematic view showing an operation of the fuel vapor treatment apparatus according to the first embodiment.

In step S306, which follows to either one of step S303, S305, the ECU 38 opens both the purge valve 19 and the passage valve 21, and switches the passage switch valve 20 to be in the second condition. Thus, the ECU 38 starts the first purge process. The valves 19-22 are in the condition shown in FIG. 4. As shown in FIG. 14, negative pressure in the intake passage 3 is applied to the second canister 13 through the first detection passage 29, and is also applied to the first canister 12. In this operation, fuel vapor absorbed in the second canister 13 and fuel vapor remaining in the first detection passage 29 are introduced into the purge passage 28, and are purged into the intake passage 3 together with fuel removed from the first canister 12. In this first purge process, fuel vapor is purged from the first detection passage 29, in addition to recovering an absorbing capacity of the second canister 13.

In step S307, the ECU 38 evaluates whether a predetermined time T1 elapses after starting of the first purge process. The predetermined time T1 is set at a minimum period needed for recovering the second canister 13 from a breakthrough condition to be in the absorbable condition. The predetermined time T1 is prestored in the memory of the ECU 38.

When step S307 makes a negative determination, the routine proceeds to step S308. In step S308, the ECU 38 evaluates whether a purge terminating condition is satisfied. When step S308 makes a negative determination, the routine returns to step S307. In steps S307, S308, the ECU 38 continues the purge process until the predetermined time T1 elapses, as long as the purge terminating condition is not satisfied.

When step S307 makes a positive determination by executing the first purge process for the predetermined time T1, the ECU 38 determines that the second canister 13 is recovered to be in the absorbable condition. In step S309, the ECU 38 turns the second canister breakthrough flag OFF and stores the second canister breakthrough flag in the memory. In step S310, the ECU 38 evaluates whether a predetermined time T2 elapses after starting of the first purge process. The predetermined time T2 is set at a minimum period needed for completely removing fuel vapor from the second canister 13. The predetermined time T2 is prestored in the memory of the ECU 38.

When step S310 makes a negative determination, the routine proceeds to step S311. In step S311, the ECU 38 evaluates whether the purge terminating condition is satisfied. When step S311 makes a negative determination, the routine returns to step S310. In steps S310, S311, the ECU 38 continues the purge process until the predetermined time T2 elapses, as long as the purge terminating condition is not satisfied.

Figure 15:
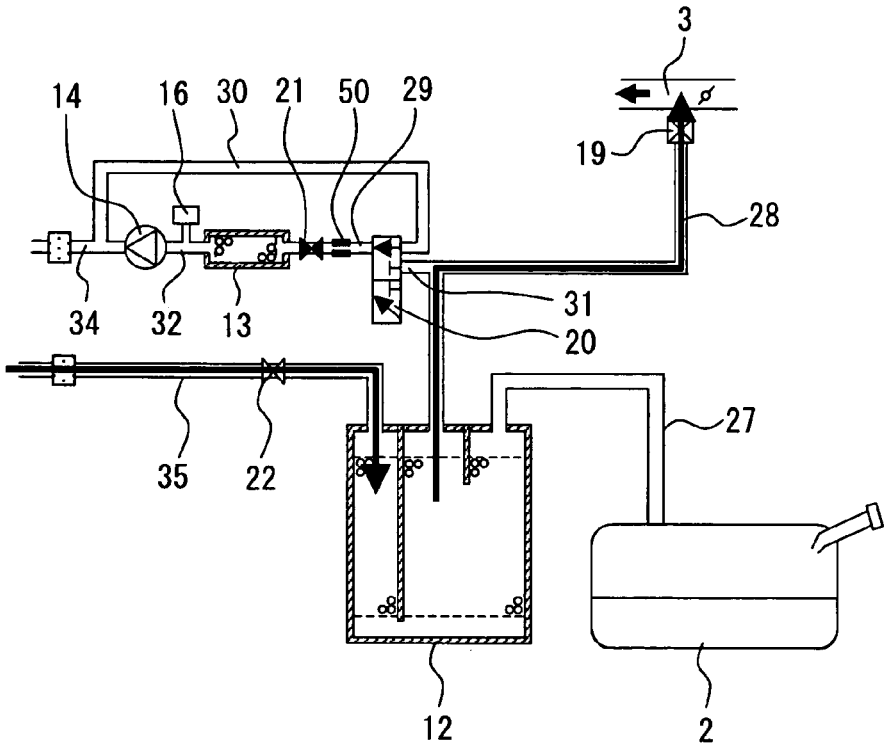
FIG. 15 is a schematic view showing an operation of the fuel vapor treatment apparatus according to the first embodiment.

When step S310 makes a positive determination by executing the first purge process for the predetermined time T2, the ECU 38 determines that fuel vapor is completely removed from the second canister 13. Thus, the routine proceeds to step S312. In step S312, the ECU 38 executes the second purge process by operating the passage switch valve 20 to be in the first condition, and closing the passage valve 21. The valves 19-22 are in the condition shown in FIG. 4. As shown in FIG. 15, negative pressure in the intake passage 3 is applied to the first canister 12, so that fuel vapor removed from the first canister 12 is purged into the intake passage 3. In this operation, negative pressure can be concentratedly applied to the first canister 12, in which fuel vapor remains, after completely removing fuel vapor from the second canister 13. Thus, minimum period, which is needed for completely removing fuel vapor from the first canister 12, can be reduced.

In step S313, the ECU 38 evaluates whether the purge terminating condition is satisfied. When step S313 makes a negative determination, the routine repeats step S313. In step S313, the ECU 38 continues the purge process until the purge terminating condition is satisfied.

When either S308, S311, or S313 makes a positive determination, the routine proceeds to step S314. In step S314, the ECU 38 operates the valves 19-22 to be in the first canister open condition, as shown in FIG. 4. Thus, the purge process is terminated.

In this first embodiment, when the ECU 38 does not detect fuel vapor exhausted from the second canister 13 to the second detection passage 32, the ECU 38 controls the purge process on the basis of the fuel vapor concentration D, which is obtained in accordance with the detection pressure ΔPair, ΔPgas, and Pt of the pressure sensor 16. The fuel vapor concentration D is a physical constant effective to a purge amount. In this operation, the ECU 38 is capable of conducting the purge process such that the ECU 38 preferably controls the air/fuel ratio of the engine 1.

In this first embodiment, when the ECU 38 detects fuel vapor, which is exhausted to the second detection passage 32, the ECU 38 prohibits the purge process controlled on the basis of the fuel vapor concentration D. The ECU 38 alternatively conducts the purge process on the basis of the predetermined value. When fuel vapor is exhausted into the second detection passage 32, accuracy of the detection pressure ΔPair, ΔPgas, and Pt may decrease, and consequently, accuracy of the fuel vapor concentration D may also decrease. Even in this condition, the ECU 38 is capable of conducting the purge control, regardless of the decrease in accuracy.

Therefore, the operation of the engine 1 can be protected from influence caused by fuel vapor exhausted to the second detection passage 32. Furthermore, the purge amount can be enhanced within the limited purge period.

In this first embodiment, when the ECU 38 detects fuel vapor, which is exhausted to the second detection passage 32, the ECU 38 maintains the second canister breakthrough flag ON until the absorbing capacity of the second canister 13 is recovered by executing the first purge process. The ECU 38 prohibits both execution of the concentration detecting process and operation of the pump 14 in a condition where the second canister breakthrough flag is ON. In this operation, the pump 14 can be restricted from drawing fuel vapor through the second detection passage 32. Thus, performance of the pump 14 can be maintained, and air pollution can be restricted. The ECU 38 prohibits the purge process controlled on the basis of the fuel vapor concentration D in a period where the second canister breakthrough flag is ON. Thus, the operation of the engine 1 can be steadily protected from influence caused by exhaust of fuel vapor.

In this first embodiment, the ECU 38 detects fuel vapor exhausted into the second detection passage 32 on the basis of the first pressure ΔPair detected using the pressure sensor 16. The ECU 38 detects the first pressure ΔPair in a condition where the pump 14 draws air after passing through the throttle 50. In this operation, as shown in FIG. 11, when fuel vapor is exhausted into the second detection passage 32 and drawn into the pump 14, the first pressure ΔPair significantly changes.

Therefore, the ECU 38 is capable of accurately detecting exhaust of fuel vapor when detecting in accordance with the first pressure ΔPair. In this first embodiment, the ECU 38 determines to detect exhaust of fuel vapor when the difference between the first pressure ΔPair and the first pressure reference ΔPair0, detected in a condition where fuel vapor is not exhausted, is equal to or greater than the allowable threshold P0. Therefore, the ECU 38 is capable of further accurately detecting exhaust of fuel vapor in view of an allowance in detection of the first pressure ΔPair by the allowable threshold P0.

In this first embodiment, the first pressure ΔPair, which is used for detecting exhaust of fuel vapor, is also used for calculating the fuel vapor concentration D for the purge control. Therefore, an additional sensor for detecting exhaust of fuel vapor need not be provided, so that manufacturing cost can be reduced.

In this first embodiment, the pump 14 serves as a gas flow generating unit. The pressure sensor 16 serves as a pressure detecting unit. The ECU 38 serves as either an exhaust detecting unit, a purge control unit, or a pressure reduction control unit. The passage switch valve 20 serves as a passage switching unit. The passage valve 21 serves as either a first passage open/close unit or a passage open/close unit.

(Modification of First Embodiment)

In this first embodiment, the ECU 38 may use the previous one accurately detected first pressure ΔPair as the first pressure reference ΔPair0. Alternatively, the ECU 38 may use a predetermined value, which is stored in the ECU 38, as the first pressure reference ΔPair0. In the latter case, the first pressure reference ΔPair0 need not be updated.

In this first embodiment, the shutoff pressure Pt, the first pressure ΔPair, and the second pressure ΔPgas may be continuously or randomly detected in a different order.

In this first embodiment, the ECU 38 may control a parameter, such as rotation speed of the pump 14, relevant to pump characteristics, when the ECU 38 operates the pump 14.

Second Embodiment

Figure 16:
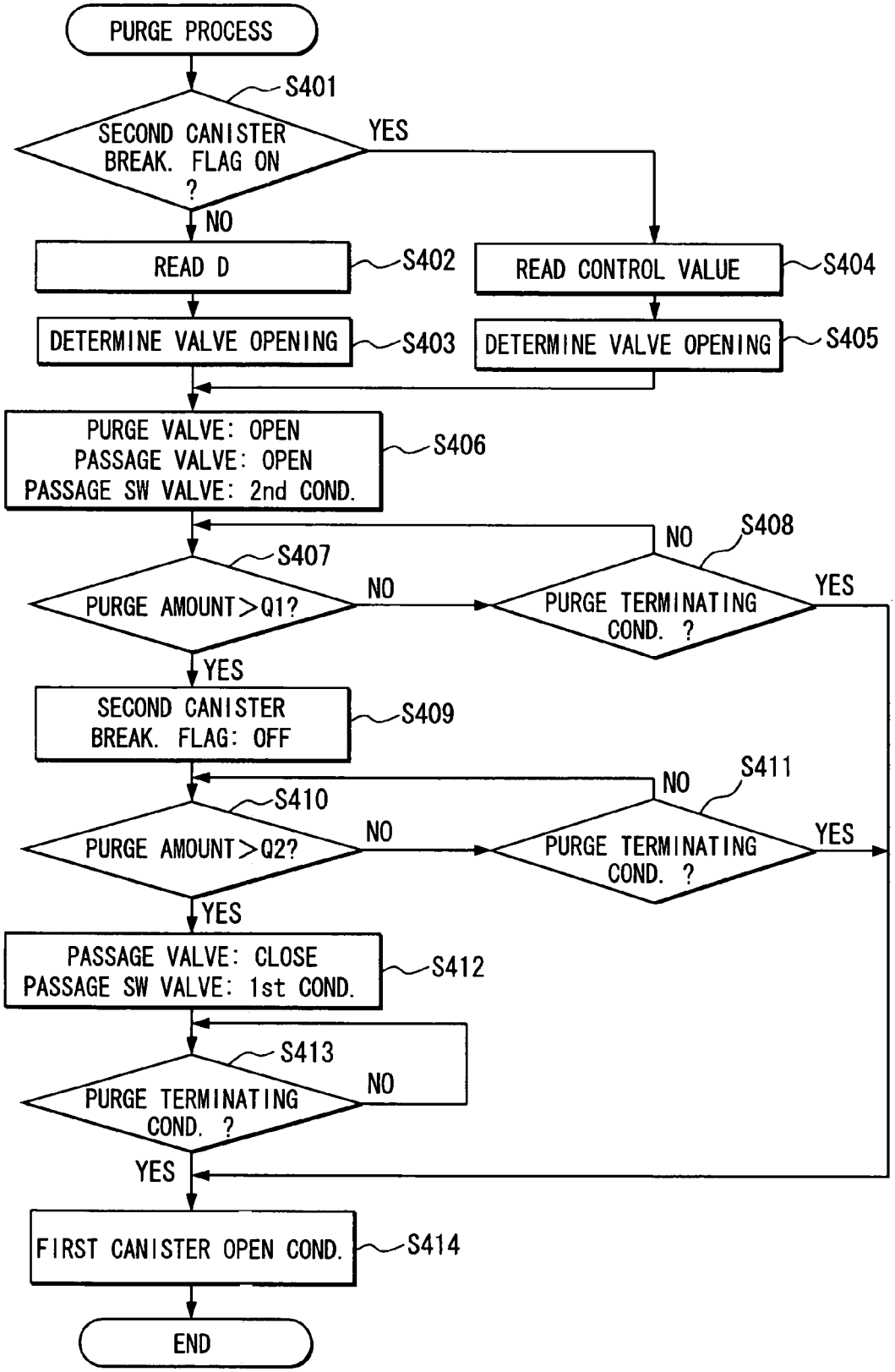
FIG. 16 is a flow chart showing a purge process according to a second embodiment.

This second embodiment is a modification of the first embodiment. Specifically, as shown in FIG. 16, in this second embodiment, the purge process is different from that of the first embodiment.

In step S407, which is an alternative of step S307 in the first embodiment, the ECU 38 evaluates whether a purge gas amount from starting of the first purge process is greater than a set amount Q1. The ECU 38 may calculate this purge gas amount in accordance with, for example, a flow amount of gas passing through the second canister 13. Alternatively, the ECU 38 may calculate the purge gas amount in accordance with, for example, a ratio between the flow amount of gas passing through the first canister 12 and the flow amount of gas passing through the second canister 13. Alternatively, the ECU 38 may calculate the purge gas amount in accordance with, for example, a flow amount of gas purged into the intake passage 3. For example, the set amount Q1 is set at a minimum purge gas amount needed for recovering the second canister 13 from a breakthrough condition to be in an absorbable condition. The set amount Q1 is prestored in the memory of the ECU 38.

When step S407 makes a negative determination, the routine proceeds to step S408, which is substantially equivalent to step S308 in the first embodiment. In this operation, the ECU 38 continues the purge process until the purge gas amount becomes greater than the set amount Q1, as long as the purge terminating condition is not satisfied. When step S407 makes a positive determination, the ECU 38 determines that the second canister 13 is recovered to be in the absorbable condition. In step S409, which is substantially equivalent to step S309 in the first embodiment, the ECU 38 turns the second canister breakthrough flag OFF.

In step S410, which is an alternative of step S310 in the first embodiment, the ECU 38 evaluates whether the purge gas amount from starting of the first purge process is greater than a set amount Q2. The set amount Q2 is set at a minimum purge gas amount needed for completely removing fuel vapor from the second canister 13. The set amount Q2 is prestored in the memory of the ECU 38.

When step S410 makes a negative determination, the routine proceeds to step S411, which is substantially equivalent to step S311 in the first embodiment. In this operation, the ECU 38 continues the purge process until the purge gas amount becomes greater than the set amount Q2, as long as the purge terminating condition is not satisfied. When the purge gas amount becomes greater than the set amount Q2, and step S410 makes a positive determination, the ECU 38 determines that fuel vapor is completely removed from the second canister 13. Thus, the routine proceeds to step S412.

Each of steps S401 to S406, S412 to S414 is substantially equivalent to each of steps S301 to S306, S312 to S314 in the first embodiment.

In this second embodiment, the ECU determines the absorbing capacity of the second canister 13, which is in the breakthrough condition, to be recovered in accordance with the purge gas amount correlating with an amount of fuel removed from the second canister 13. Therefore, even when the purge gas amount is excessive or insufficient due to variation in pressure in the intake passage 3, pressure loss in the purge passage 28, and the like, the ECU 38 is capable of properly determining the recovery of the absorbing capacity.

Third Embodiment

Figure 17:
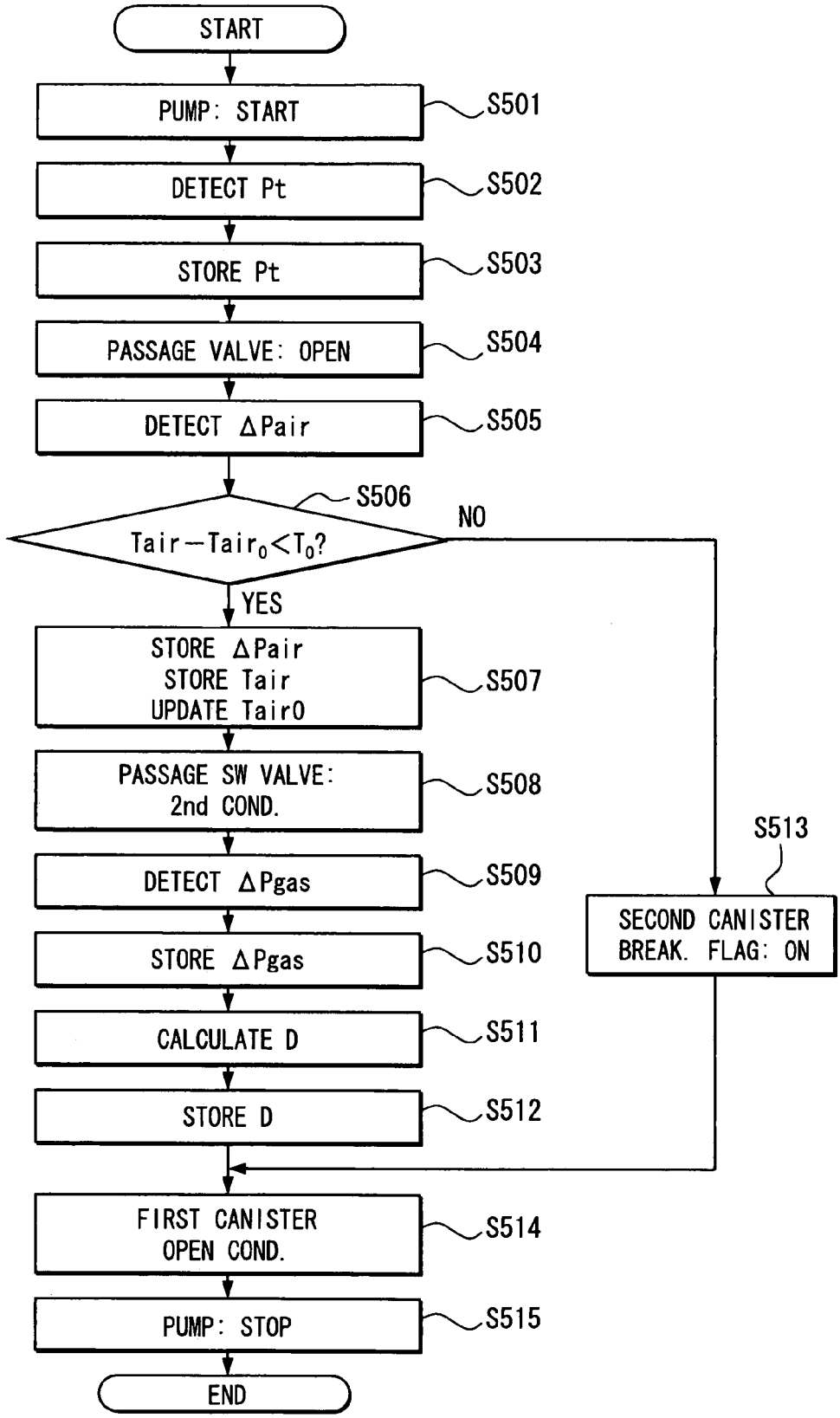
FIG. 17 is a flow chart showing a concentration detecting process according to a third embodiment.

This third embodiment is a modification of the first embodiment. Specifically, as shown in FIG. 17, in this third embodiment, the concentration detecting process is different from that of the first embodiment.

In step S506, which is an alternative of step S206 in the first embodiment, the ECU 38 obtains a minimum period Tair needed until the first pressure ΔPair becomes constant after opening the passage valve 21 in step S504, which is substantially equivalent to step S204 in the first embodiment. In step S506, the ECU 38 evaluates whether difference between the minimum period Tair and a minimum period reference Tair0 is less than an allowable threshold T0. Thus, the ECU 38 detects fuel vapor exhausted from the second canister 13 into the second detection passage 32.

Specifically, step S504 and the like are executed, and fuel vapor is exhausted from the second canister 13, which is in a breakthrough condition, into the second detection passage 32. The fuel vapor is drawn into the pump 14, and consequently, the P–Q characteristic changes. In this condition, the first pressure ΔPair also keeps changing. When the P–Q characteristic becomes constant, the first pressure ΔPair also becomes constant. Therefore, as shown in FIG. 18, when breakthrough occurs in the second canister 13, the minimum period Tair, which is needed until the first pressure ΔPair becomes constant, becomes long.

Therefore, in step S506, the ECU 38 compares difference between the minimum period Tair and the minimum period reference Tair0 with the allowable threshold T0. The minimum period Tair is a predicted value of the minimum period Tair in a condition where fuel vapor is not exhausted from the second canister 13. In this comparison, when the difference between the minimum period Tair and the minimum period reference Tair0 is less than the allowable threshold T0, the ECU 38 determines the second canister 13 to be in an absorbable condition. Thus, the ECU 38 determines to be capable of properly calculating the concentration by accurately detecting the first pressure ΔPair. Thus, the routine proceeds to step S507. When the difference between the minimum period Tair and the minimum period reference Tair0 is equal to or greater than the allowable threshold T0, the ECU 38 determines that breakthrough occurs in the second canister 13 to exhaust fuel vapor therefrom. Thus, the ECU 38 determines to be incapable of properly calculating the concentration. Thus, the routine proceeds to step S513. The ECU 38 calculates the minimum period reference Tair0 by obtaining multiple values of the minimum period Tair of the first pressure ΔPair, which are determined to be normal in previous step S506, from the latest one in order, and averaging the multiple values of the minimum period Tair. The number of the values of the minimum period Tair may be five, for example. In this operation, the ECU 38 is capable of obtaining the minimum period reference Tair0 in conformity to the latest P–Q characteristic. Thus, even when the P–Q characteristic varies from an initial characteristic thereof, the ECU 38 is capable of obtaining the minimum period reference Tair0 in consideration of influence caused by the variation in P–Q characteristic. The allowable threshold T0 is set in consideration of requirement of accuracy of the fuel vapor concentration D, detection accuracy of the pressure sensor 16, and the like, in addition to factors causing variation in the calculation. The allowable threshold T0 is prestored in the memory of the ECU 38.

When step S506 makes a positive determination, the routine proceeds to step S507, which is an alternative of step S207 in the first embodiment. In step S507, the ECU 38 stores the first pressure ΔPair, which is accurately detected, and the minimum period Tair of the accurately detected first pressure ΔPair in the memory. In addition, in step S507, the ECU 38 updates the averaged multiple values by using the minimum period Tair of the accurately detected first pressure ΔPair, thereby calculating the minimum period reference Tair0. The ECU 38 stores the minimum period reference Tair0 in the memory.

Each of steps S501 to S503, S505, S508 to S515 is substantially equivalent to each of steps S201 to S203, S205, S208 to S215 in the first embodiment.

In this third embodiment, the ECU 38 detects fuel vapor exhausted into the second detection passage 32 on the basis of the minimum period Tair of the first pressure ΔPair detected using the pressure sensor 16. The ECU 38 detects the first pressure ΔPair in a condition where the pump 14 draws air after passing through the throttle 50. In this operation, as shown in FIG. 18, when fuel vapor is exhausted into the second detection passage 32 and drawn into the pump 14, the minimum period Tair becomes long. Therefore, the ECU 38 is capable of accurately detecting exhaust of fuel vapor when detecting in accordance with the minimum period Tair. In this third embodiment, the ECU 38 determines to detect exhaust of fuel vapor when the difference between the minimum period Tair and the minimum period reference Tair0, detected in a condition where fuel vapor is not exhausted, is equal to or greater than the allowable threshold T0. Therefore, the ECU 38 is capable of further accurately detecting exhaust of fuel vapor in view of an allowance in detection of the minimum period Tair by the allowable threshold T0.

(Modification of Third Embodiment)

In this third embodiment, the ECU 38 may use the minimum period Tair of the previous one accurately detected first pressure ΔPair as the minimum period reference Tair0. Alternatively, the ECU 38 may use a predetermined value, which is stored in the ECU 38, as the minimum period reference Tair0. In the latter case, the minimum period reference Tair0 need not be updated.

Fourth Embodiment

Figure 19:
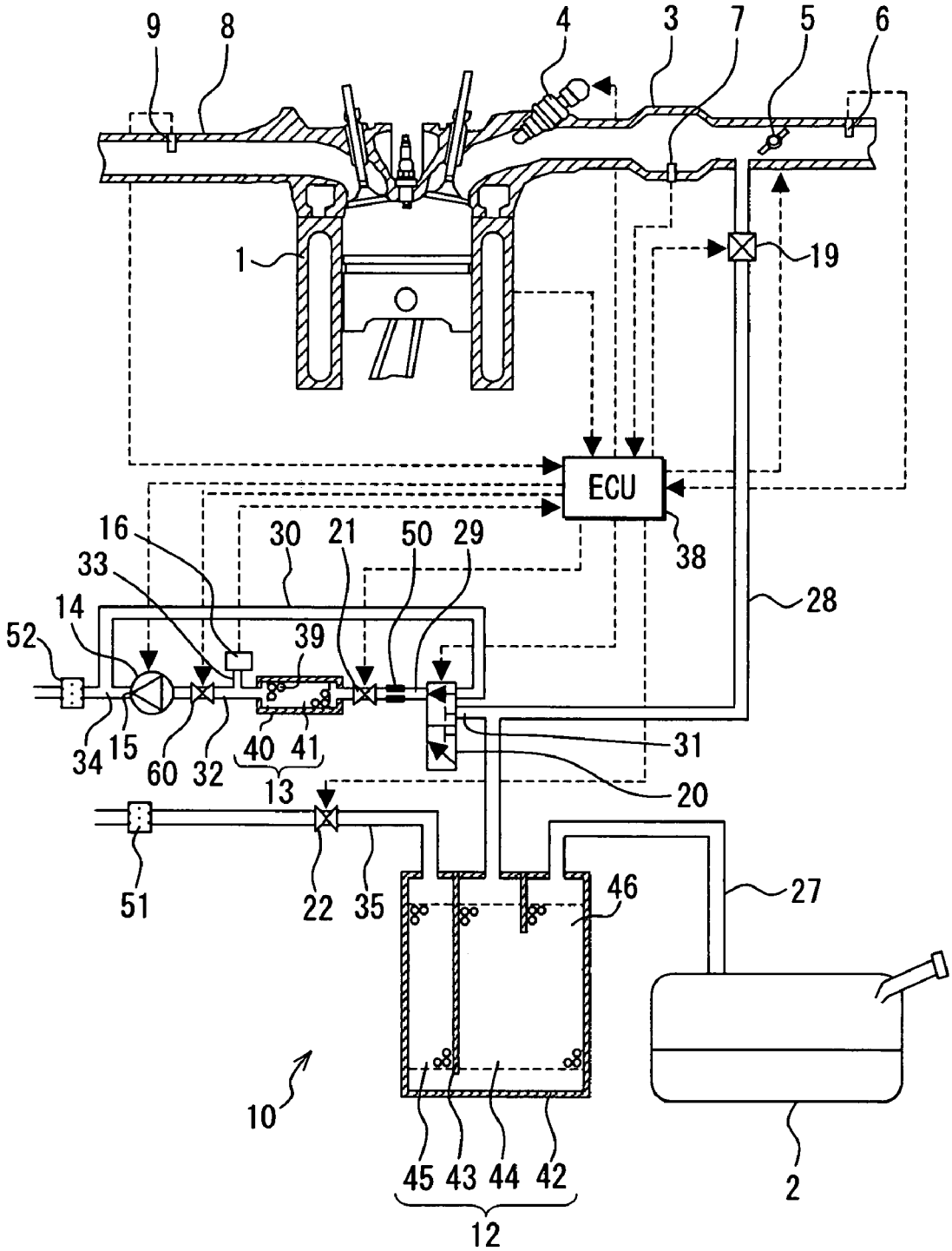
FIG. 19 is a schematic view showing a fuel vapor treatment apparatus according to a fourth embodiment.

This fourth embodiment is a modification of the first embodiment. Specifically, as shown in FIG. 19, in this fourth embodiment, the structure of the fuel vapor treatment apparatus 10 is different from that of the first embodiment.

Specifically, a passage valve 60 having a solenoid actuator is provided between the second canister 13 and the pump 14 in the second detection passage 32. The passage valve 60 is electrically connected with the ECU 38. The passage valve 60 opens and closes to control communication between the end of the second detection passage 32 on the side of the pump 14 and the end of the second detection passage 32 on the side of the second canister 13. When the passage valve 60 closes, the passage valve 60 blocks the second detection passage 32 between the pump 14 and the second canister 13. When the passage valve 60 opens, the passage valve 60 communicates the second detection passage 32 therethrough. In this operation, the passage valve 60 communicates and blocks the second detection passage 32 between the pump 14 and the second canister 13. In this fourth embodiment, the passage valve 21, which is provided to the first detection passage 29, is defined as a first passage valve 21, and the passage valve 60 is defined as a second passage valve 60, so as to distinguish the passage valve 60 from the passage valve 21.

Referring to FIG. 20, in this fourth embodiment, the ECU 38 establishes the first canister open condition where the purge valve 19 and the first passage valve 21 are closed, the passage switch valve 20 is in the first condition, and the canister close valve 22 is opened. In addition, the ECU 38 operates the second passage valve 60 in accordance with the second canister breakthrough flag being turned ON or OFF. When the second canister breakthrough flag is turned ON, the ECU 38 closes the second passage valve 60, thereby blocking the second detection passage 32 between the second canister 13 and the pump 14. In this operation, fuel vapor can be restricted from being exhausted, e.g., diffused from the second canister 13, which is in a breakthrough condition, into the pump 14. Thus, the characteristic of the pump 14 can be maintained. In addition, fuel vapor can be restricted from being exhausted to the atmosphere through the pump 14. When the second canister breakthrough flag is turned OFF, the ECU 38 opens the second passage valve 60.

Figure 21:
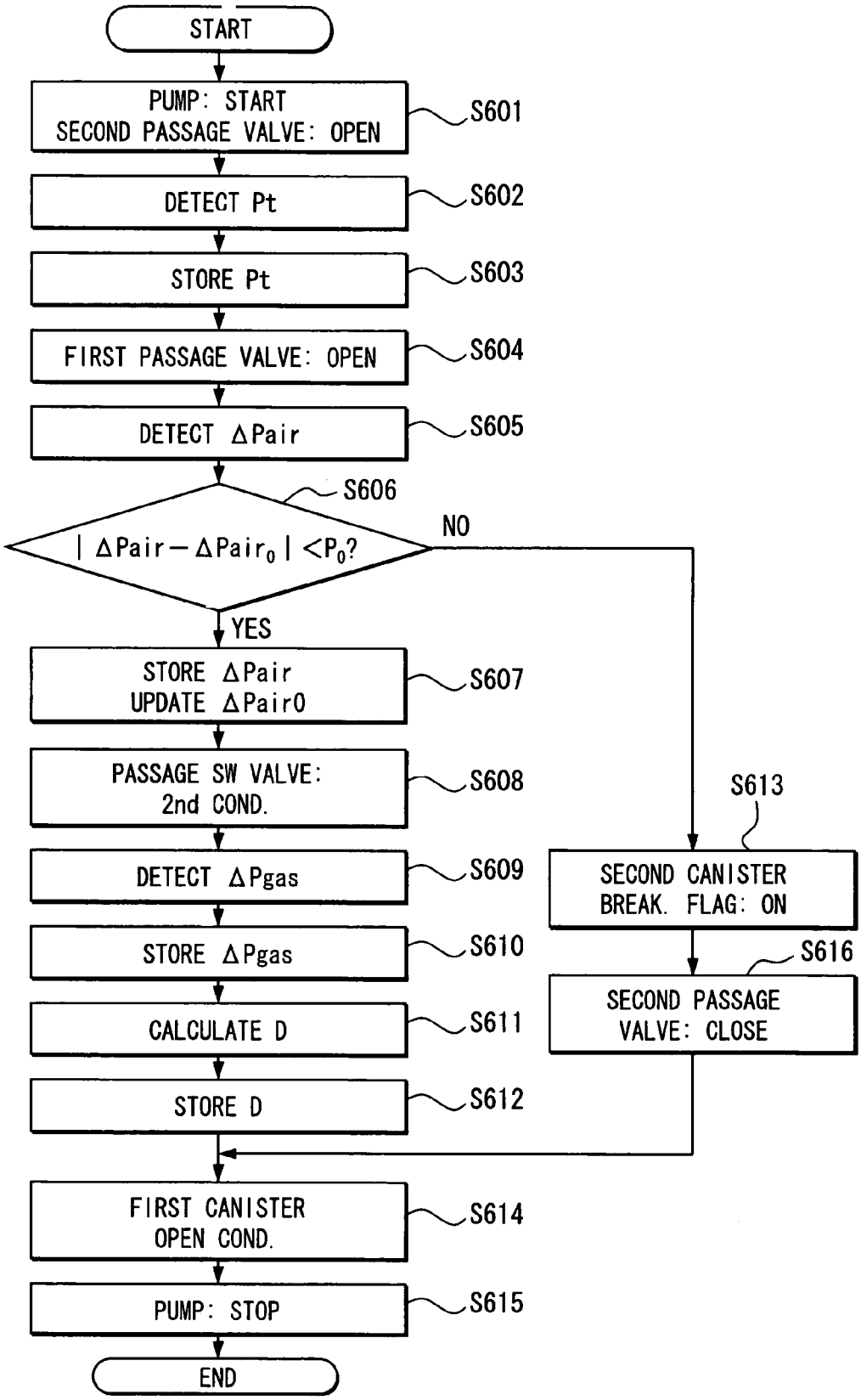
FIG. 21 is a flow chart showing a concentration detecting process according to a fourth embodiment.

In this fourth embodiment, as shown in FIGS. 20, 21, the concentration detecting process is different from that of the first embodiment.

In step S601, which is an alternative of step S201 in the first embodiment, the ECU 38 starts operation of the pump 14, and opens the second passage valve 60.

In step S613, which is substantially equivalent to step S213 in the first embodiment, the ECU 38 turns the second canister breakthrough flag ON. Subsequently, in step S616, the ECU 38 closes the second passage valve 60. In this operation, the second canister 13 is blocked from the pump 14, so that fuel vapor can be restricted from being exhausted from the second canister 13, which is in a breakthrough condition, into the pump 14. Thus, the characteristic of the pump 14 can be maintained. In addition, fuel vapor can be restricted from being exhausted to the atmosphere through the pump 14.

Each of steps S602 to S612, S614, S615 is substantially equivalent to each of steps S202 to S212, S214, S215 in the first embodiment.

Figure 22:
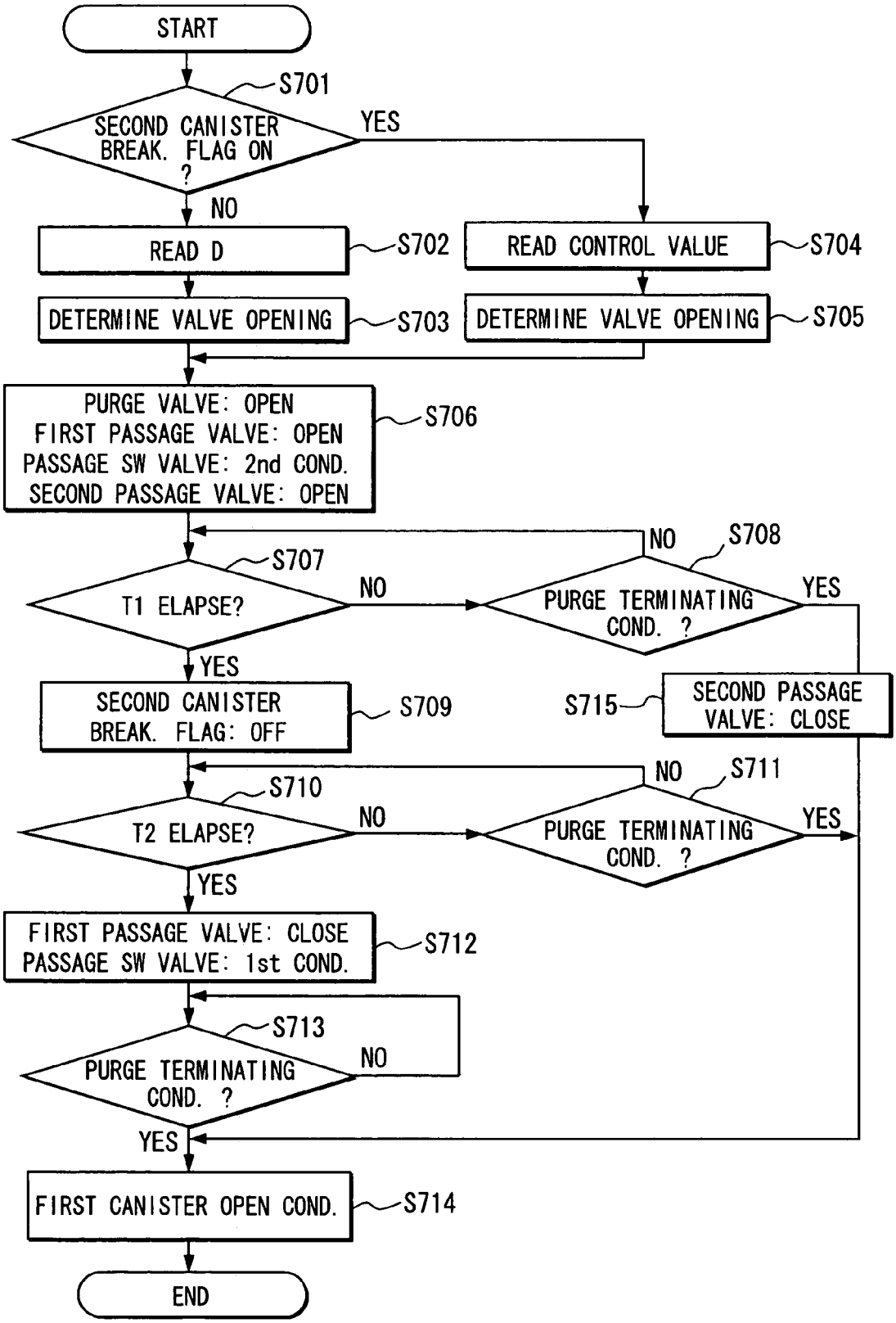
FIG. 22 is a flow chart showing a purge process according to a fourth embodiment.

In this fourth embodiment, as shown in FIGS. 20, 22, the purge process is different from that of the first embodiment.

In step S706, which is an alternative of step S306 in the first embodiment, the ECU 38 opens the second passage valve 60, in addition to opening of both the purge valve 19 and the first passage valve 21, and switching of the passage switch valve 20 to the second condition.

In step S708, which is an alternative of step S308 in the first embodiment, even when the predetermined time T1 does not elapse after starting of the first purge process, and the second canister 13 is not recovered to be in the absorbable condition, the ECU 38 may determine the purge executing condition to be satisfied. Therefore, in step S715, the ECU 38 closes the second passage valve 60, thereby blocking the second canister 13 from the pump 14. In this operation, when the absorbing capacity of the second canister 13 is not recovered, fuel vapor in the second canister 13 can be restricted from being exhausted into the pump 14. Thus, the characteristic of the pump 14 can be maintained. In addition, fuel vapor can be restricted from being exhausted to the atmosphere through the pump 14.

Each of steps S701 to S705, S707, S709 to S714 is substantially equivalent to each of steps S301 to S305, S307, S309 to S314 in the first embodiment.

In this fourth embodiment, the second passage valve 60 serves as a second passage open/close unit.

Fifth Embodiment

Figure 23:
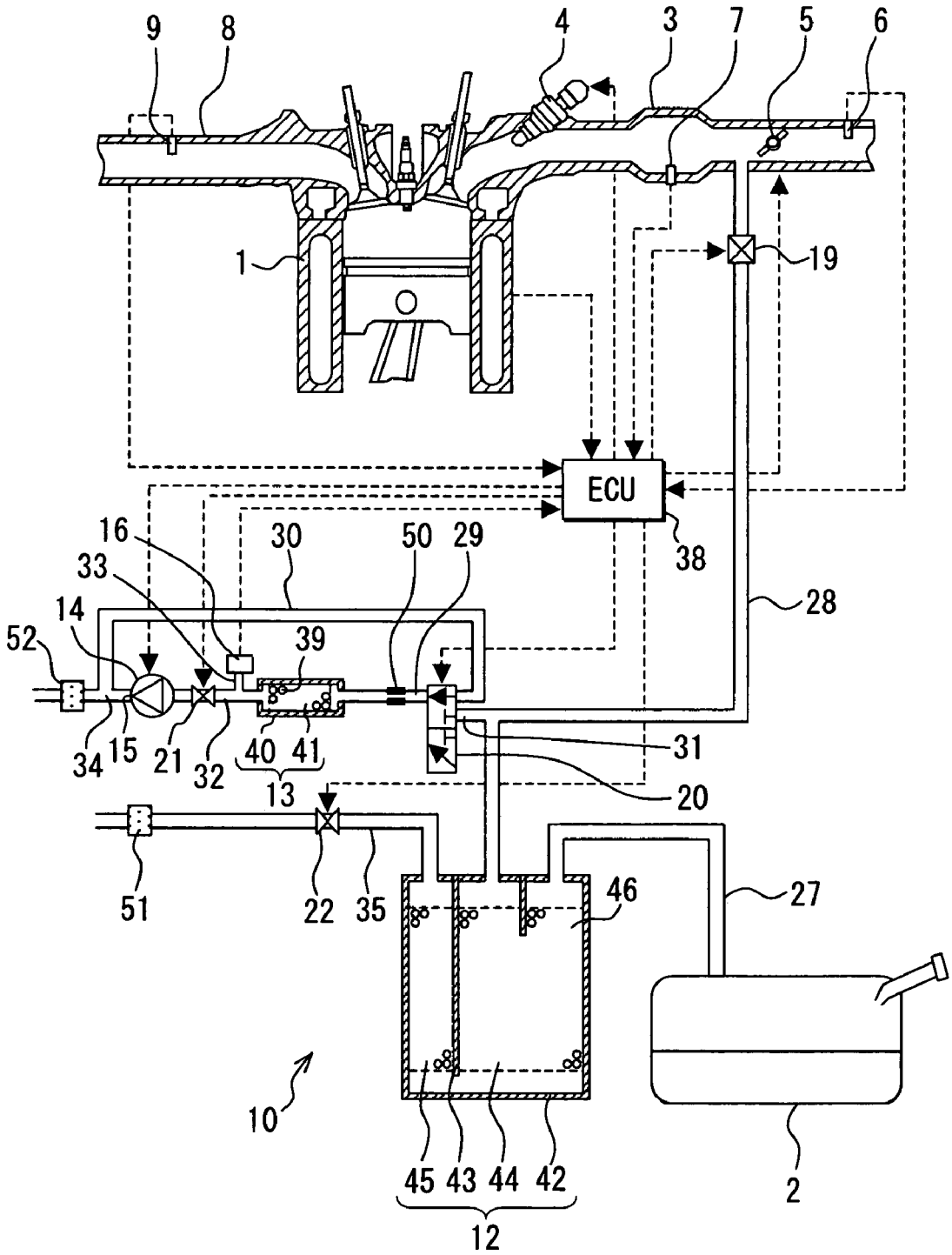
FIG. 23 is a schematic view showing a fuel vapor treatment apparatus according to a fifth embodiment.

This fifth embodiment is a modification of the first embodiment. Specifically, as shown in FIG. 23, in this fifth embodiment, the structure of the fuel vapor treatment apparatus 10 is different from that of the first embodiment.

Specifically, the passage valve 21 is provided in the second detection passage 32 at the position similarly to the passage valve 60 in the fourth embodiment, instead of being provided to the first detection passage 29. In this fifth embodiment, the number of the valves is less by one, compared with that in the fourth embodiment.

In this fifth embodiment, the fuel vapor treatment apparatus 10 conducts an operation similarly to the first embodiment. Specifically, the ECU 38 does not communicate the second detection passage 32 between the second canister 13 and the pump 14, excluding in conditions, where the ECU 38 detects the pressure ΔPair, ΔPgas, or the ECU 38 executes the first purge process, in which the ECU 38 needs to communicate therethrough. In this operation, fuel vapor can be restricted from being exhausted from the second canister 13, which is in a breakthrough condition, into the pump 14. Thus, the characteristic of the pump 14 can be maintained. In addition, fuel vapor can be sufficiently restricted from being exhausted to the atmosphere through the pump 14.

In this fifth embodiment, the passage valve 21 serves as either a second passage open/close unit or a passage open/close unit.

Sixth Embodiment

Figure 24:
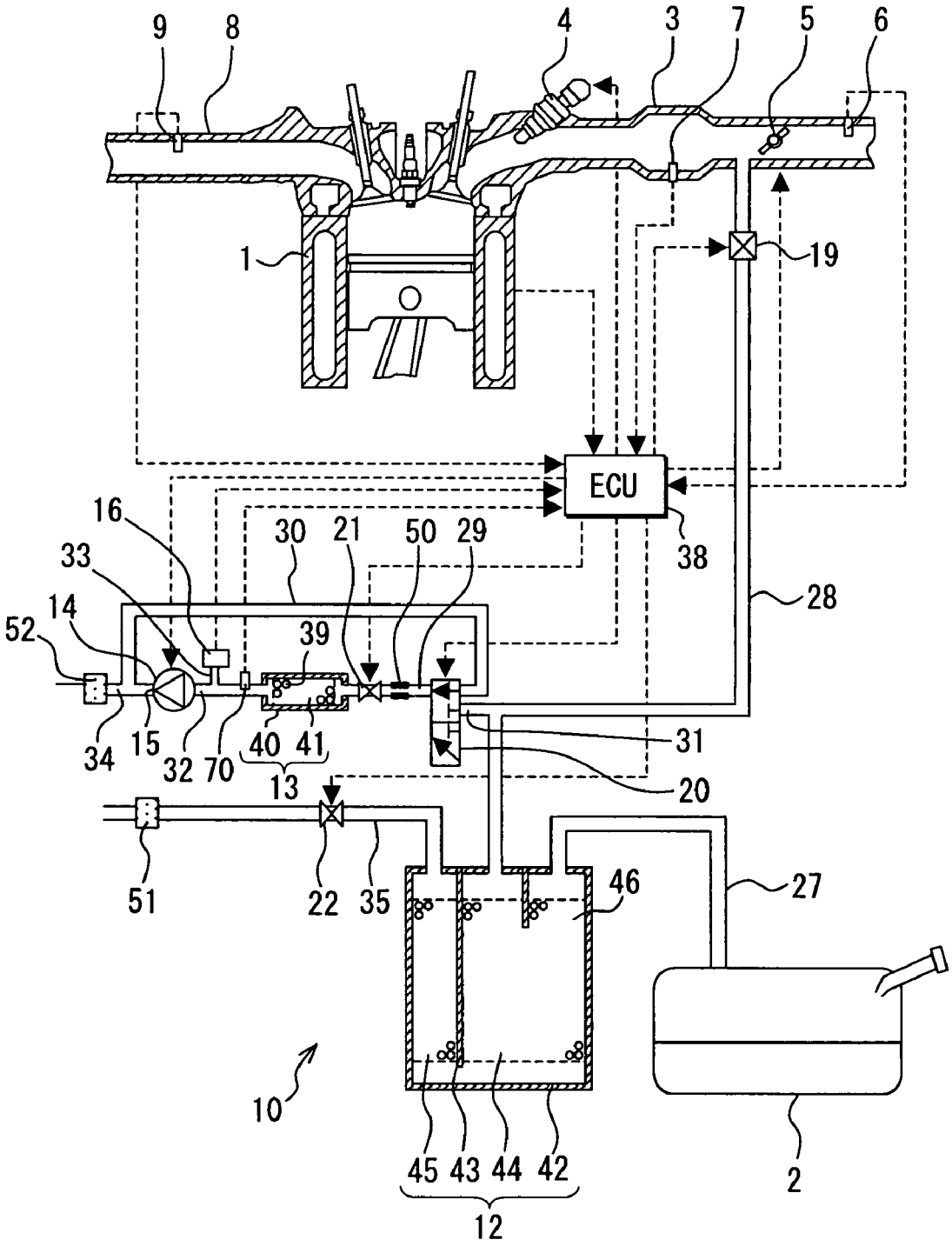
FIG. 24 is a schematic view showing a fuel vapor treatment apparatus according to a sixth embodiment.

This sixth embodiment is a modification of the first embodiment. Specifically, as shown in FIG. 24, in this sixth embodiment, the structure of the fuel vapor treatment apparatus 10 is different from that of the first embodiment.

Specifically, a fuel sensor 70 is provided to the second detection passage 32. The fuel sensor 70 is electrically connected with the ECU 38 for detecting fuel vapor. In particular, the fuel sensor 70 detects fuel vapor in the second detection passage 32.

Figure 25:
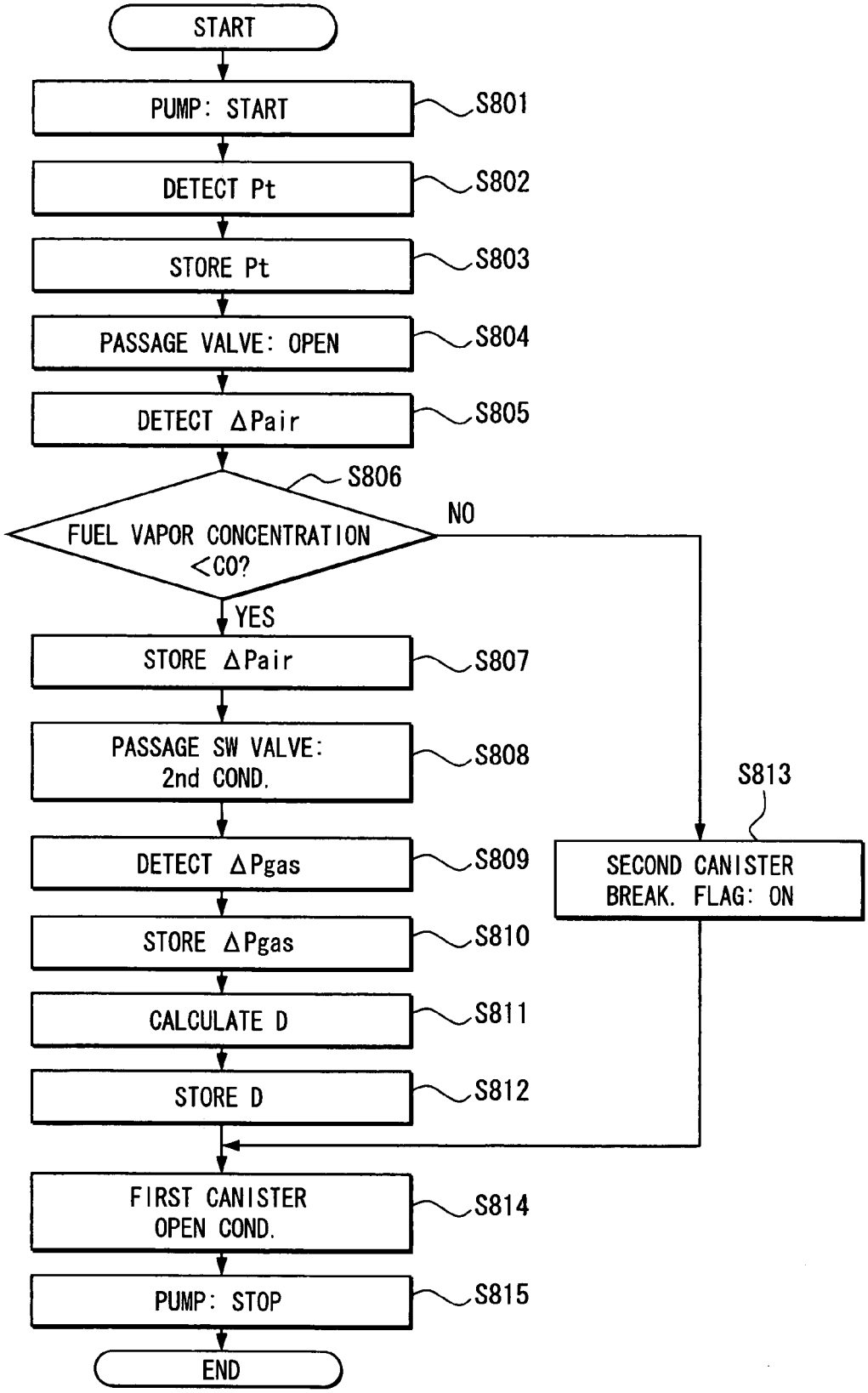
FIG. 25 is a flow chart showing a concentration detecting process according to the sixth embodiment.

In this sixth embodiment, as shown in FIG. 25, the concentration detecting process is different from that of the first embodiment.

In step S806, which is an alternative of step S206 in the first embodiment, the ECU 38 detects the fuel vapor concentration in the second detection passage 32, using the fuel sensor 70. In step S806, the ECU 38 evaluates whether the detected fuel vapor concentration is less than a predetermined threshold C0. Thus, the ECU 38 detects fuel vapor exhausted from the second canister 13 into the second detection passage 32. The threshold C0 is set in consideration of requirement of accuracy of the fuel vapor concentration, detection accuracy of the fuel sensor 70, and the like, in addition to factors causing variation in the detection. The threshold C0 is prestored in the memory of the ECU 38.

When step S806 makes a positive determination, the ECU 38 determines the second canister 13 to be in the absorbable condition. Thus, the ECU 38 determines to be capable of properly calculating the concentration. In step S807, which is an alternative of step S207 in the first embodiment, the ECU 38 stores the first pressure ΔPair in the memory. When step S806 makes a negative determination, the ECU 38 determines that breakthrough occurs in the second canister 13 to exhaust fuel vapor therefrom. Thus, the ECU 38 determines to be incapable of properly calculating the concentration. Thus, the routine proceeds to step S813.

Each of steps S801 to S805, S808 to S815 is substantially equivalent to each of steps S201 to S205, S208 to S215 in the first embodiment.

In this sixth embodiment, the ECU 38 detects fuel vapor exhausted from the second canister 13 into the second detection passage 32, directly using the fuel sensor 70. Thus, accuracy of the detection can be further enhanced. In this sixth embodiment, the fuel sensor 70 serves as a fuel detecting unit.

(Modification of Sixth Embodiment)

In this sixth embodiment, it suffices that the fuel sensor 70 detects fuel vapor exhausted from the second canister 13 into the second detection passage 32. Therefore, the fuel sensor 70 may detect a physical quantity relevant to property of fuel vapor, instead of or in addition to detecting of the concentration.

In this sixth embodiment, the ECU 38 may stop the pump 14 for temporarily terminating pressure reduction in the second detection passage 32 when the ECU 38 detects fuel vapor using the fuel sensor 70. In this operation, energy consumption can be reduced in detection of the fuel vapor. Furthermore, the pump 14 can be protected from drawing fuel vapor exhausted from the second canister 13, so that the characteristic of the pump 14 can be maintained, and fuel vapor can be restricted from being exhausted to the atmosphere.

Seventh Embodiment

Figure 26:
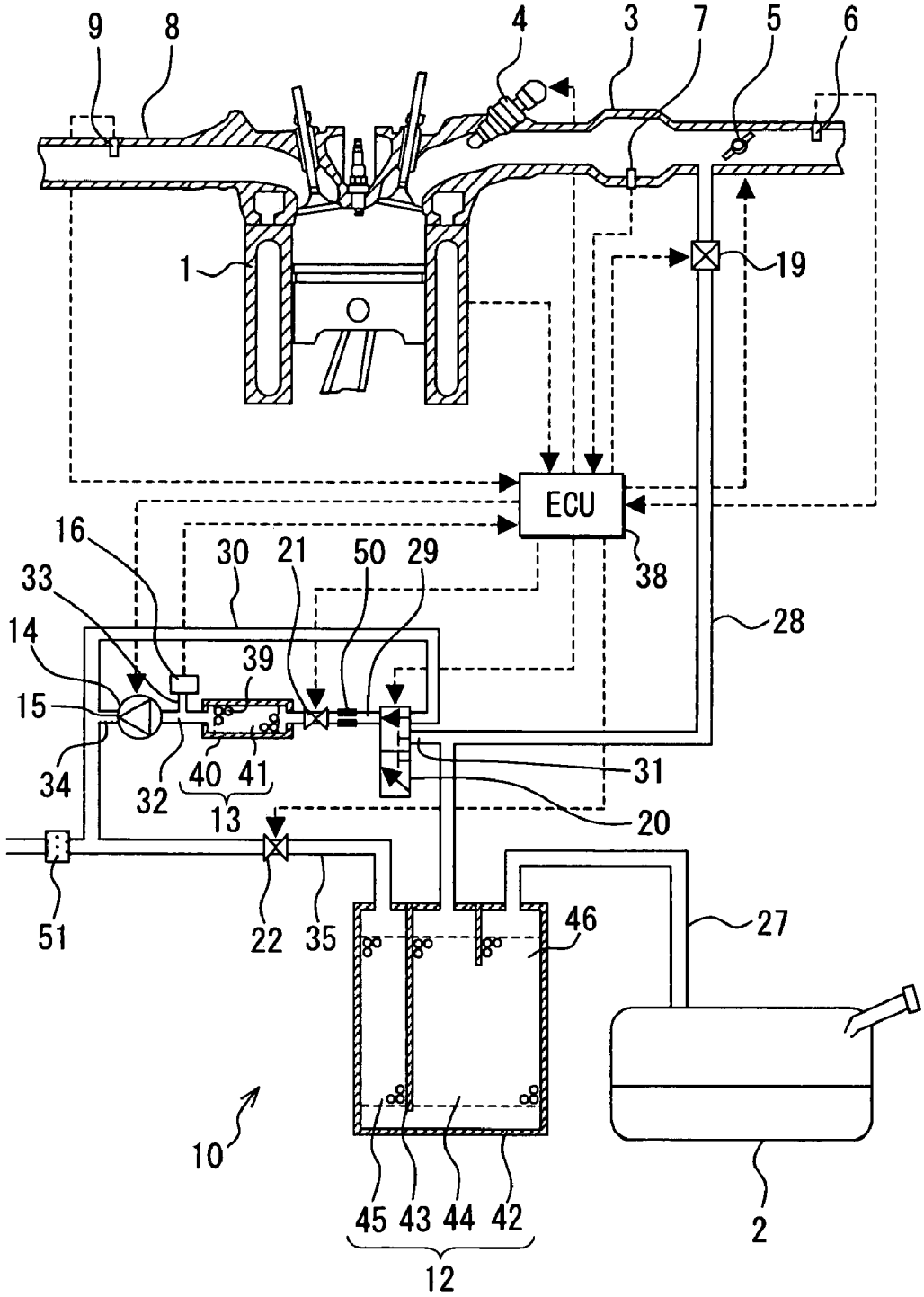
FIG. 26 is a schematic view showing a fuel vapor treatment apparatus according to a seventh embodiment.

This seventh embodiment is a modification of the first embodiment. Specifically, as shown in FIG. 26, in this seventh embodiment, the structure of the fuel vapor treatment apparatus 10 is different from that of the first embodiment.

Specifically, the end of the atmosphere passage 30 on the opposite side of the passage switch valve 20 communicates with the open passage 35 between the canister close valve 22 and the filter 51. In this structure, the atmosphere passage 30 opens to the atmosphere through the open passage 35. The end of the exhaust passage 34 on the opposite side of the pump 14 communicates with the atmosphere passage 30 between the passage switch valve 20 and the open passage 35. In this structure, the exhaust port 15 of the pump 14 regularly opens to the atmosphere through the exhaust passage 34, the atmosphere passage 30, and the open passage 35. The pump 14 reduce pressure in the second detection passage 32, thereby drawing gas into the pump 14, and exhausts the drawn gas outside the fuel vapor treatment apparatus 10 through the open passage 35.

Figures 27, 28:
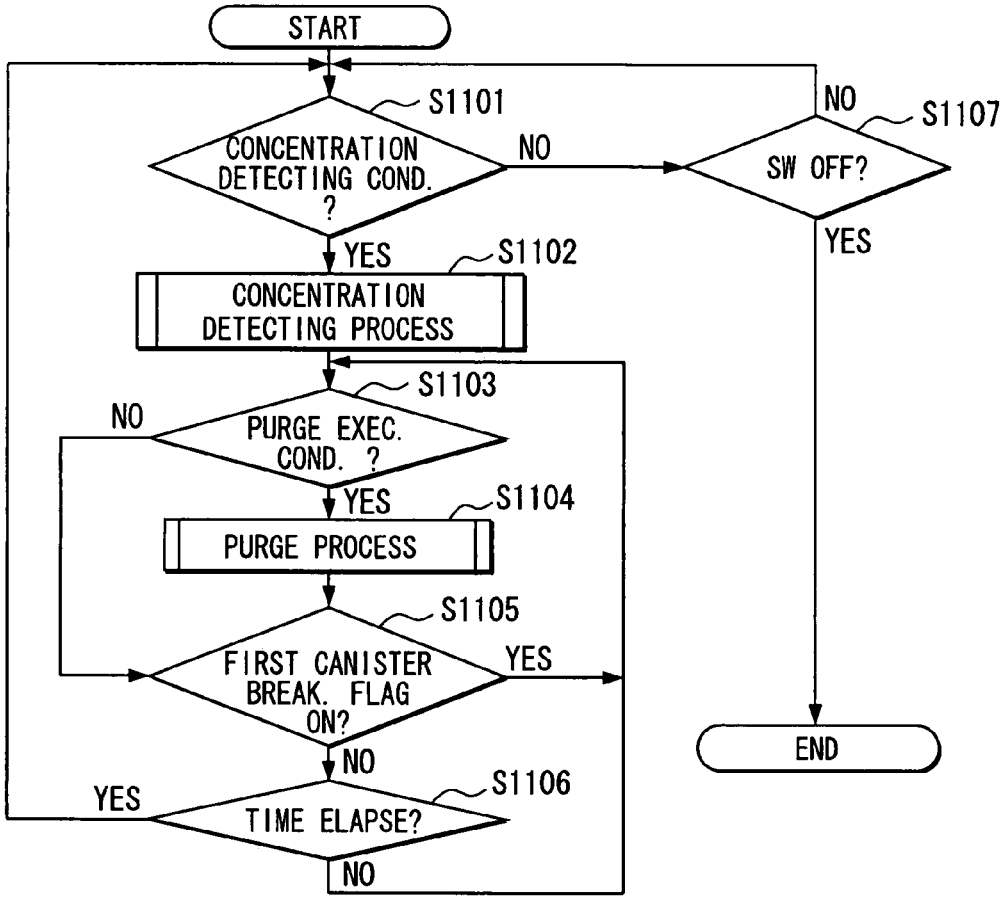
FIG. 27 is a flow chart showing a main process according to the seventh embodiment.
FIG. 28 is a table showing operations of components of the fuel vapor treatment apparatus according to the seventh embodiment.

In this seventh embodiment, as shown in FIG. 27, the main process is different from that of the first embodiment. In step S1105, which is an alternative of step S105 in the first embodiment, the ECU 38 evaluates whether a first canister breakthrough flag is ON to indicate breakthrough of the first canister 12. When step S1105 makes a positive determination, the routine returns to step S1103. When step S1105 makes a negative determination, the routine proceeds to step S1106.

Each of steps S1101, S1103, S1106, S1107 is substantially equivalent to each of steps S101, S103, S106, S107 in the first embodiment. Step S1102, in which the ECU 38 executes a concentration detecting process, is substantially equivalent to step S102 in the first embodiment, excluding the subject matter described below. Step S1104, in which the ECU 38 executes a purge process, is substantially equivalent to step S104 in the first embodiment, excluding the subject matter described below. In this operation, the ECU 38 prohibits execution of the concentration detecting process in a period where a first canister breakthrough flag is ON.

Figure 29:
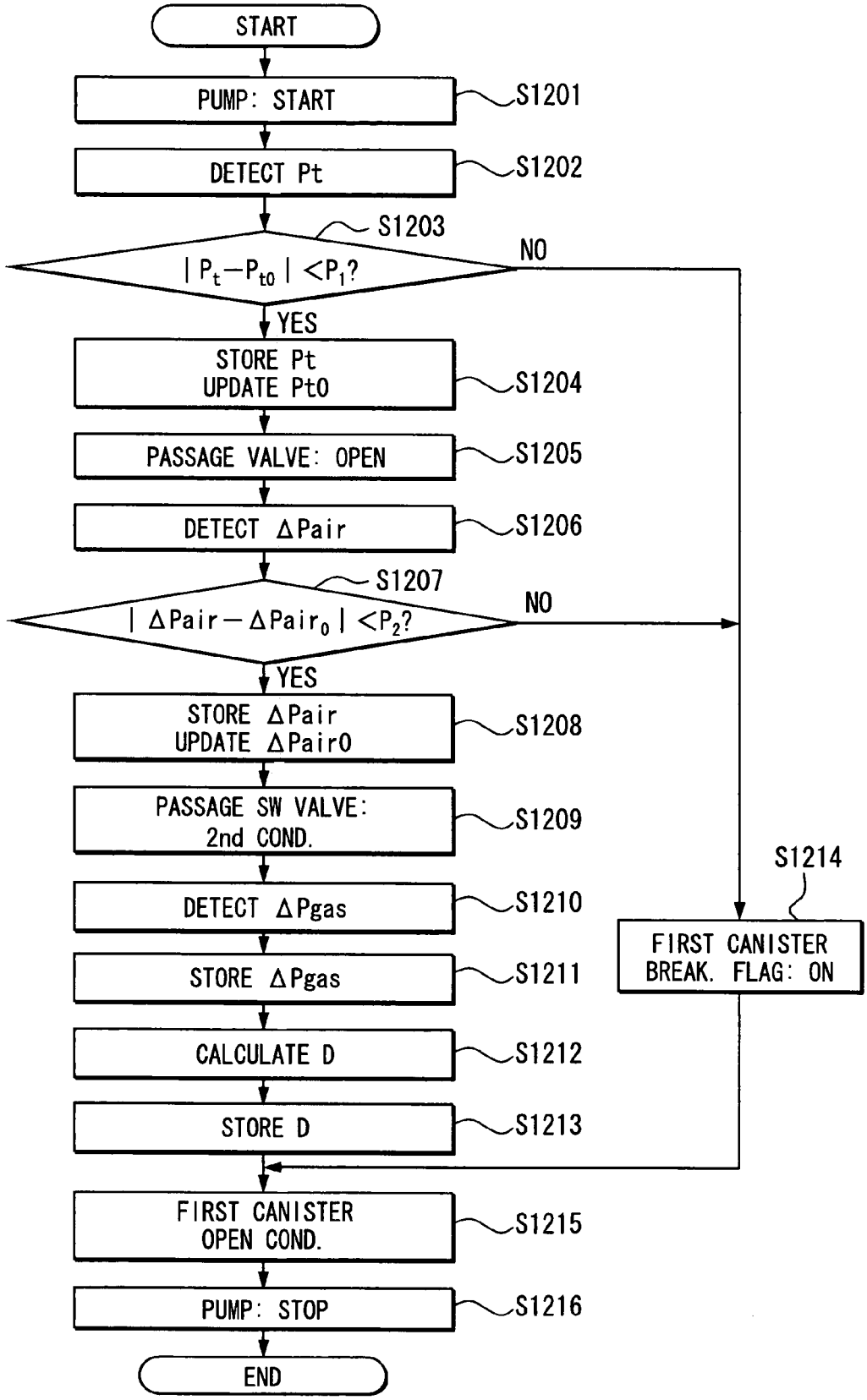
FIG. 29 is a flow chart showing a concentration detecting process according to the seventh embodiment.

In this seventh embodiment, as shown in FIGS. 28, 29, the concentration detecting process is different from that of the first embodiment. The routine proceeds to step S1203 subsequent to steps S1201, S1202, which are substantially equivalent to steps S201, S202 in the first embodiment. In step S1203, the ECU 38 evaluates whether difference between the shutoff pressure Pt and a predetermined shutoff pressure reference Pt0 is less than an allowable threshold P1. Thus, the ECU 38 detects fuel vapor exhausted from the first canister 12 into the open passage 35.

Figure 30:
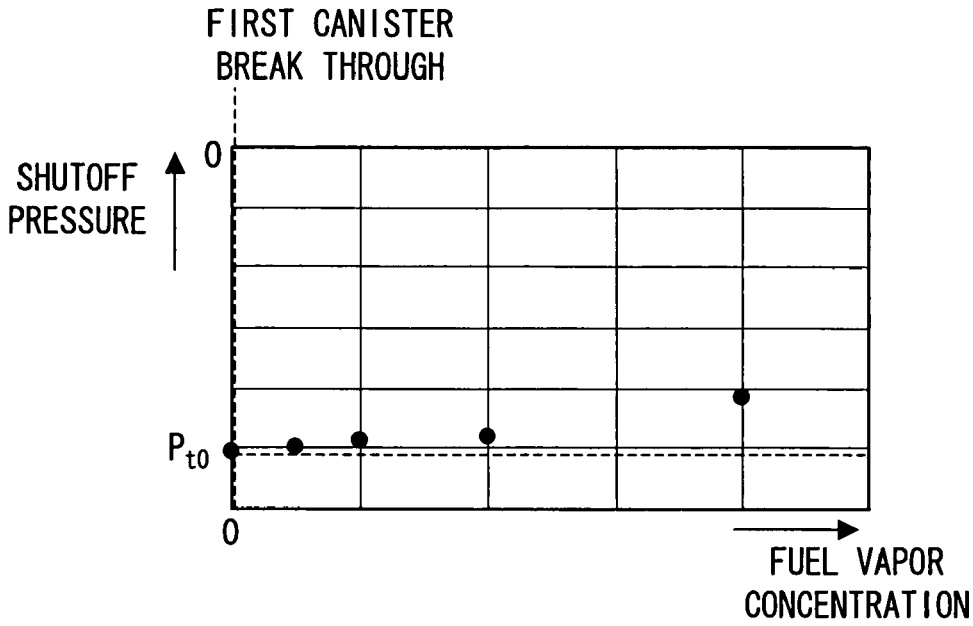
FIG. 30 is a graph showing a relationship between a fuel vapor concentration and shutoff pressure of the fuel vapor treatment apparatus, according to the seventh embodiment.

Specifically, when breakthrough occurs in the first canister 12 before the ECU 38 executes the concentration detecting process, the first canister 12 cannot sufficiently absorb fuel vapor, and the fuel vapor may be exhausted into the open passage 35. In this condition, the exhausted fuel vapor may diffuse into the pump 14 after passing through the atmosphere passage 30 and the exhaust passage 34. As shown in FIG. 30, when diffused fuel vapor flows into the pump 14, the shutoff pressure Pt changes toward the atmospheric pressure, corresponding to the fuel vapor concentration. Furthermore, in this condition, where fuel vapor flows into the pump 14, when the ECU 38 executes the steps S1206, S1210, which are substantially equivalent to steps S205, S209 in the first embodiment, the P–Q characteristic of the pump 14 gradually changes as the pump 14 exhausts fuel vapor. Accordingly, the P–Q characteristic of the pump 14 may vary in each detection of the shutoff pressure Pt, the pressure ΔPair, ΔPgas. Therefore, the ECU 38 is incapable of properly calculating the concentration by executing step S1212, which is subsequently equivalent to step S211.

Therefore, in step S1203, the ECU 38 compares difference between the shutoff pressure reference Pt0 and the shutoff pressure Pt with the allowable threshold P1. The shutoff pressure reference Pt0 is a predicted value of the shutoff pressure Pt in a condition where fuel vapor is not exhausted from the first canister 12. In this comparison, when the difference between the shutoff pressure Pt and the shutoff pressure reference Pt0 is less than the allowable threshold P1, the ECU 38 determines to be capable of properly calculating the concentration by accurately detecting the first pressure Pt and the like. In this condition, the routine proceeds to step S1204, which is an alternative of step S203 in the first embodiment. When the difference between the shutoff pressure Pt and the shutoff pressure reference Pt0 is equal to or greater than the allowable threshold P1, the ECU 38 determines that breakthrough occurs in the first canister 12 to exhaust fuel vapor therefrom. Thus, the ECU 38 determines to be incapable of properly calculating the concentration. In this condition, the routine proceeds to step S1214, which is an alternative of step S213 in the first embodiment. The ECU 38 calculates the shutoff pressure reference Pt0 by obtaining multiple values of the shutoff pressure Pt, which are determined to be normal in previous step S1203, from the latest one in order, and averaging the multiple values of the shutoff pressure Pt. The number of the values of the shutoff pressure Pt may be five, for example. In this operation, the ECU 38 is capable of obtaining the shutoff pressure reference Pt0 in conformity to the latest P–Q characteristic. Thus, even when the P–Q characteristic varies from an initial characteristic thereof, the ECU 38 is capable of obtaining the shutoff pressure reference Pt0 in consideration of influence caused by the variation in P–Q characteristic. The allowable threshold PO is set in consideration of requirement of accuracy of the fuel vapor concentration D, detection accuracy of the pressure sensor 16, and the like, in addition to factors causing variation in the calculation. The allowable threshold PO is prestored in the memory of the ECU 38.

When step S1203 makes a positive determination, the routine proceeds to step S1204. In step S1204, the ECU 38 stores the shutoff pressure Pt, which is accurately detected, in the memory. In addition, in step S1204, the ECU 38 updates the averaged multiple values by using the present accurately calculated shutoff pressure Pt, thereby calculating the latest shutoff pressure reference Pt0. The ECU 38 stores the shutoff pressure reference Pt0 in the memory.

Subsequently, the ECU 38 executes steps S1205, S1206, which are substantially equivalent to steps S204, S205 in the first embodiment, and further executes step S1207, which is substantially equivalent to step S206 in the first embodiment. In step S1207, the ECU 38 evaluates whether difference between the first pressure ΔPair and the first pressure reference ΔPair0 is less than an allowable threshold P2. Thus, the ECU 38 detects fuel vapor exhausted from the first canister 12 into the open passage 35.

Figure 31:
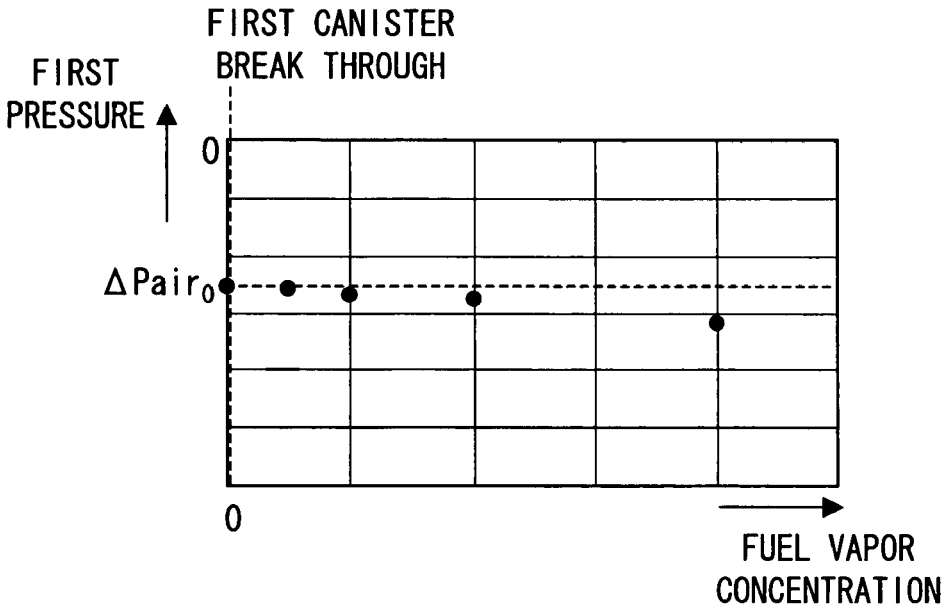
FIG. 31 is a graph showing a relationship between a fuel vapor concentration and first pressure of the fuel vapor treatment apparatus, according to the seventh embodiment.

Specifically, when breakthrough occurs in the first canister 12 before the ECU 38 executes the concentration detecting process, fuel vapor is exhausted from the first canister 12 into the open passage 35, and is diffused into the atmosphere passage 30. In this case, when the ECU 38 executes step S1205, and/or fuel vapor further is diffused, fuel vapor is mixed in air passing through the first detection passage 29. Consequently, the detected first pressure ΔPair becomes different from a value when only air passes through the throttle 50. As shown in FIG. 31, the detected first pressure ΔPair changes toward negative side, correspondingly to the fuel vapor concentration. Accordingly, in step S1212, it is difficult to properly calculate the concentration in accordance with the P–Q characteristic of the pump 14.

In step S1207, when the difference between the first pressure ΔPair and the first pressure reference ΔPair0 is less than the allowable threshold P2, the ECU 38 determines to be capable of properly calculating the concentration by accurately detecting the first pressure ΔPair. Thus, the routine proceeds to step S1208. When the difference between the first pressure ΔPair and the first pressure reference ΔPair0 is equal to or greater than the allowable threshold P2, the ECU 38 determines that breakthrough occurs in the first canister 12 to exhaust fuel vapor therefrom. Thus, the ECU 38 determines to be incapable of properly calculating the concentration. Thus, the routine proceeds to step S1214. The first pressure reference ΔPair0 is calculated by averaging multiple values, similarly to the first embodiment. The allowable threshold P2 is set similarly to the allowable threshold P0 in the first embodiment.

When either step S1203 or step S1207 makes a negative determination, the routine proceeds to step S1214. In step S1214, the ECU 38 turns the first canister breakthrough flag ON and stores the first canister breakthrough flag in the memory. Subsequently, the routine proceeds to step S1215.

Each of steps S1208 to S1213, S1215, S1216 is substantially equivalent to each of steps S207 to S212, S214, S215.

Figure 32:
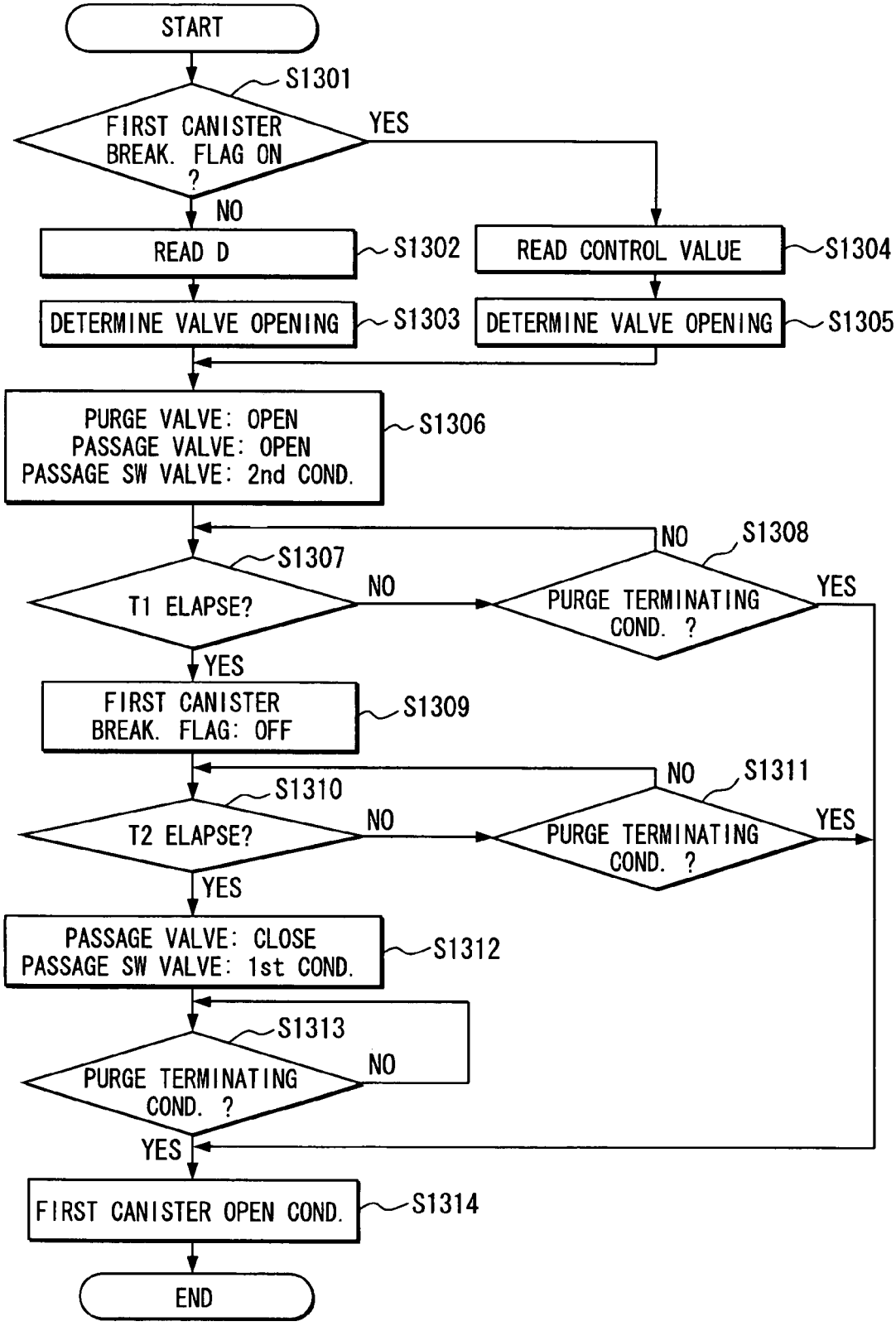
FIG. 32 is a flow chart showing a purge process according to the seventh embodiment.

In this seventh embodiment, as shown in FIGS. 28, 32, the purge process is also different from that of the first embodiment. In step S1301, which is an alternative of step S301 in the first embodiment, the ECU 38 evaluates whether the first canister breakthrough flag is ON. In this comparison, when step S1301 makes a negative determination, the ECU 38 determines to permit executing of the purge control in accordance with the fuel vapor concentration D. In this case, the ECU 38 executes steps S1302, S1303, which are substantially equivalent to steps S302, S303 in the first embodiment. When step S1301 makes a positive determination, the ECU 38 determines to prohibit executing of the purge control in accordance with the fuel vapor concentration D. In this case, the ECU 38 executes steps S1304, S1305, which are substantially equivalent to steps S304, S305 in the first embodiment.

Figure 33:
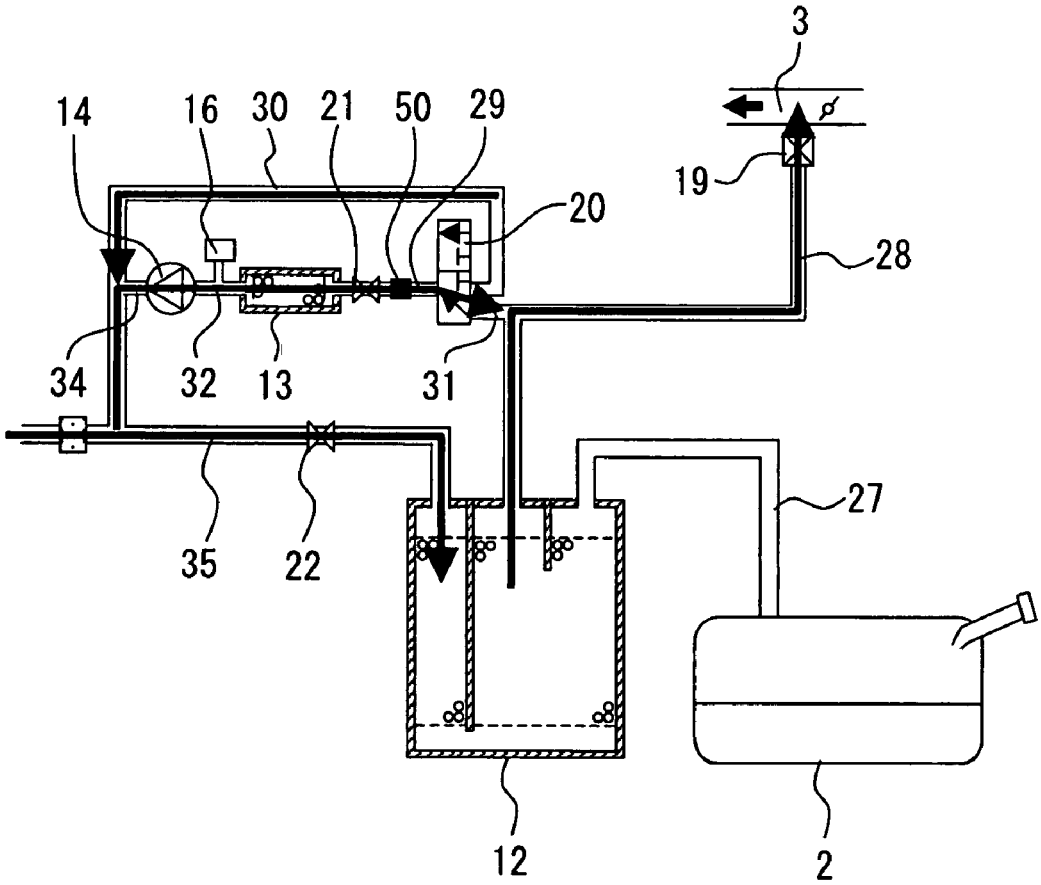
FIG. 33 is a schematic view showing an operation of the fuel vapor treatment apparatus according to the seventh embodiment.

The routine proceeds to step S1306, which is substantially equivalent to step S306 in the first embodiment, subsequent to steps S1303, S1305. In step S1306, the ECU 38 executes the first purge process. The valves 19-22 are in the condition shown in FIG. 28. As shown in FIG. 33, negative pressure in the intake passage 3 is applied to the open passage 35, the atmosphere passage 30, and the exhaust passage 34 through the first canister 12. In this condition, gas flows into the first canister 12 through the open passage 35, the atmosphere passage 30, and the exhaust passage 34. When the first canister 12 exhausts fuel vapor into the open passage 35, the exhausted fuel vapor is swept into the first canister 12, and absorbed in the first canister 12. The valves 19-22 are in the condition shown in FIG. 28. In this operation, fuel vapor in the second canister 13 and the first detection passage 29 is introduced into the purge passage 28, and is purged together with fuel removed from the first canister 12.

The routine proceeds to step S1307, which is an alternative of step S307 in the first embodiment. In step S1307, the ECU 38 evaluates whether a predetermined time T1 elapses after starting of the first purge process. The predetermined time T1 is set at a minimum period needed for completely sweeping fuel vapor exhausted into the open passage 35. When the ECU 38 determines that the predetermined time T1 elapses, step S1307 makes a positive determination, so that the ECU 38 determines fuel vapor to be completely swept from the open passage 35. In this condition, the routine proceeds to step S1309, which is an alternative of step S309 in the first embodiment. In step S1309, the ECU 38 turns the first canister breakthrough flag OFF and stores the first canister breakthrough flag in the memory.

Each of steps S1308, S1310 to S1314 is substantially equivalent to each of steps S308, S310 to S314 in the first embodiment.

In this seventh embodiment, when the ECU 38 does not detect fuel vapor, which is exhausted from the first canister 12 to the open passage 35, the ECU 38 controls the purge process on the basis of the fuel vapor concentration D, which is obtained in accordance with the detection pressure ΔPair, ΔPgas, and Pt of the pressure sensor 16. In this operation, the ECU 38 is capable of conducting the purge process such that the ECU 38 preferably controls the air/fuel ratio of the engine 1 in accordance with the fuel vapor concentration D, which exerts influence to the purge amount.

In this seventh embodiment, when the ECU 38 detects fuel vapor, which is exhausted to the open passage 35, the ECU 38 prohibits the purge process controlled on the basis of the fuel vapor concentration D. The ECU 38 ignores the fuel vapor concentration D, and alternatively conducts the purge process on the basis of the predetermined value. When fuel vapor is exhausted into the open passage 35, accuracy of the detection pressure ΔPair, ΔPgas, and Pt may decrease, and accuracy of the fuel vapor concentration D may also decrease. Even in this condition, the ECU 38 is capable of conducting the purge control, regardless of the decrease in accuracy. Therefore, the operation of the engine 1 can be protected from influence caused by fuel vapor exhausted to the open passage 35. Furthermore, the purge amount can be enhanced in the limited purge period.

In this seventh embodiment, when the ECU 38 detects fuel vapor, which is exhausted to the open passage 35, the ECU 38 maintains the first canister breakthrough flag ON until furl vapor is swept from the open passage 35 by executing the first purge process. The ECU 38 prohibits the purge process controlled on the basis of the fuel vapor concentration D in a period where the first canister breakthrough flag is ON. Thus, the operation of the engine 1 can be steadily protected from influence caused by exhaust of fuel vapor. In a period where the first canister breakthrough flag is ON, the fuel vapor concentration D is not used in the purge control, so that the ECU 38 prohibits the concentration detecting process, which is for obtaining the fuel vapor concentration D. In this operation, energy consumption such as operating of the pump 14 can be reduced.

In this seventh embodiment, the ECU 38 detects fuel vapor exhausted into the open passage 35 on the basis of the shutoff pressure Pt detected using the pressure sensor 16. The shutoff pressure Pt is detected in a condition where the inlet port of the pump 14 is shut off. Referring to FIG. 30, when fuel vapor is exhausted into the open passage 35 and drawn into the pump 14 before the detection, the shutoff pressure Pt significantly changes. Therefore, the ECU 38 is capable of accurately detecting exhaust of fuel vapor when detecting in accordance with the shutoff pressure Pt. In this seventh embodiment, the ECU 38 determines to detect exhaust of fuel vapor when the difference between the shutoff pressure Pt and the shutoff pressure reference Pt0, detected in a condition where fuel vapor is not exhausted, is equal to or greater than the allowable threshold P0. Therefore, the ECU 38 is capable of further accurately detecting exhaust of fuel vapor in view of an allowance in detection of the shutoff pressure Pt by the allowable threshold P0.

In this seventh embodiment, the ECU 38 further detects exhaust of fuel vapor on the basis of the first pressure ΔPair detected using the pressure sensor 16. Referring to FIG. 31, when fuel vapor is exhausted into the open passage 35 and drawn into the pump 14 before or during the detection, the first pressure ΔPair significantly changes. Therefore, the ECU 38 is capable of accurately detecting exhaust of fuel vapor in accordance with the first pressure ΔPair. In this seventh embodiment, the ECU 38 detects exhaust of fuel vapor in accordance with the first pressure ΔPair, by using the first pressure reference ΔPair0 and the allowable threshold P0, similarly to the first embodiment. Therefore, accuracy of the detection can be further enhanced.

In this seventh embodiment, the shutoff pressure Pt and the first pressure ΔPair, which are used for detecting exhaust of fuel vapor, are also used for calculating the fuel vapor concentration D for the purge control. Therefore, an additional sensor for detecting exhaust of fuel vapor need not be provided, so that manufacturing cost can be reduced.

In this seventh embodiment, the pump 14 serves as a gas flow generating unit. The pressure sensor 16 serves as a pressure detecting unit. The ECU 38 serves as an exhaust detecting unit and a purge control unit. Both the first detection passage 29 and the second detection passage 32 construct a detection passage. The passage switch valve 20 serves as a passage switching unit. The passage valve 21 serves as a passage open/close unit.

(Modification of Seventh Embodiment)

In this seventh embodiment, the ECU 38 may use the previous one accurately detected shutoff pressure Pt as the shutoff pressure reference Pt0. Alternatively, the ECU 38 may use a predetermined value, which is stored in the ECU 38, as the shutoff pressure reference Pt0. In the latter case, the shutoff pressure reference Pt0 need not be updated.

In this seventh embodiment, the ECU 38 may determine to detect fuel vapor exhausted from the first canister 12 when both the shutoff pressure Pt and the first pressure ΔPair are largely deviate respectively from the shutoff pressure reference Pt0 and the first pressure reference ΔPair0.

Figure 34:
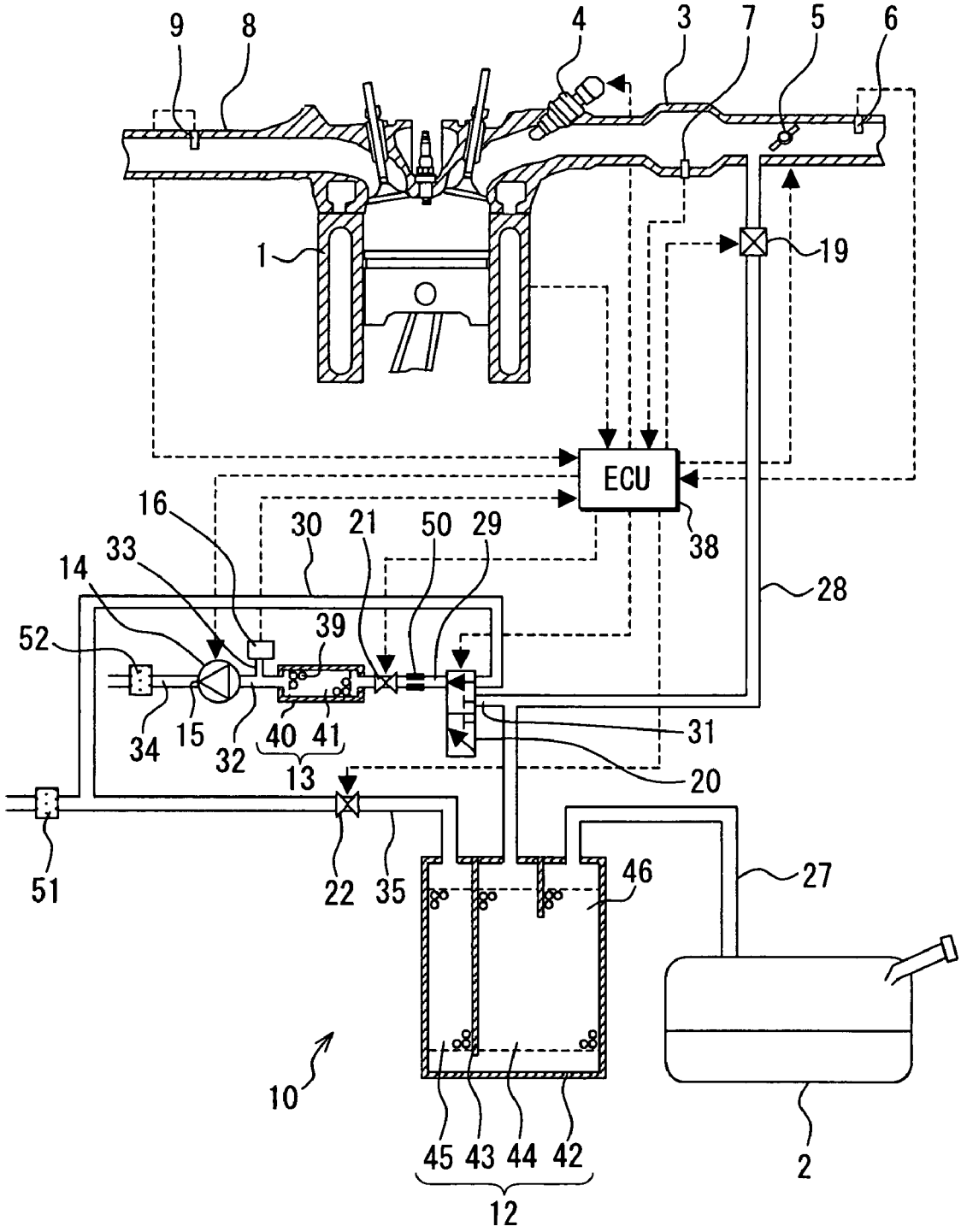
FIG. 34 is a schematic view showing a fuel vapor treatment apparatus according to a modification of the seventh embodiment.
Figure 35:
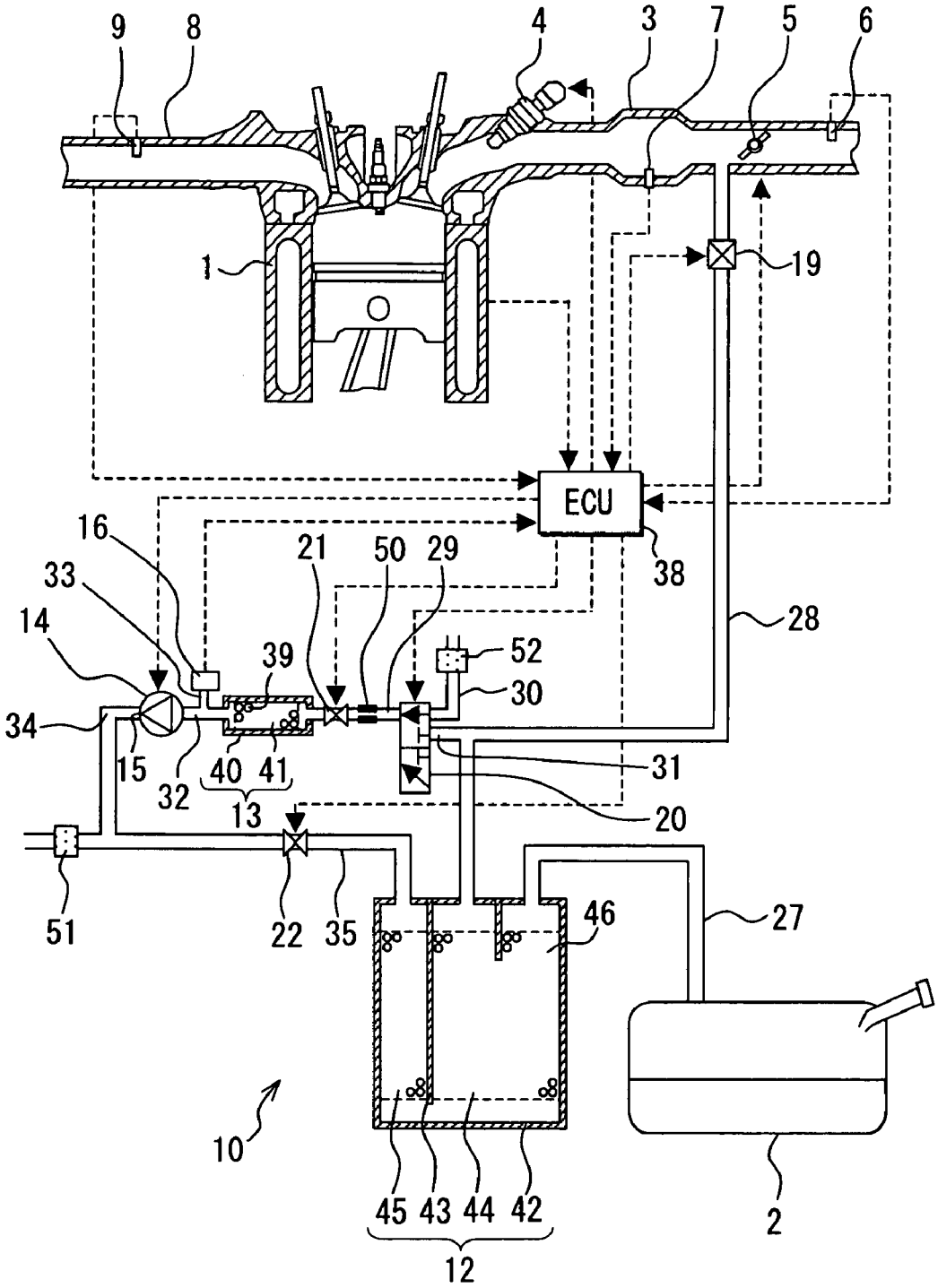
FIG. 35 is a schematic view showing a fuel vapor treatment apparatus according to a modification of the seventh embodiment.

In this seventh embodiment, as shown in FIG. 34, the exhaust passage 34 may be separated from the atmosphere passage 30 and the open passage 35. In this structure, comparison of the shutoff pressure Pt with the shutoff pressure reference Pt0 need not be conducted for detecting exhaust of fuel vapor, and the shutoff pressure reference Pt0 need not be updated. As shown in FIG. 35, the atmosphere passage 30 may be separated from the open passage 35 and the exhaust passage 34. In this structure, comparison of the first pressure ΔPair with the first pressure reference ΔPair0 need not be conducted for detecting exhaust of fuel vapor, and the first pressure reference ΔPair0 need not be updated.

In this seventh embodiment, the second canister 13 may be omitted, and the first and second detection passages 29, 32 may construct single detection passage.

Eighth Embodiment

Figure 36:
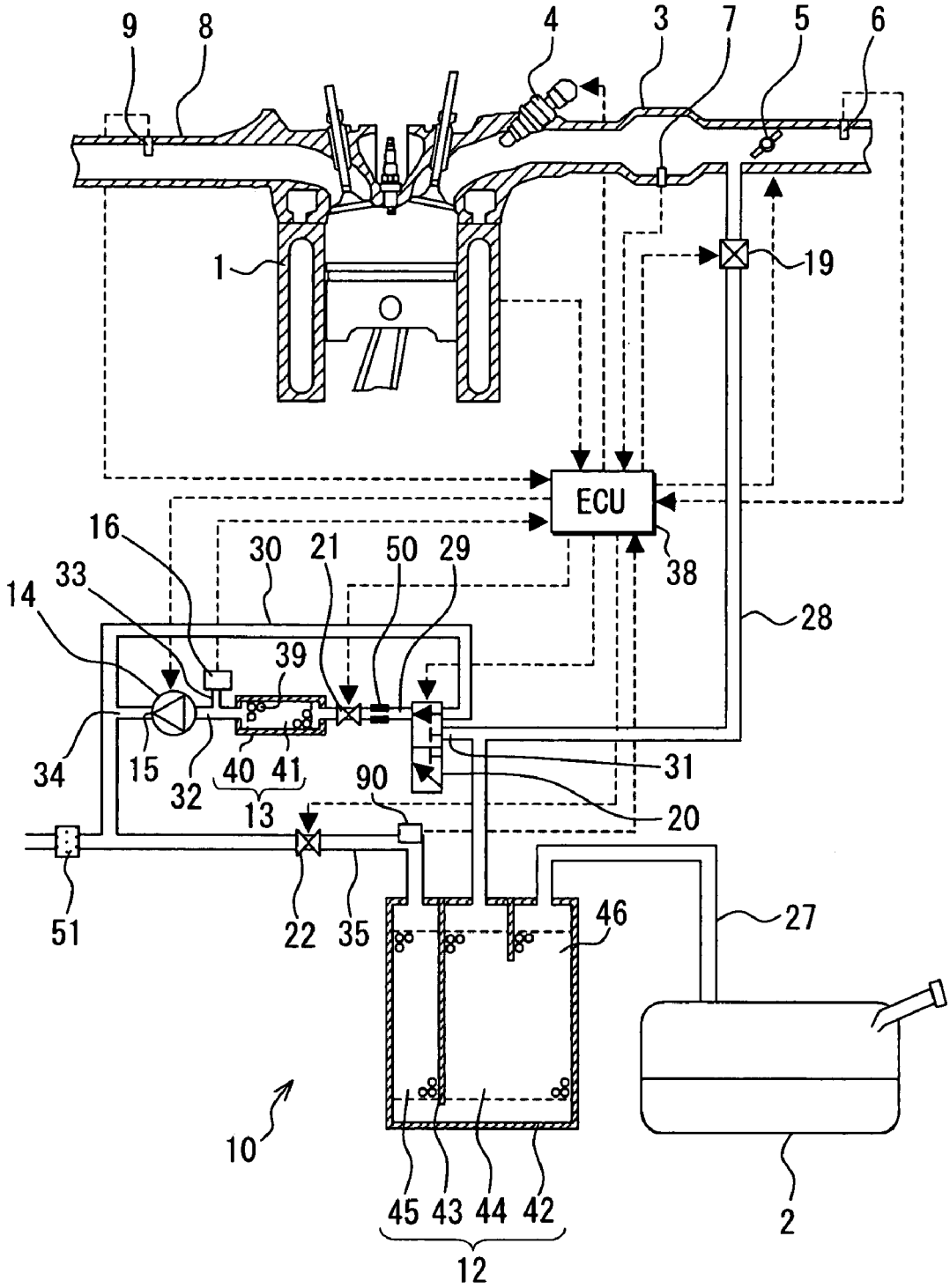
FIG. 36 is a schematic view showing a fuel vapor treatment apparatus according to an eighth embodiment.

This eighth embodiment is a modification of the seventh embodiment. Specifically, as shown in FIG. 36, in this eighth embodiment, the structure of the fuel vapor treatment apparatus 10 is different from that of the first embodiment.

Specifically, a fuel sensor 90 is provided between the first canister 12 and the canister close valve 22 in the open passage 35 for detecting fuel vapor. The fuel sensor 90 is electrically connected with the ECU 38. In particular, the fuel sensor 90 detects fuel vapor in the open passage 35.

Figure 37:
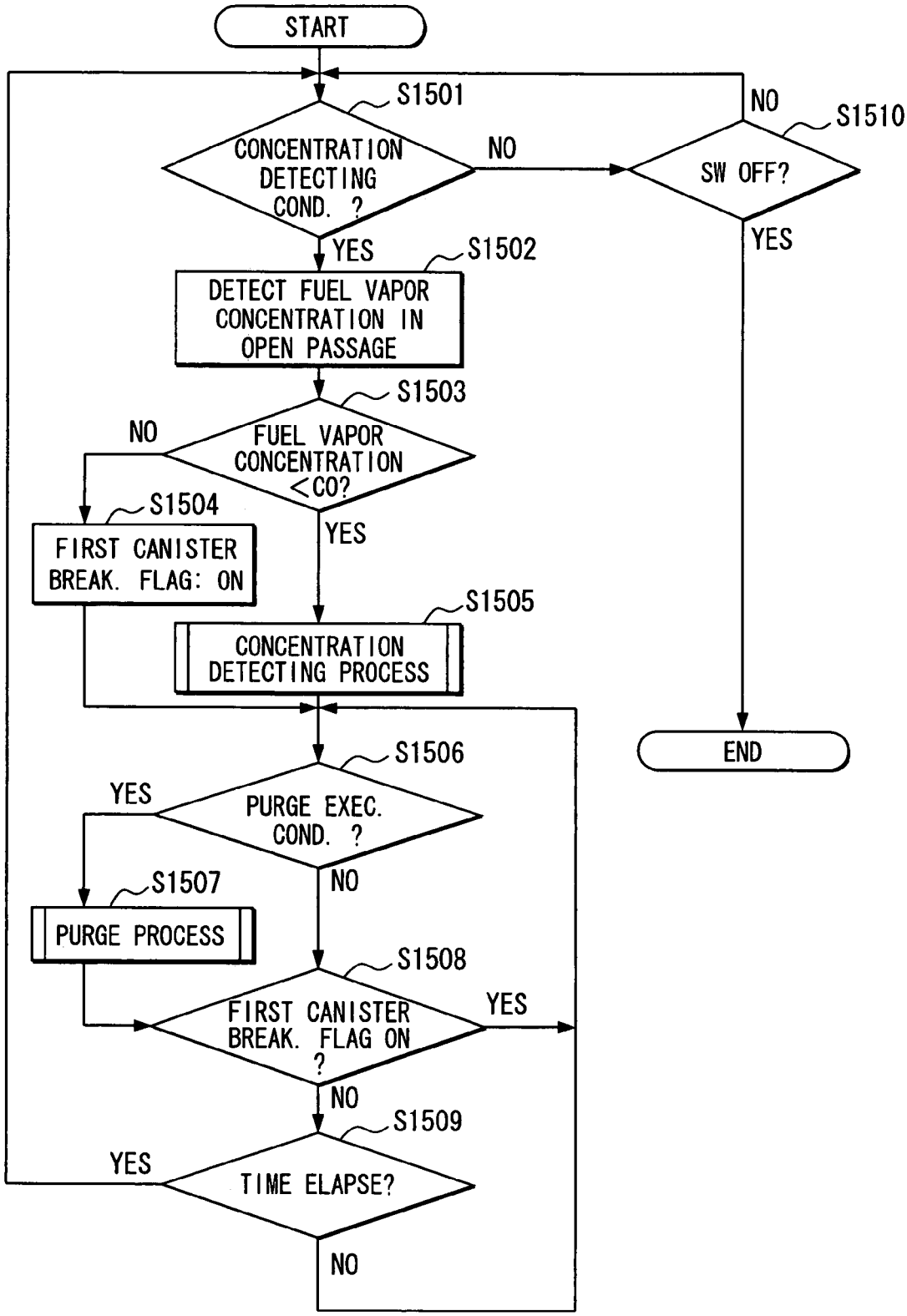
FIG. 37 is a flow chart showing a main process according to the eighth embodiment.

In this eighth embodiment, as shown in FIG. 37, the main process is different from that of the seventh embodiment. When step S1501, which is substantially equivalent to step S1101 in the seventh embodiment, makes a positive determination, the routine proceeds to step S1502. In step S1502, the ECU 38 detects the fuel vapor concentration in the open passage 35, using the fuel sensor 90. In step S1503, the ECU 38 evaluates whether the detected fuel vapor concentration is less than a predetermined threshold C0. Thus, the ECU 38 detects fuel vapor exhausted from the first canister 12 into the open passage 35. The threshold C0 is set in consideration of requirement of accuracy of the fuel vapor concentration, detection accuracy of the fuel sensor 90, and the like, in addition to factors causing variation in the detection. The threshold C0 is prestored in the memory of the ECU 38.

When step S1503 makes a negative determination, the ECU 38 determines that breakthrough occurs in the first canister 12 to exhaust fuel vapor therefrom. Thus, the ECU 38 determines to be incapable of properly executing the concentration detecting process. Thus, the routine proceeds to step S1504. In step S1504, the ECU 38 turns the first canister breakthrough flag ON and stores the first canister breakthrough flag in the memory. The routine skips step S1505, and proceeds to step S1506. When step S1503 makes a positive determination, the ECU 38 determines that the first canister 12 is in the absorbable condition. Thus, the ECU 38 determines to be capable of properly executing the concentration detecting process. In this condition, the routine proceeds to step S1506 after executing step S1505.

Step S1505, in which the ECU 38 executes a purge process, is substantially equivalent to step S1102 in the seventh embodiment, excluding the subject matter described below. Each of steps S1506 to S1510 is substantially equivalent to each of steps S1103 to S1107 in the seventh embodiment. In this operation, the ECU 38 prohibits execution of the concentration detecting process in a period where the first canister breakthrough flag is ON.

Figure 38:
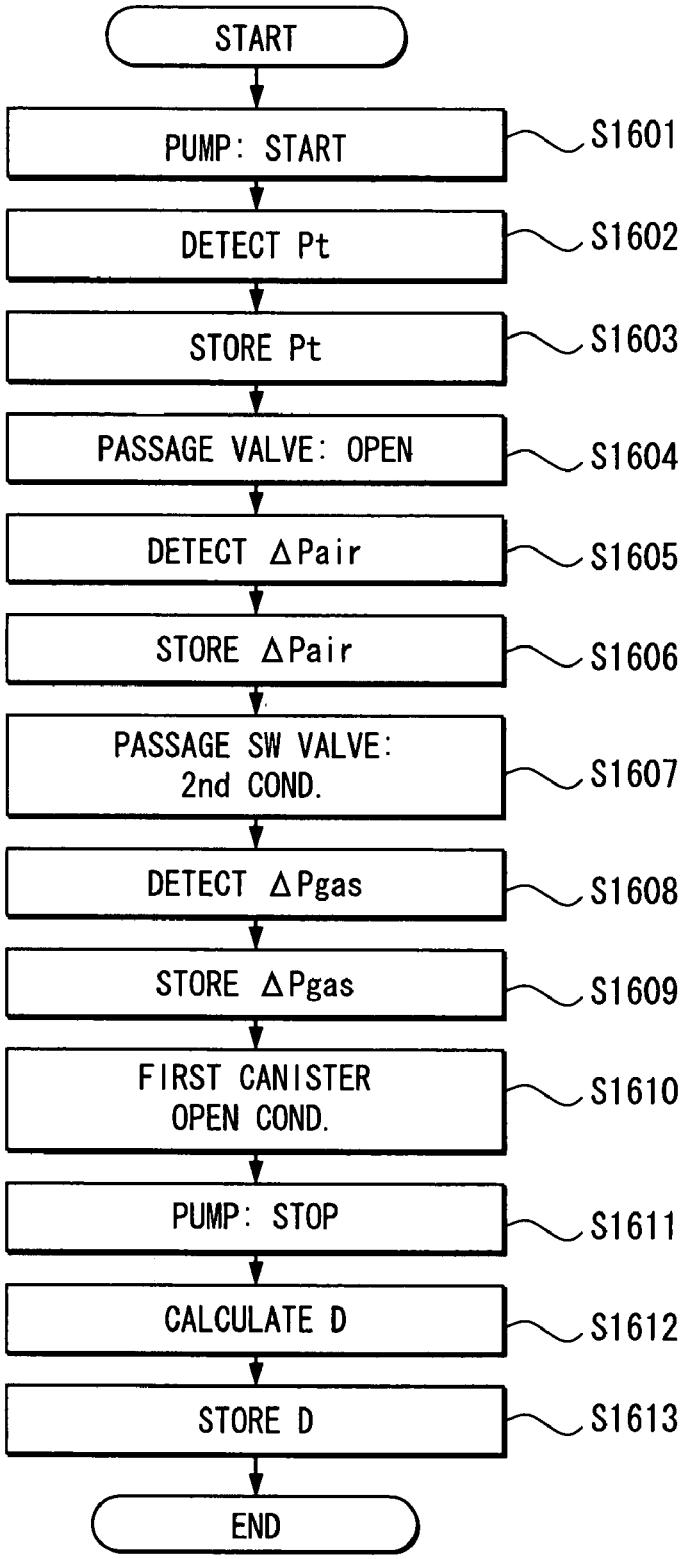
FIG. 38 is a flow chart showing a concentration detecting process according to the eighth embodiment.

In this eighth embodiment, as shown in FIG. 38, the concentration detecting process is different from that of the seventh embodiment. The ECU 38 does not execute steps S1203, S1207, S1214 in the seventh embodiment.

Correspondingly, the ECU 38 does not update the shutoff pressure reference Pt0 and the first pressure reference ΔPair0 in steps S1603, S1606, which are alternatives of steps S1204, S1208 in the seventh embodiment.

Each of steps S1610 to S1613 is substantially equivalent to each of steps S1212, S1213, S1215, S1216 in the seventh embodiment, excluding of the executing order of steps. Each of steps S1601, S1602, S1604, S1605, S1607 to S1609 is substantially equivalent to each of steps S1201, S1202, S1205, S1206, S1209 to S1211 in the seventh embodiment.

In this eighth embodiment, the ECU 38 detects fuel vapor exhausted from the first canister 12 into the open passage 35, directly using the fuel sensor 90. Thus, accuracy of the detection can be further enhanced.

In this eighth embodiment, when the ECU 38 detects fuel vapor exhausted to the open passage 35, after starting of the engine 1 and before executing of the concentration detecting process for the first time, the ECU 38 skips the first concentration detecting process, and executes the purge process by ignoring the fuel vapor concentration D. In this operation, when the first canister 12 is in a breakthrough condition immediately after starting of the engine 1, the ECU 38 does not execute the concentration detecting process, which is not necessary for the purge control, so that the ECU 38 does not operate the pump 14 Thus, energy consumption can be reduced, and fuel vapor exhausted from the first canister 12 can be restricted from causing a problem by omitting operation of the pump 14.

In this eighth embodiment, the fuel sensor 90 serves as a fuel detecting unit.

(Modification of Eighth Embodiment)

In this eighth embodiment, it suffices that the fuel sensor 90 detects fuel vapor exhausted from the first canister 12 into the open passage 35. Therefore, the fuel sensor 90 may detect a physical quantity relevant to property of fuel vapor, instead of or in addition to detecting of the concentration.

In this eighth embodiment, it suffices to provide the fuel sensor 90 on the side of the opening to the atmosphere with respect to the first canister 12. Therefore, the fuel sensor 90 may be provided in the open passage 35 on the side of the opening to the atmosphere with respect to the canister close valve 22. Alternatively, the fuel sensor 90 may be provided to the atmosphere passage 30, the exhaust passage 34, or the like, communicating with the open passage 35.

Ninth Embodiment

Figure 39:
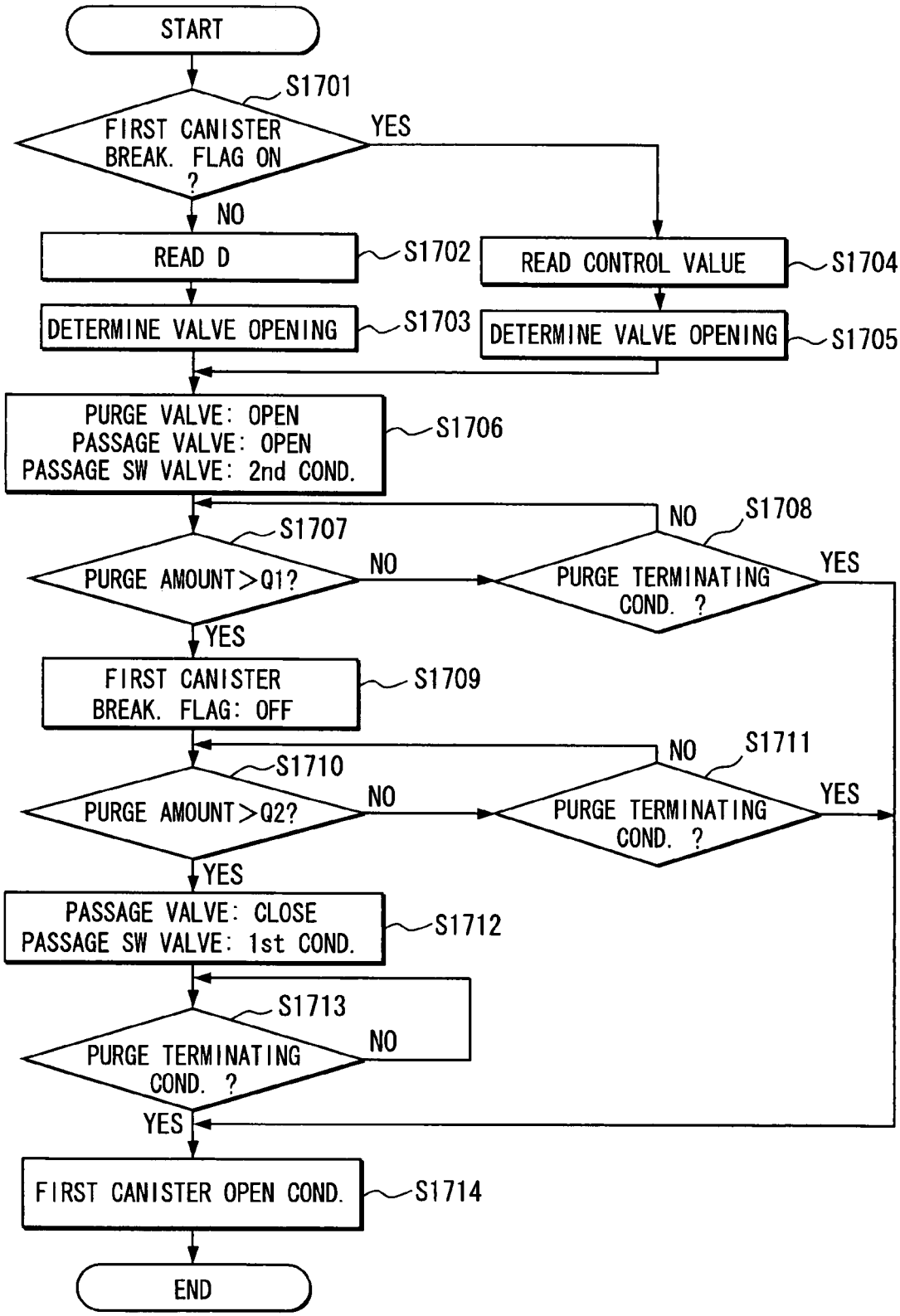
FIG. 39 is a flow chart showing a purge process according to a ninth embodiment.

This ninth embodiment is a modification of the seventh embodiment. Specifically, as shown in FIG. 39, in this ninth embodiment, the purge process is different from that of the first embodiment.

In step S1707, which is an alternative of step S1307 in the seventh embodiment, the ECU 38 evaluates whether a purge gas amount from starting of the first purge process is greater than a set amount Q1, which is a minimum amount needed for completely sweeping fuel vapor from the open passage 35. For example, the set amount Q1 is predetermined in accordance with a volume of the open passage 35 or the like. The set amount Q1 is prestored in the memory of the ECU 38. The ECU 38 may calculate the purge gas amount in accordance with, for example, a flow amount of gas passing through the open passage 35. Alternatively, the ECU 38 may calculate the purge gas amount in accordance with, for example, a flow amount of gas purged into the intake passage 3.

When step S1707 makes a negative determination, the routine proceeds to step S1708, which is substantially equivalent to step S1308 in the seventh embodiment. In this operation, the ECU 38 continues the purge process until the purge gas amount becomes greater than the set amount Q1, as long as the purge terminating condition is not satisfied. When step S1707 makes a positive determination, the ECU 38 determines that fuel vapor is swept from the open passage 35. In step S1709, which is substantially equivalent to step S1309 in the seventh embodiment, the ECU 38 turns the first canister breakthrough flag OFF.

Subsequently, the ECU 38 executes steps S1710, S1711, which are alternatives of steps S1310, S1311 in the seventh embodiment. Steps S1710, S1711 are substantially equivalent to steps S410, S411 in the second embodiment. In step S1710, the ECU 38 evaluates whether a purge gas amount from starting of the first purge process is greater than a set amount Q2, which is a minimum amount needed for completely sweeping fuel vapor from the second canister 13. The ECU 38 may calculate this purge gas amount in accordance with, for example, a flow amount of gas passing through the second canister 13. Alternatively, the ECU 38 may calculate the purge gas amount in accordance with, for example, a ratio between the flow amount of gas passing through the first canister 12 and the flow amount of gas passing through the second canister 13. Alternatively, the ECU 38 may calculate the purge amount in accordance with, for example, a flow amount of gas purged into the intake passage 3.

Each of steps S1701 to S1706, S1712 to S1714 is substantially equivalent to each of steps S1301 to S1306, S1312 to S1314 in the seventh embodiment.

In this ninth embodiment, the ECU 38 evaluates whether fuel vapor is swept from the open passage 35 in accordance with the purge gas amount correlating with the amount of fuel swept from the open passage 35. Therefore, even when the purge gas amount is excessive or insufficient due to variation in pressure in the intake passage 3, pressure loss in the purge passage 28, the open passage 35, and the like, the ECU 38 is capable of properly determining completion of sweeping of fuel vapor.

Tenth Embodiment

Figure 40:
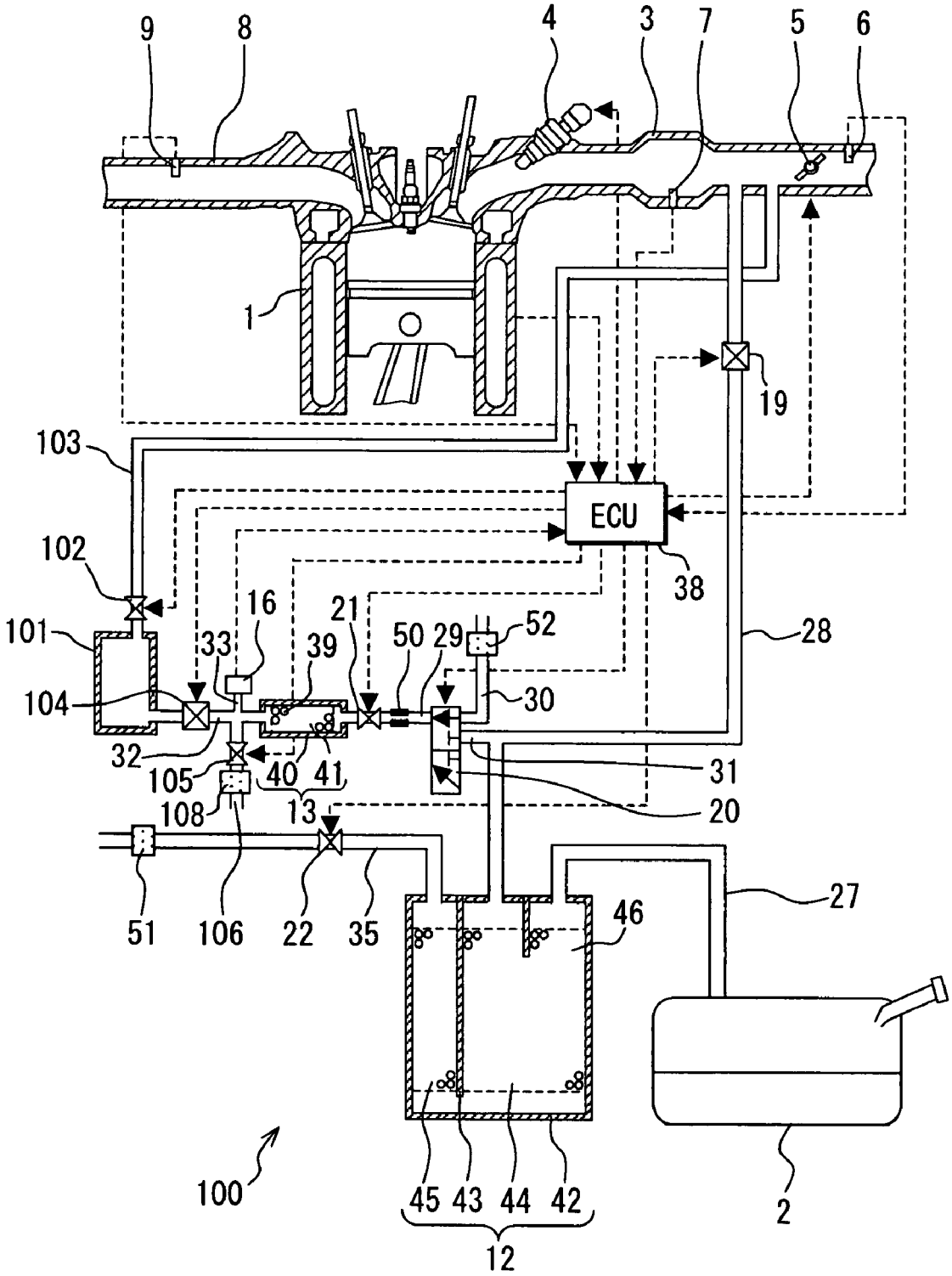
FIG. 40 is a schematic view showing a fuel vapor treatment apparatus according to a tenth embodiment.

This tenth embodiment is a modification of the first embodiment. Specifically, as shown in FIG. 40, in this tenth embodiment, the structure of the fuel vapor treatment apparatus 100 is different from that of the first embodiment.

The fuel vapor treatment apparatus 100 is provided with an accumulator 101, instead of the pump 14. The accumulator 101 communicates with the intake passage 3 through a negative pressure passage 103. A negative pressure control valve 102 having a solenoid actuator is provided midway through the negative pressure passage 103. The negative pressure control valve 102 opens and closes to control communication between the accumulator 101 and the intake passage 3. When the negative pressure control valve 102 opens, negative pressure in the intake passage 3 is applied from the downstream of the throttle device 5 to the accumulator 101 through the negative pressure passage 103, so that the accumulator 101 accumulates negative pressure. The negative pressure control valve 102 is electrically connected with the ECU 38. The ECU 38 controls the negative pressure control valve 102 in accordance with intake pressure detected using the intake pressure sensor 7, thereby controlling accumulation of negative pressure in the accumulator 101. Referring to FIG. 40, the negative pressure passage 103 preferably communicates with the intake passage 3 upstream of the purge passage 28. In this structure, fuel vapor purged from the purge passage 28 into the intake passage 3 can be restricted from flowing into the negative pressure passage 103.

The accumulator 101 is further connected with a flow control valve 104 having a solenoid actuator. The flow control valve 104 is further connected with an end of the second detection passage 32 on the opposite side of the second canister 13. The flow control valve 104 opens and closes to control communication between the accumulator 101 and the second detection passage 32. When the flow control valve 104 opens, negative pressure in the accumulator 101 is applied to the second detection passage 32. In this condition, pressure in the second detection passage 32 is reduced, so that gas flow is generated through the second detection passage 32. In this embodiment, the flow control valve 104 has a flow rectifying structure such as a specific nozzle, e.g., a sonic nozzle for rectifying flow therethrough. In this structure, when the flow control valve 104 opens, and the negative pressure in the accumulator 101 changes, flow amount of gas drawn into the accumulator 101 can be stabilized. The volume and negative pressure in the accumulator 101 are predetermined such that the flow rectifying structure of the flow control valve 104 is capable of stabilizing gas flow. Furthermore, the volume and negative pressure in the accumulator 101 are predetermined such that a flow amount of gas and a total amount of gas can be secured as needed for the concentration detecting process. A sensor may be provided for detecting pressure in the accumulator 101, instead of providing the flow rectifying structure to the flow control valve 104. The ECU 38 may stabilize the gas drawn into the accumulator 101 by manipulating opening of the flow control valve 104 in accordance with the detection signal of the sensor.

An atmosphere passage 106 braches from the second detection passage 32 between the second canister 13 and the flow control valve 104. The atmosphere passage 106 has an end, which is on the opposite side of the branch end, opening to the atmosphere. The atmosphere passage 106 is provided with an atmosphere valve 105 having a solenoid actuator and a filter 108 in the end opening to the atmosphere. When the atmosphere valve 105 opens, the second canister 13 communicates with the atmosphere through the atmosphere passage 106 and the second detection passage 32.

The flow control valve 104 and the atmosphere valve 105 are electrically connected with the ECU 38. As shown in FIG. 41, the ECU 38 closes both the flow control valve 104 and the atmosphere valve 105 in the first canister open condition.

In this tenth embodiment, as shown in FIG. 42, the ECU 38 executes an accumulating process for controlling accumulation of negative pressure in the accumulator 101. The ECU 38 establishes the first canister open condition in an initial condition of the accumulating process.

Specifically, in this accumulating process, in step S1801, the ECU 38 evaluates whether the intake pressure in the intake passage 3 is less than a predetermined threshold Pi. When step S1801 makes a positive determination, the routine proceeds to step S1802. The ECU 38 opens the negative pressure control valve 102 to control accumulation of negative pressure in the accumulator 101. When step S1801 makes a negative determination, the routine proceeds to step S1803. The ECU 38 closes the negative pressure control valve 102, and the routine proceeds to step S1804. In step S1804, the ECU 38 evaluates whether the ignition switch is turned OFF.

When step S1804 makes a positive determination, the accumulating process is terminated. When step S1804 makes a negative determination, or when step S1802 completes, the routine returns to step S1801.

Figure 43:
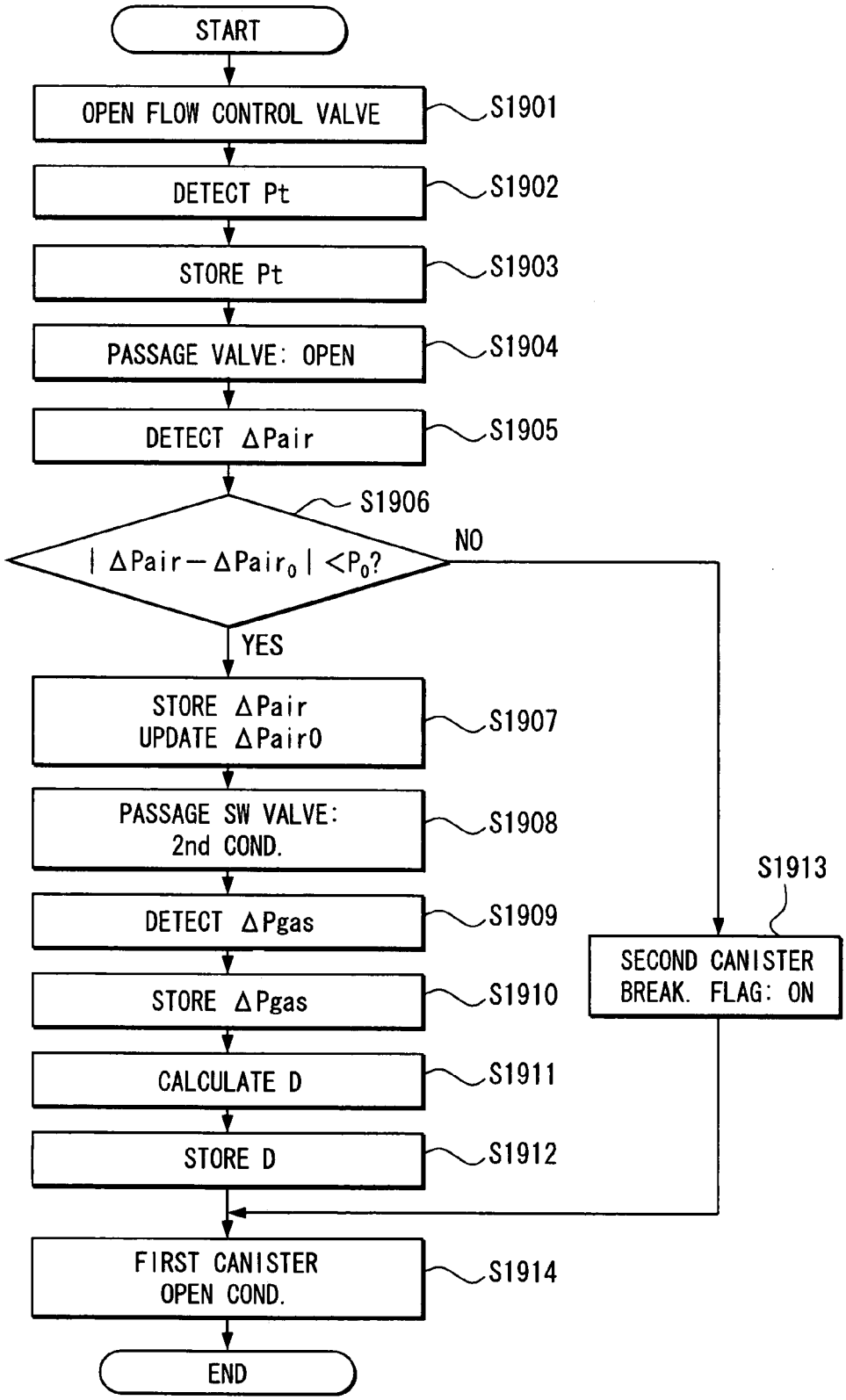
FIG. 43 is a flow chart showing a concentration detecting process according to the tenth embodiment.

In this tenth embodiment, as shown in FIGS. 41, 43, the concentration detecting process is different from that of the first embodiment. In step S1901, which is an alternative of step S201 in the first embodiment, the ECU 38 opens the flow control valve 104. The valves 19-22, 104, 105 are in the condition shown in FIG. 41. In this condition, the first detection passage 29 is blocked, so that negative pressure in the accumulator 101 is applied to the second detection passage 32, thereby reducing pressure in the second detection passage 32. Thus, the detection pressure of the pressure sensor 16 changes to the shutoff pressure Pt.

In step S1914, which is an alternative of steps S214, S215 in the first embodiment, the ECU 38 operates the valves 19-22, 104, 105 to establish the first canister open condition shown in FIG. 41, thereby blocking the accumulator 101 from the second detection passage 32. When the routine proceeds to step S1914 subsequent to step S1913, which is substantially equivalent to step S213 in the first embodiment, breakthrough occurs in the second canister 13 to exhaust fuel vapor into the second detection passage 32. In this operation, the fuel vapor can be restricted from being drawn into the flow rectifying structure of the flow control valve 104, so that a flow characteristic of the flow rectifying structure can be maintained. In addition, fuel vapor can be restricted from being exhausted into the second detection passage 32 and being drawn into the accumulator 101. Thus, the fuel vapor can be restricted from being exhausted into the intake passage 3 due to opening of the negative pressure control valve 102, so that the air/fuel ratio of the engine 1 can be maintained.

Each of steps S1902 to S1912 is substantially equivalent to each of steps S202 to S212 in the first embodiment.

Figure 44:
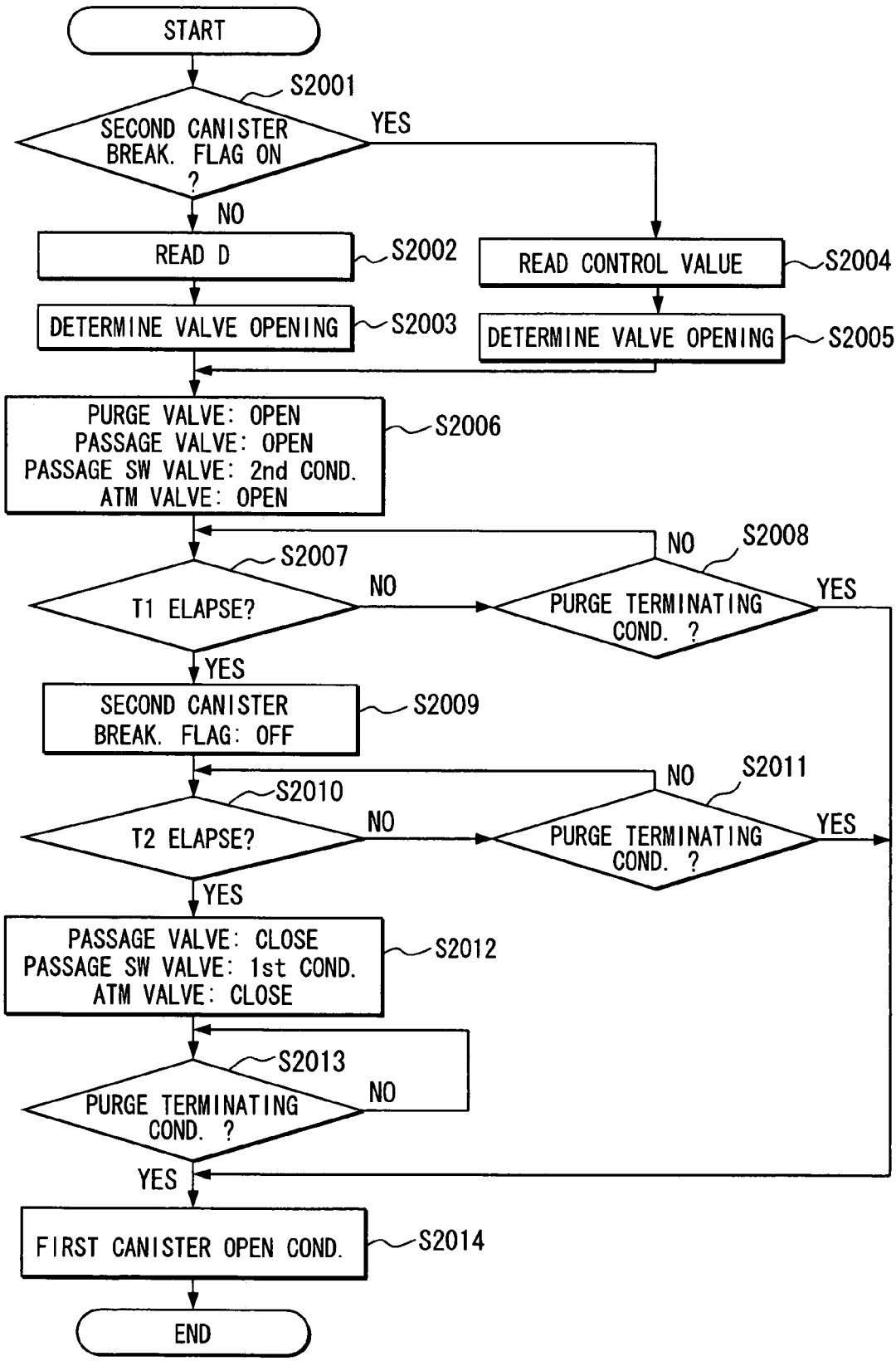
FIG. 44 is a flow chart showing a purge process according to the tenth embodiment.

In this tenth embodiment, as shown in FIGS. 41, 44, the purge process is different from that of the first embodiment. In step S2006, which is an alternative of step S306 in the first embodiment, the ECU 38 opens all the purge valve 19, the passage valve 21, and the atmosphere valve 105, and switches the passage switch valve 20 to be in the second condition. Thus, the ECU 38 starts the first purge process. In step S2012, which is an alternative of step S312 in the first embodiment, the ECU 38 executes the second purge process by operating the passage switch valve 20 to be in the first condition, and closing both the passage valve 21 and the atmosphere valve 105. Each of steps S2001 to S2005, S2007 to S2011, S2013, and S2014 is substantially equivalent to each of steps S301 to S305, S307 to S311, S313, and S314. In this operation, the ECU 38 changes the purge control in accordance with detection of fuel vapor exhausted to the second detection passage 32, similarly to the first embodiment. Thus, the ECU 38 is capable of controlling the purge process appropriately to the operation of the engine 1.

In this tenth embodiment, the accumulator 101, the negative pressure control valve 102, and the flow control valve 104 all together serve as a gas flow generating unit.

Eleventh Embodiment

This eleventh embodiment is a modification of the first embodiment. Specifically, this eleventh embodiment is different from the first embodiment in that the ECU 38 estimates an amount of fuel vapor absorbed into the second canister 13 so that the ECU 38 reflects the estimation to both the concentration detecting process and the purge process.

Figure 46:
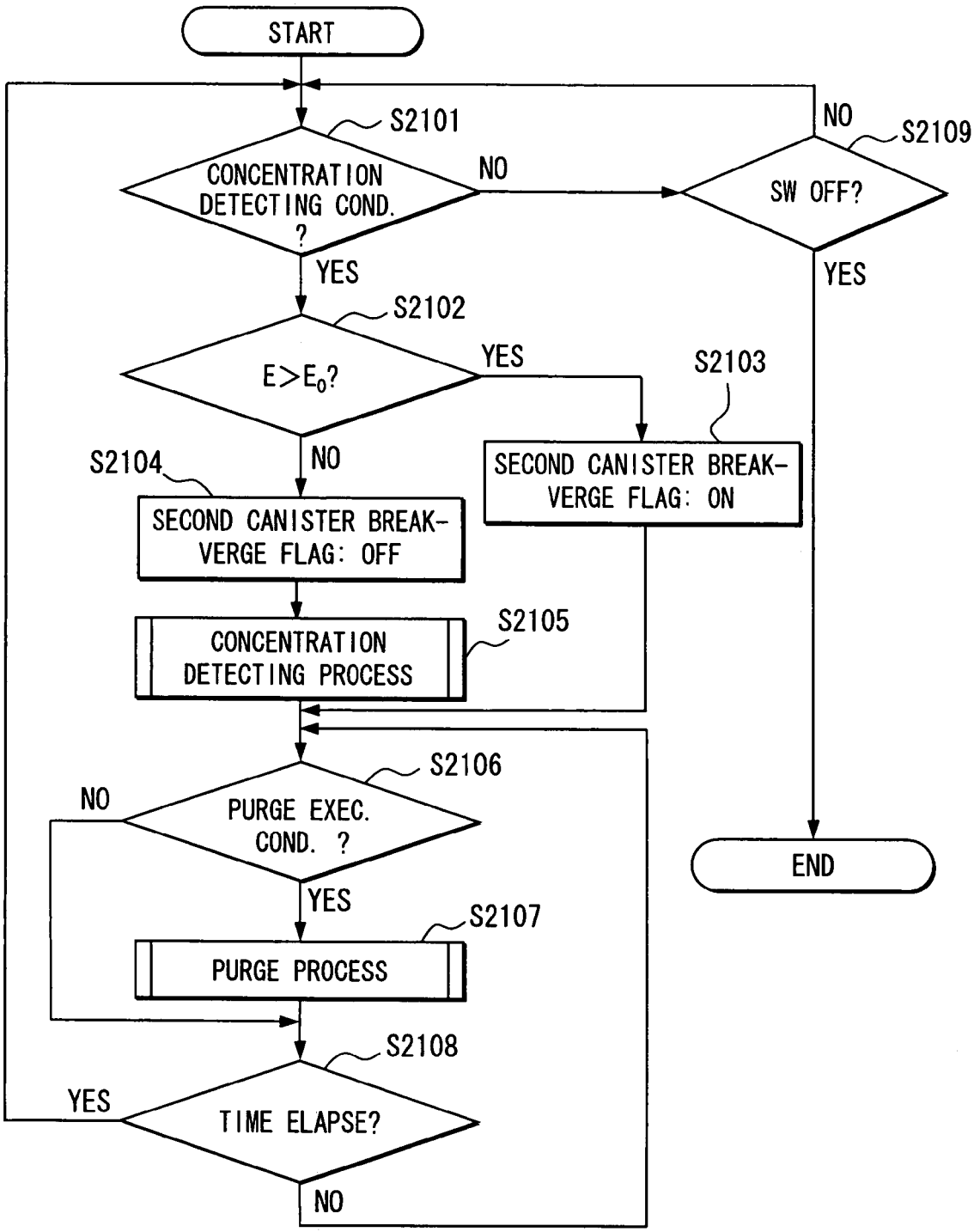
FIG. 46 is a flow chart showing a main process according to the eleventh embodiment.

As shown in FIGS. 45, 46, in the main process of this eleventh embodiment, when step S2101, which is substantially equivalent to step S101 in the first embodiment, makes a positive determination, the routine proceeds to step S2102. The ECU 38 stores an estimated absorption amount E as an estimation result of an amount of fuel vapor absorbed in the second canister 13. In step S2102, the ECU 38 evaluates whether the latest estimated absorption amount E is greater than an allowable threshold E0. For example, the allowable threshold E0 is set to be less than a breakthrough amount Ef. Breakthrough occurs in the second canister 13 when an amount of fuel vapor absorbed in the second canister 13 increases to the breakthrough amount Ef. The allowable threshold E0 is prestored in the memory of the ECU 38.

When the estimated absorption amount E is greater than the allowable threshold E0, the ECU 38 determines the second canister 13 to be on the verge of a breakthrough condition. In this condition, the ECU 38 determines that fuel vapor in the second canister 13 may be exhausted to the second detection passage 32, which is reduced in pressure, and consequently, the fuel vapor may be drawn into the pump 14. Thus, the routine proceeds to step S2103. In step S2103, the ECU 38 turns a second canister breakthrough-verge flag ON, and stores the second canister breakthrough-verge flag in the memory. Subsequently, the routine skips step S2105 not to execute the concentration detecting process, and proceeds to step S2106. In this operation, when the estimated absorption amount E is greater than the allowable threshold E0, the ECU 38 prohibits the concentration detecting process in which the second detection passage 32 is reduced in pressure.

When the estimated absorption amount E is equal to or less than the allowable threshold E0, ECU 38 determines that the second canister 13 is sufficiently in an absorbable condition. Thus, the ECU 38 determines that the pump 14 does not draw fuel vapor in the second canister 13 even when the second detection passage 32 is reduced in pressure. Thus, the routine proceeds to step S2104. In step S2104, the ECU 38 turns the second canister breakthrough-verge flag OFF, and stores the second canister breakthrough-verge flag in the memory. The routine proceeds to step S2105 to execute the concentration detecting process, and subsequently the routine proceeds to step S2106. In this operation, when the estimated absorption amount E is equal to or less than the allowable threshold E0, the ECU 38 allows to execute the concentration detecting process in which the second detection passage 32 is reduced in pressure.

Each of steps S2106, S2109 is substantially equivalent to each of steps S103, S107 in the first embodiment. Step S2108 is substantially equivalent to step S106 in the first embodiment, excluding that step S2108 is executed when step S2106 makes a negative determination or subsequent to step S2107. The process of each of steps S2105, S2107 is different from corresponding steps in the first embodiment. The difference is described as below.

Figure 47:
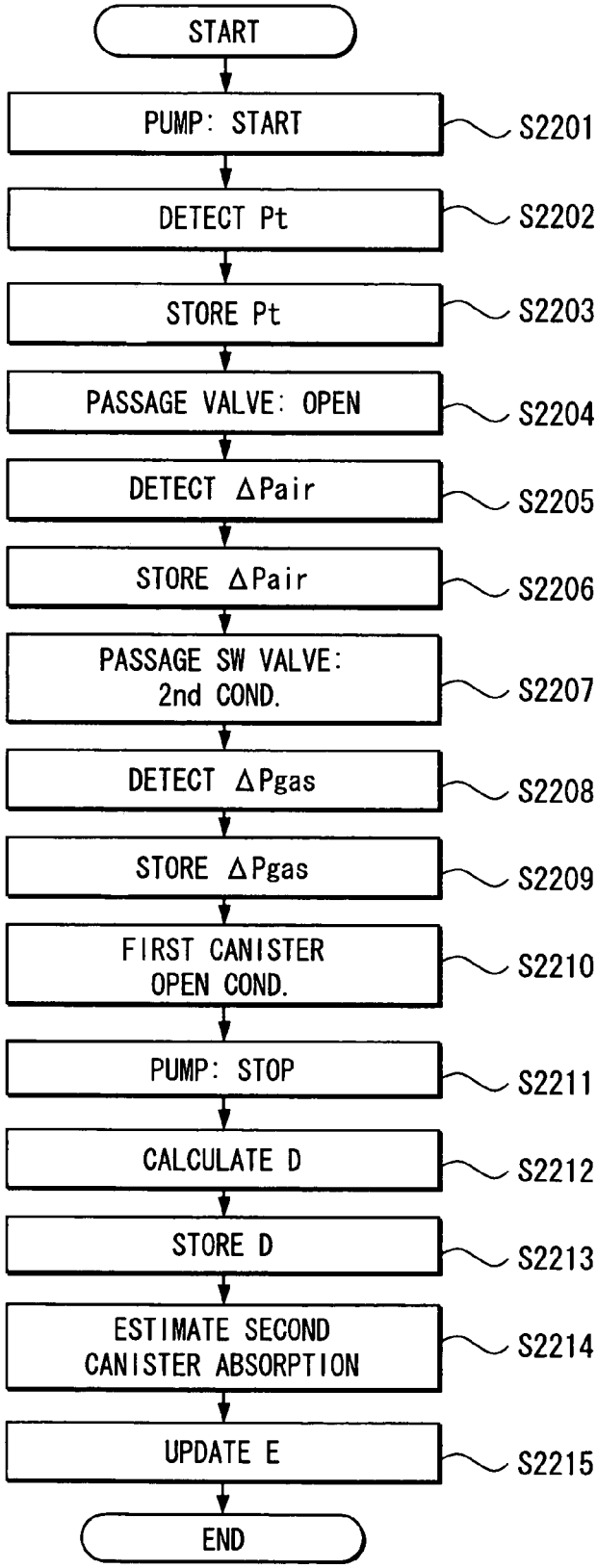
FIG. 47 is a flow chart showing a concentration detecting process according to the eleventh embodiment.

As shown in FIGS. 45, 47, in the concentration detecting process of this eleventh embodiment, the ECU 38 executes steps S2214, S2215 subsequent to steps S2201 to S2213, which correspond to steps S1601 to S1613 in the eighth embodiment.

In step S2212, the ECU 38 calculates the fuel vapor concentration D in accordance with the pressure Pt, ΔPair, ΔPgas. In step S2214, the ECU 38 estimates an amount (absorption amount) of fuel vapor absorbed in the second canister 13 in accordance with the fuel vapor concentration D calculated in step S2212.

Specifically, when the ECU 38 executes step S2214, the estimated absorption amount E stored in the memory of the ECU 38 is assumed to be an absorption amount (pre-detection absorption amount Edb) in the second canister 13 before detecting of the pressure Pt, ΔPair, ΔPgas. The absorption amount estimated by executing step S2214 is assumed to be an absorption amount (post-detection absorption amount Eda) in the second canister 13 after detecting of the pressure Pt, ΔPair, ΔPgas.

Under these assumptions, the post-detection absorption amount Eda can be estimated on the basis of the following equation (25) using the pre-detection absorption amount Edb as a parameter.

$$Eda=Edb+A1\cdot D \tag{25}$$

Figure 48:
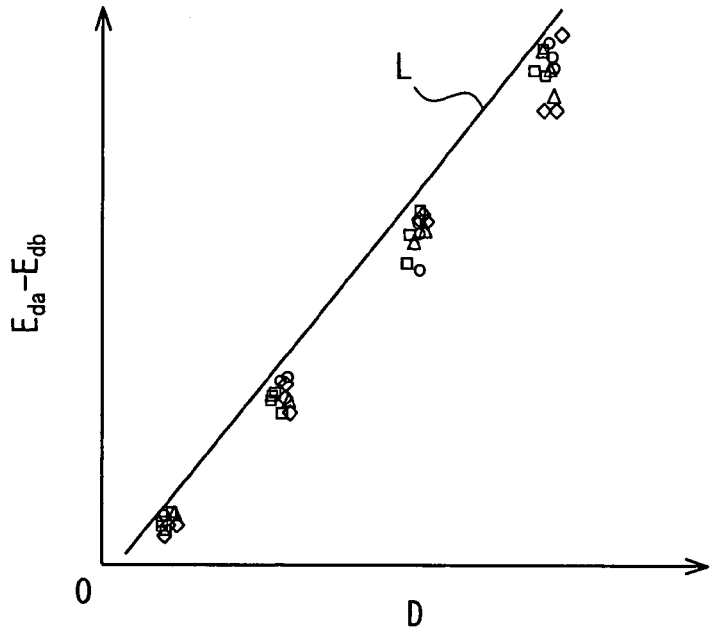
FIG. 48 is a graph showing a relationship between a fuel vapor concentration and an absorption amount in a second canister of the fuel vapor treatment apparatus, according to the eleventh embodiment.

For example, an experiment is conducted using a pump 14 having the maximum capacity as the flow amount Q, so that, as shown in FIG. 48, a correlation between the difference (Eda−Edb), which is calculated by subtracting the pre-detection absorption amount Edb from the post-detection absorption amount Eda, and the fuel vapor concentration D is obtained. Subsequently, a regression line L is defined on the safety side relative to the obtained correlation between the difference (Eda−Edb) and the fuel vapor concentration D. Thus, the coefficient A1 in the equation (25) can be obtained from the slope A1 of the regression line L. In this embodiment, the equation (25) and the coefficient A1 are prestored in the memory of the ECU 38. The ECU 38 uses the equation (25) and the coefficient A1 for estimating the post-detection absorption amount Eda.

The ECU 38 estimates the post-detection absorption amount Eda, and the routine proceeds to step S2215. In step S2215, the ECU 38 updates the estimated absorption amount E, stored in the memory, by substituting the estimated absorption amount E for the post-detection absorption amount Eda. Thus, the routine is terminated.

Figure 49:
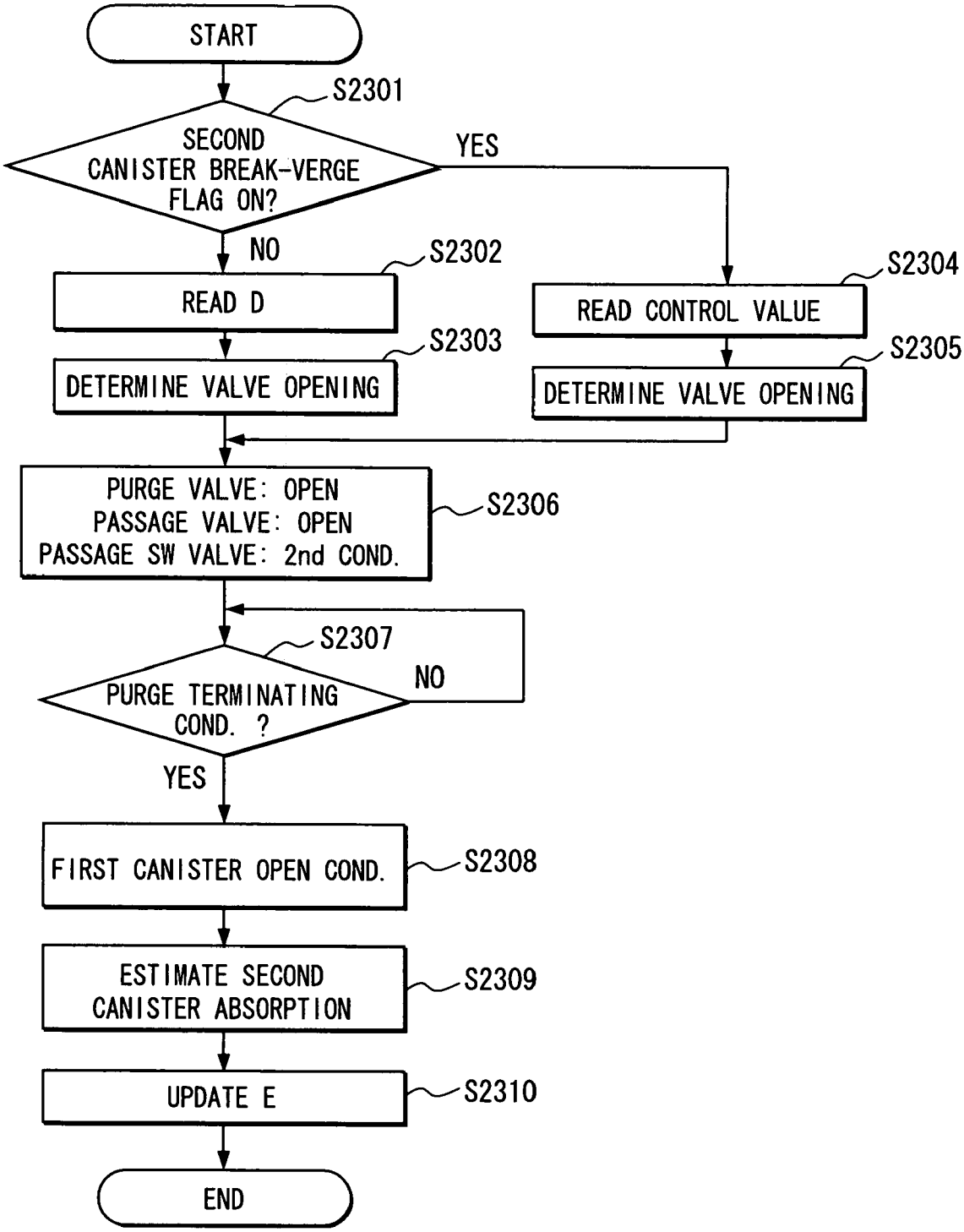
FIG. 49 is a flow chart showing a purge process according to the eleventh embodiment.

The purge execution process in this eleventh embodiment is described with reference to FIGS. 45, 49. As shown in FIG. 49, in step S2301, which is an alternative of step S301 in the first embodiment, the ECU 38 evaluates whether the second canister breakthrough-verge flag is ON.

When step S2301 makes a positive determination, the routine proceeds to steps S2304 to S2308, which are substantially equivalent to steps S304 to S306, S313, S314 in the first embodiment. In this operation, when the estimated absorption amount E is greater than the allowable threshold E0, the routine skips the concentration detecting process in step S2302. Subsequently, in step S2305, the ECU 38 determines the valve opening by ignoring the fuel vapor concentration D calculated from the pressure ΔPair, ΔPgas, Pt, so that the ECU 38 executes the purge process using the determined valve opening as an initial value to purge fuel vapor from both the canisters 12, 13.

When step S2301 makes a negative determination, the routine proceeds to steps S2302, S2303, S2306 to S2308, which are substantially equivalent to steps S302, S303, S306, S313, S314 in the first embodiment. In this operation, when the estimated absorption amount E is equal to or less than the allowable threshold E0, the routine executes the concentration detecting process in step S2302. Subsequently, in step S2303, the ECU 38 determines the valve opening by calculating the fuel vapor concentration D from the pressure ΔPair, ΔPgas, Pt, so that the ECU 38 executes the purge process using the determined valve opening as an initial value to purge fuel vapor from both the canisters 12, 13.

The ECU 38 executes the purge process, and subsequently, the routine proceeds to step S2309. In step S2309, the ECU 38 estimates the absorption amount of fuel vapor in the second canister 13 in accordance with a purge amount ΣQp of fuel vapor purged from the second canister 13 in steps S2306 to S2308

Specifically, when the ECU 38 executes step S2309, the estimated absorption amount E stored in the memory of the ECU 38 is assumed to be an absorption amount (pre-purge absorption amount Epb) in the second canister 13 before executing the purge process. The absorption amount estimated by executing step S2309 is assumed to be an absorption amount (post-purge absorption amount Epa) in the second canister 13 after executing the purge process.

Under these assumptions, the post-purge absorption amount Epa can be estimated on the basis of the following equations (26), (27), (28) using the pre-purge absorption amount Epb as a parameter. The equations (26), (27) respectively define the a1, b1 in the equation (28).

$$a1=a11\cdot Epb+a12 \tag{26}$$

$$b1=b11\cdot Epb+b12 \tag{27}$$

$$Epa=a1\cdot Ln(\Sigma Qp)+b1 \tag{28}$$

Figure 50:
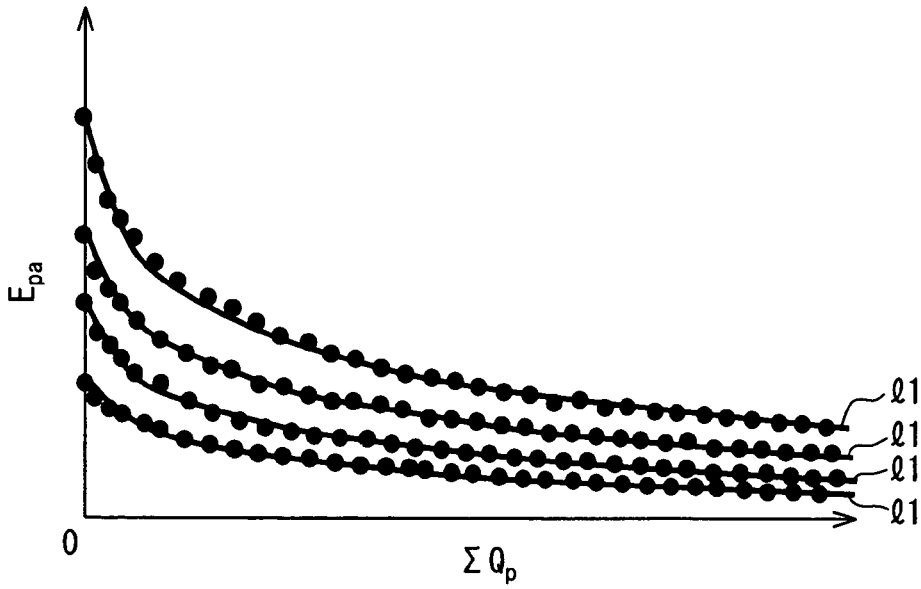
FIG. 50 is a graph showing a relationship between a purge amount and an absorption amount in the purge process of the fuel vapor treatment apparatus, according to the eleventh embodiment.
Figure 51:
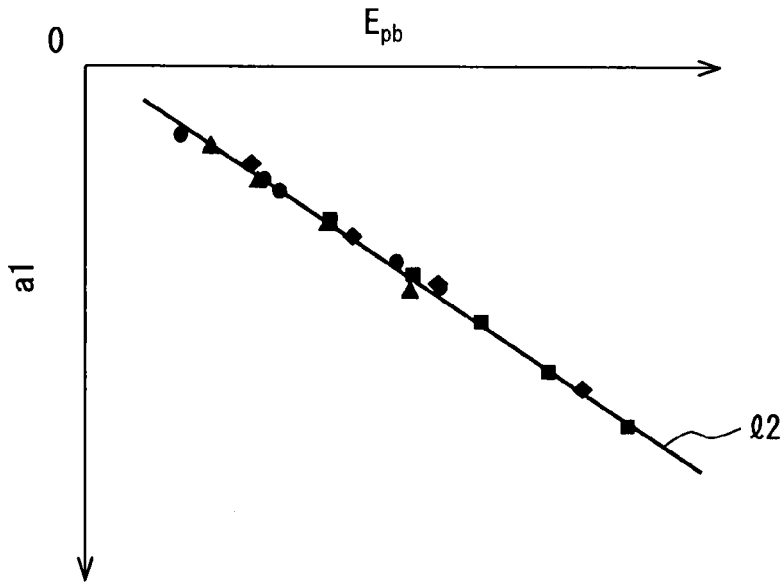
FIG. 51 is a graph showing a relationship between a pre-purge absorption amount and a coefficient for estimating the absorption amount in the purge process of the fuel vapor treatment apparatus, according to the eleventh embodiment.

For example, the coefficients a11, a12 in the equation (26) may be defined as follows. As shown in FIG. 50, primary correlations between the post purge absorption amount Epa and the purge amount ΣQp are obtained for various values of the pre-purge absorption amount Epb by conducting an experiment. Subsequently, regression lines L1 of the primary correlations are obtained for respective values of the pre-purge absorption amount Epb. The regression lines L1 are defined by the equation (28). As shown in FIG. 51, a secondary correlation between a coefficient a1 of each of the secondary correlations L1 and the pre-purge absorption amount Epb is obtained. A regression line L2 is defined relative to the secondary correlation between the coefficient a1 and the pre-purge absorption amount Epb. Thus, the coefficients a11, a12 in the equation (26) are obtained from the slope a11 and the intercept a12 of the regression line 12.

Figure 52:
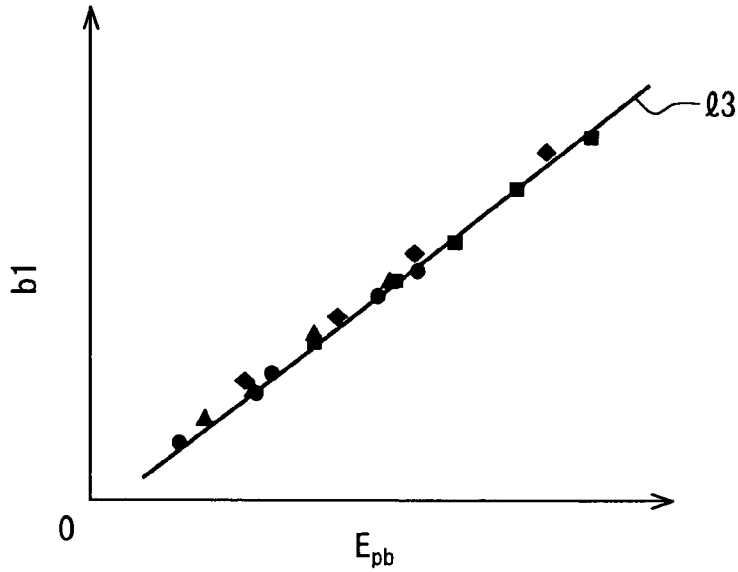
FIG. 52 is a graph showing a relationship between the pre-purge absorption amount and a coefficient for estimating the absorption amount in the purge process of the fuel vapor treatment apparatus, according to the eleventh embodiment.

For example, the coefficients b11, b12 in the equation (27) may be defined as follows. As shown in FIG. 52, a tertiary correlation between a coefficient b1 of each of the regression lines L1 and the pre-purge absorption amount Epb is obtained. The regression lines L1 are defined for obtaining the coefficients a11, a12. A regression line 13 is defined relative to the tertiary correlation between the coefficient b1 and the pre-purge absorption amount Epb. Thus, the coefficients b11, b12 in the equation (27) are obtained from the slope b11 and the intercept b12 of the regression line 13.

For example, the ECU 38 calculates the purge amount ΣQp of the equation (28) in each execution of the purge process in steps S2306 to S2308, as described below. Specifically, the ECU 38 calculates a total purge amount of fuel vapor purged from both the canisters 12, 13 in accordance with the valve opening and the detection pressure of the intake pressure sensor 7. The ECU 38 multiplies the total purge amount by a prestored value, which indicates a purge ratio between the canisters 12, 13, so that the ECU 38 calculates the purge amount ΣQp.

The following equation (29) is obtained from the equations (26), (27), (28). In this embodiment, the equation (29) and the coefficients a11, a12, b11, b12 are prestored in the memory of the ECU 38 for estimating of the post-purge absorption amount Epa.

$$Epa=(a11\cdot Epb+a12)\cdot Ln(\Sigma Qp)+(b11\cdot Epb+b12) \tag{29}$$

The ECU 38 estimates the post-purge absorption amount Epa, and the routine proceeds to step S2310. In step S2310, the ECU 38 updates the estimated absorption amount E, stored in the memory, by substituting the estimated absorption amount E for the post-purge absorption amount Epa. Thus, the routine is terminated.

In this eleventh embodiment, the ECU 38 properly executes the concentration detecting process by reducing pressure in the second detection passage 32 in a condition where the estimated absorption amount E of the second canister 13 is equal to or less than the allowable threshold E0. Thus, the ECU 38 controls the purge process in accordance with the fuel vapor concentration D, which is accurately obtained. The fuel vapor concentration D is a physical constant effective to a purge amount. In this operation, the ECU 38 is capable of conducting the purge process such that the ECU 38 preferably controls the air/fuel ratio of the engine 1.

In this eleventh embodiment, when the second canister 13 is on the verge of a breakthrough condition, and consequently, the estimated absorption amount E of the second canister 13 is greater than the allowable threshold E0, the ECU 38 prohibits the concentration detecting process, thereby prohibiting pressure reduction in the second detection passage 32. In this operation, fuel vapor in the second canister 13, which is in the breakthrough condition, can be restricted from being exhausted into the second detection passage 32. Thus, the pump 14 can be protected from drawing the fuel vapor. Thus, performance of the pump 14 can be maintained, and air pollution can be restricted. When the estimated absorption amount E becomes greater than the allowable threshold E0, the ECU 38 prohibits the concentration detecting process. Even in this condition, the ECU 38 executes the purge process in accordance with the prestored value other than the fuel vapor concentration D, so that the purge amount can be enhanced in the limited purge period.

In this eleventh embodiment, the pump 14 serves as a gas flow generating unit. The pressure sensor 16 serves as a pressure detecting unit. The ECU 38 serves as a purge control unit, an estimating unit, and an allow/prohibit determining unit.

Twelfth Embodiment

Figure 54:
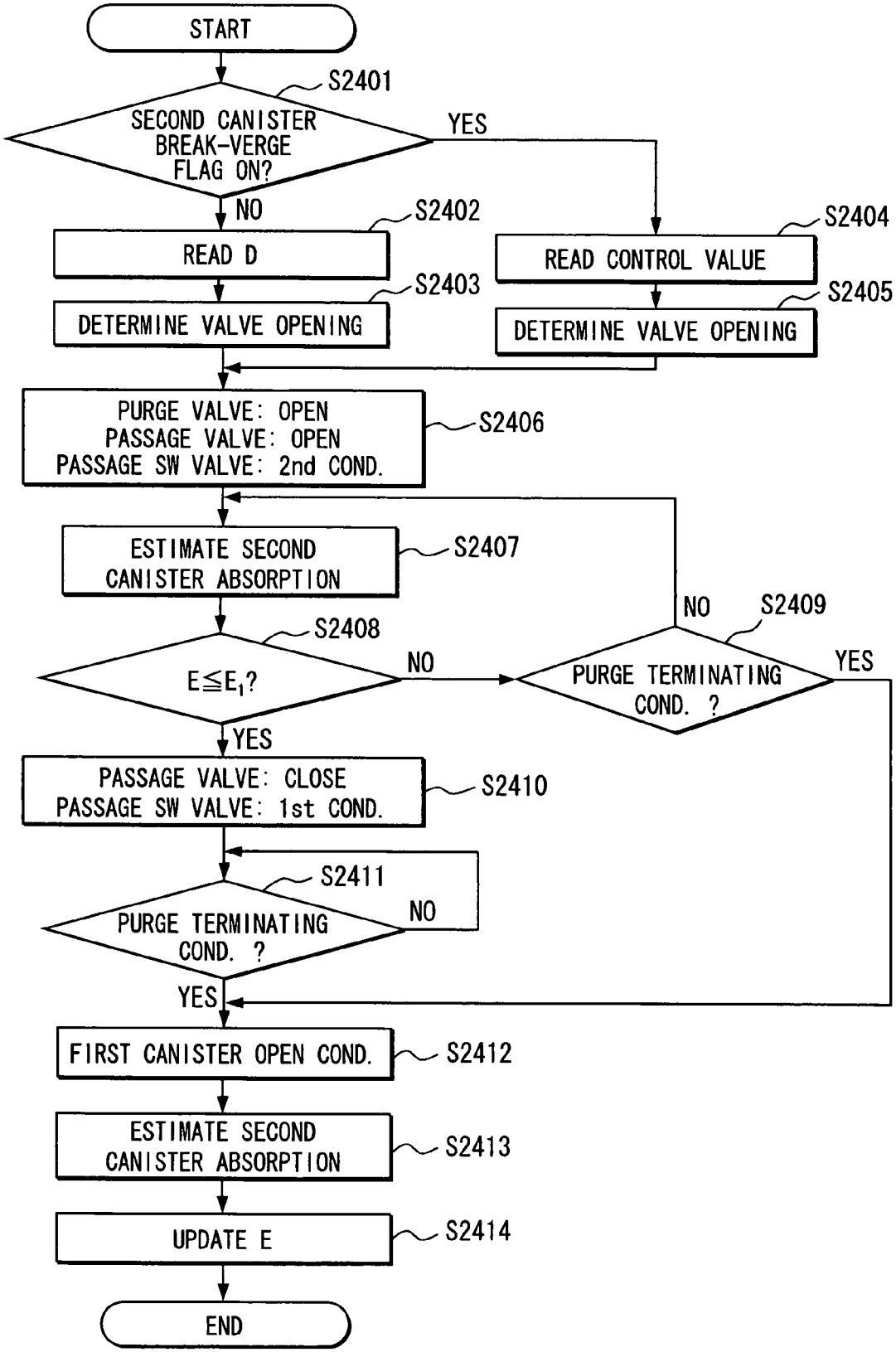
FIG. 54 is a flow chart showing a purge process according to the twelfth embodiment.

This twelfth embodiment is a modification of the eleventh embodiment. Specifically, as shown in FIGS. 53, 54, in this twelfth embodiment, the purge process is different from that of the eleventh embodiment.

The ECU 38 executes steps S2401 to S2406, which are substantially equivalent to steps S2301 to S2306 in the eleventh embodiment, to execute the first purge process for both the canisters 12, 13. The ECU 38 further executes steps S2407 to S2410.

In step S2407, the ECU 38 calculates the post-purge absorption amount Epa, which conforms to the equation (29), as the estimated absorption amount E, in accordance with the purge amount ΣQp in the first purge process through preceding steps. In step S2408, the ECU 38 evaluates whether the estimated absorption amount E calculated in step S2407 is equal to or less than a recovery threshold E1. For example, the recovery threshold E1 is set to be less than the breakthrough amount Ef and the allowable threshold E0. The recovery threshold E1 is prestored in the memory of the ECU 38.

In this operation, When the estimated absorption amount E is greater than the recovery threshold E1, the ECU 38 determines that the absorbing capacity of the second canister 13 is not sufficiently recovered by the first purge process. Thus, the routine proceeds to step S2409. In step S2409, the ECU 38 evaluates whether the purge terminating condition is satisfied. When step S2409 makes a negative determination, the routine returns to step S2407. When step S2409 makes a positive determination, the routine proceeds to step S2412. In step S2412, the ECU 38 forcedly terminates the first purge process.

When the estimated absorption amount E becomes less than the recovery threshold E1, the ECU 38 determines that the absorbing capacity of the second canister 13 is sufficiently recovered by the first purge process. Thus, the routine executes steps S2410 to S2412. Each of steps S2410 to S2412 corresponds to each of steps S312 to S314 in the first embodiment. In steps S2410 to S2412, the ECU 38 executes the second purge process to concentrate negative pressure in the intake passage 3 to the first canister 12. In this twelfth embodiment, the ECU 38 executes the first purge process to recover the absorbing capacity of the second canister 13, and subsequently, the ECU 38 switches the operation to the second purge process to concentrate negative pressure to the first canister 12, so that the purge amount can be enhanced.

The routine proceeds to steps S2413, S2414, which are substantially equivalent to steps S2309, S2310 in the eleventh embodiment, subsequent to step S2412 to update the estimated absorption amount E.

Thirteenth Embodiment

This thirteenth embodiment is a modification of the first embodiment, and being capable of producing effects similarly to the eleventh embodiment. In addition, this thirteenth embodiment is different from the first embodiment in that, even when error occurs in the estimation of the amount of fuel vapor absorbed in the second canister 13, the ECU 38 corrects the error of the estimation to reduce influence caused by the error.

Figure 55:
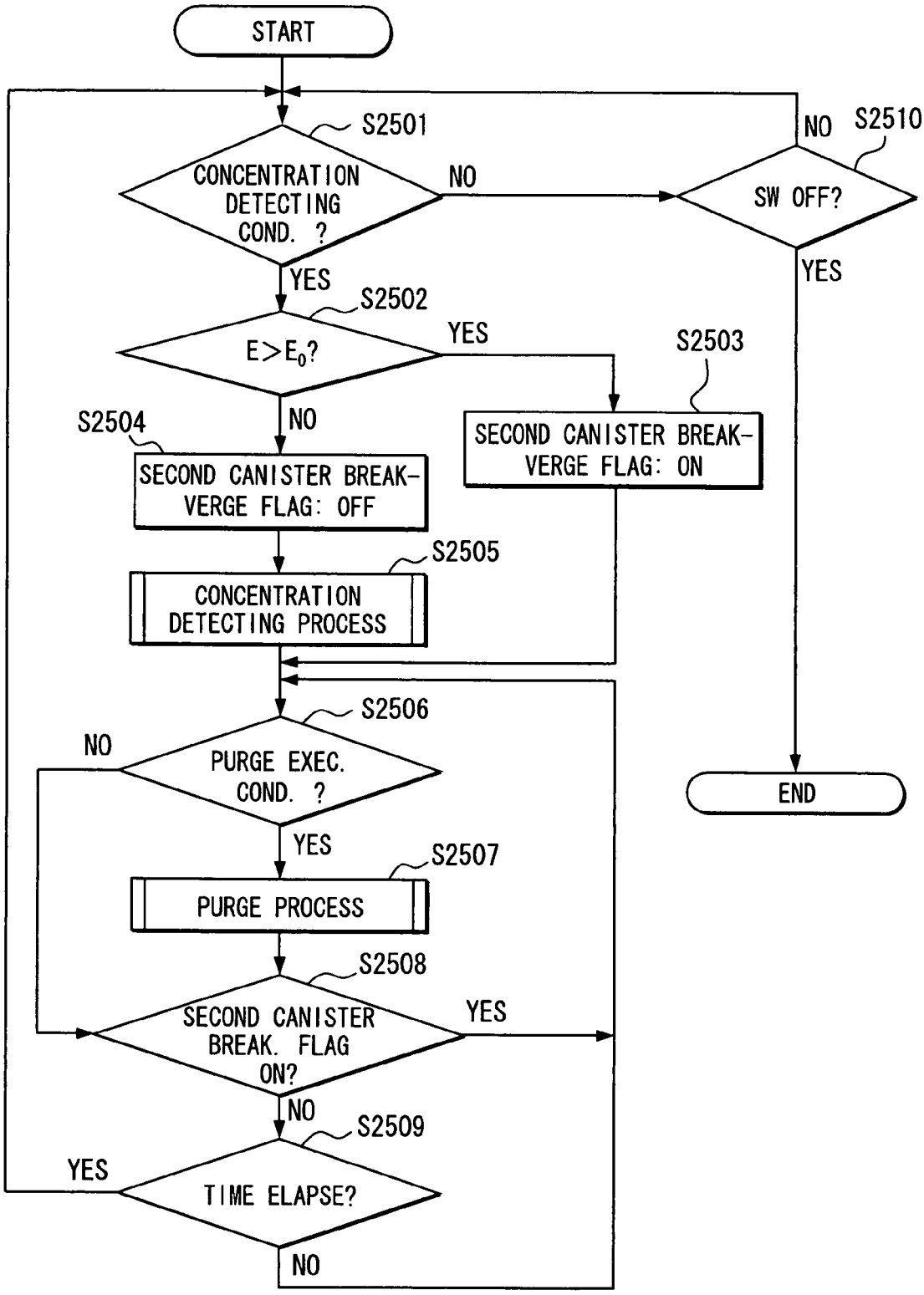
FIG. 55 is a flow chart showing a main process according to a thirteenth embodiment.

As shown in FIG. 55, in the main process of this thirteenth embodiment, in steps S2502 to S2504, each corresponding to steps S2102 to S2104 in the eleventh embodiment, the ECU 38 compares the estimated absorption amount E with the allowable threshold E0, thereby evaluating whether the ECU 38 allows the concentration detecting process.

Each of steps S2501, S2506, S2508 to S2510 is substantially equivalent to each of steps S101, S103, S105 to S107 in the first embodiment. The process of each of steps S2505, S2507 is different from corresponding steps in the first embodiment. The difference is described as below.

Figure 56:
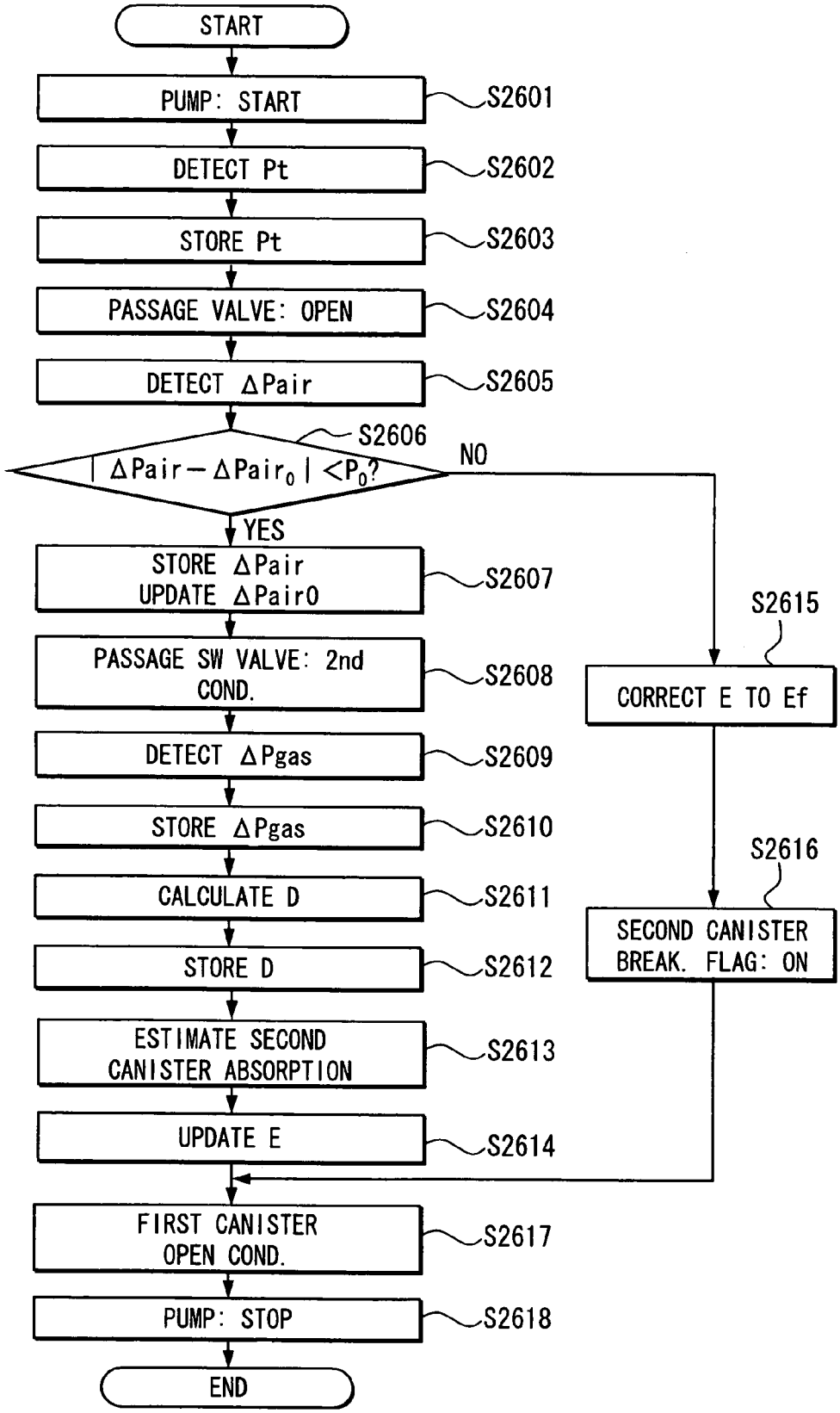
FIG. 56 is a flow chart showing a concentration detecting process according to the thirteenth embodiment.

As shown in FIG. 56, in the concentration detecting process of this thirteenth embodiment, steps S2613 to S2615 are added to steps S2601 to S2612 and steps S2616 to S2618, which are substantially equivalent to steps S201 to S215 in the first embodiment.

Each of steps S2613, S2614 corresponds to each of steps S2214, S2215 in the eleventh embodiment. In steps S2613, S2614, the ECU 38 estimates the amount (post-detection absorption amount Eda) of fuel vapor absorbed in the second canister 13, thereby updating the estimated absorption amount E stored in the memory.

In step S2606, when the ECU 38 detects fuel vapor exhausted from the second canister 13, the routine proceeds to step S2615. In step S2615, the ECU 38 forcedly corrects the estimated absorption amount E, which is stored in the memory, by substituting the breakthrough amount Ef for the estimated absorption amount E. Subsequently, in steps S2616 to S2618, the ECU 38 further executes the concentration detecting process. Thus, the routine is terminated. The ECU 38 may start the concentration detecting process by determining the estimated absorption amount E to be equal to or less than the allowable threshold E0, even in a condition where breakthrough actually occurs in the second canister 13. In this condition, in the above operation of this thirteenth embodiment, the ECU 38 restricts both detection of the second pressure ΔPgas, which is conducted by reducing pressure in the second detection passage 32, and calculation of the fuel vapor concentration D.

Figure 57:
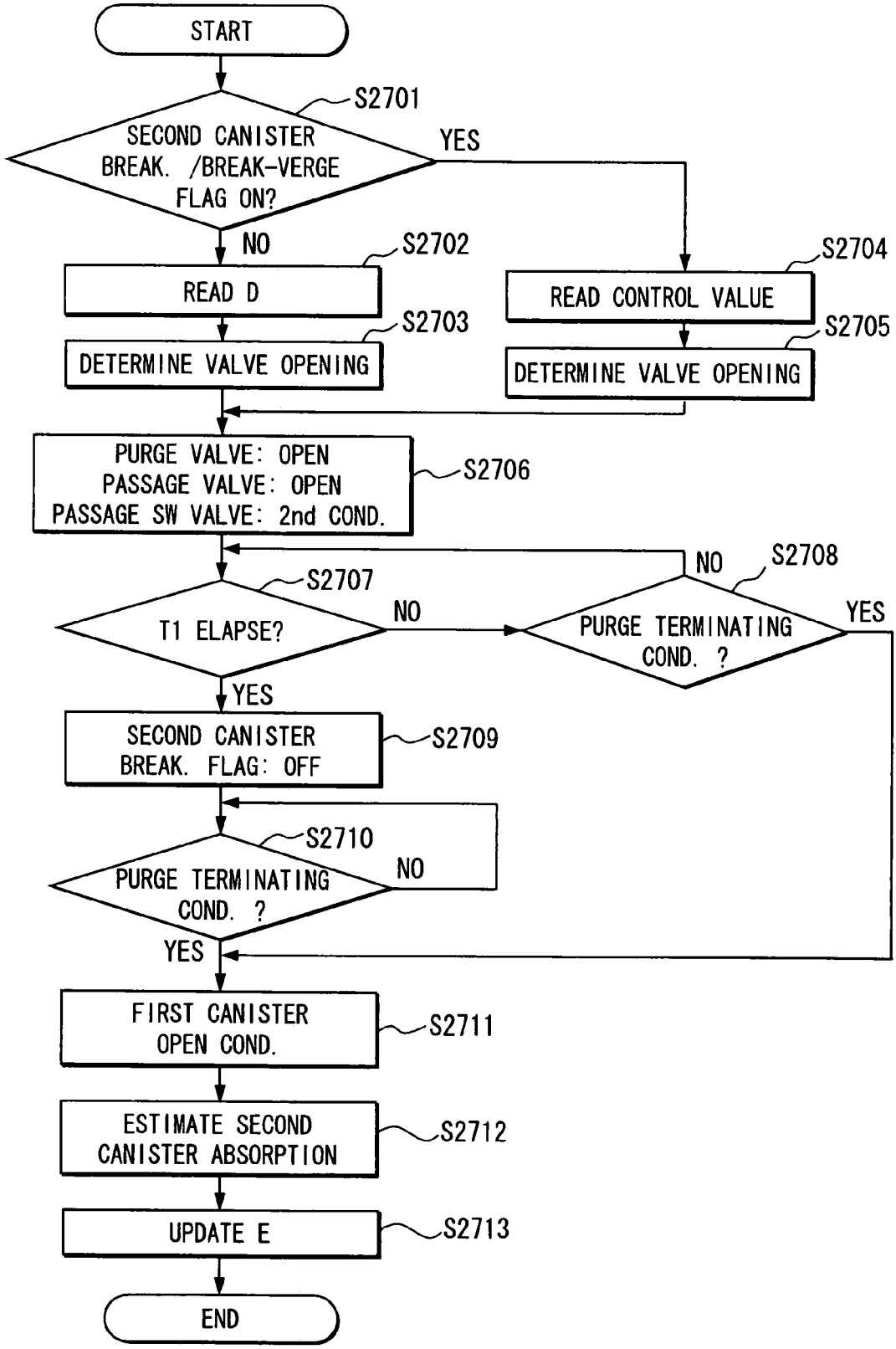
FIG. 57 is a flow chart showing a purge process according to the thirteenth embodiment.

As shown in FIG. 57, in the purge process of this thirteenth embodiment, the ECU 38 executes step S2701 instead of step S301 in the first embodiment. Specifically, in step S2701, the ECU 38 evaluates whether one of the second canister breakthrough-verge flag and the second canister breakthrough flag is ON.

When step S2701 makes a positive determination, the routine proceeds to steps S2704 to S2711, which are substantially equivalent to steps S304 to S309, S313, S314 in the first embodiment. In this operation, when the estimated absorption amount E is greater than the allowable threshold E0, or when the ECU 38 detects fuel vapor exhausted from the second canister 13, the routine skips the concentration detecting process in step S2702. Subsequently, in step S2705, the ECU 38 determines the valve opening by ignoring the fuel vapor concentration D, so that the ECU 38 executes the purge process using the determined valve opening as an initial value to purge fuel vapor from both the canisters 12, 13.

When step S2701 makes a negative determination, the routine proceeds to steps S2702, S2703, S2706 to S2711, which are substantially equivalent to steps S302, S303, S306 to S309, S313, S314 in the first embodiment. In a condition where the ECU 38 calculates the latest fuel vapor concentration D, the ECU 38 defines the valve opening as an initial value correspondingly to the latest fuel vapor concentration D, so that the ECU 38 conducts the purge process to purge fuel vapor from both the canisters 12,13.

In each case, the routine proceeds to steps S2712, S2713, which correspond to steps S2309, S2310 in the eleventh embodiment, subsequent to step S2711. In steps S2712, S2713, the ECU 38 estimates the amount (post-purge absorption amount Epa) of fuel vapor absorbed in the second canister 13, thereby updating the estimated absorption amount E stored in the memory.

In this thirteenth embodiment, when the ECU 38 allows executing of the concentration detecting process in step S2502, the routine proceeds to step S2505 where the ECU 38 detects fuel vapor exhausted from the second canister 13. In this case, the routine may return to steps S2501, S2502 without proceeding to step S2507 where the ECU 38 executes the purge process. However, in this case, the ECU 38 forcedly corrects the estimated absorption amount E to the breakthrough amount Ef in the preceding concentration detecting process, so that the ECU 38 determines the estimated absorption amount E to be greater than the allowable amount E0 in step S2502. Thus, the ECU 38 steadily prohibits the subsequent concentration detecting process. In this thirteenth embodiment, even if the ECU 38 causes an error in calculating of the estimated value, and consequently, the ECU 38 fails to detect breakthrough caused in the second canister 13 due to the error in the estimated value, influence due to the breakthrough can be restricted. Thus, in this thirteenth embodiment, a failsafe operation can be produced.

In this thirteenth embodiment, when the ECU 38 detects fuel vapor exhausted from the second canister 13, and the ECU 38 does not calculate the fuel vapor concentration D, the ECU 38 executes the purge process in accordance with the prestored value other than the fuel vapor concentration D. Thus, the purge amount can be enhanced in the limited purge period.

In this thirteenth embodiment, the ECU 38 serves as an exhaust detecting unit and a correcting unit.

Other Embodiment

As described above, the present invention, is not limited to the above embodiment, and is capable of being applied to various embodiments as long as being undeviating from the gist thereof.

For example, in the first to thirteenth embodiments, a device or a method may be provided instead of the pressure sensor 16 for detecting pressure in the first detection passage 29, which is reduced in pressure through the second detection passage 32 by operating of the pump 14 and/or by opening of the flow control valve 104. For example, a differential pressure sensor may be provided for detecting differential pressure between two portions in the first detection passage 29 through the throttle 50. Alternatively, a pair of pressure sensors may be provided for detecting pressure respectively in two portions in the first detection passage 29 through the throttle 50. Alternatively, a pressure sensor may be provided for detecting pressure in the first detection passage 29 on the side of the pump 14 with respect to the throttle 50. Alternatively, a pressure sensor may be provided for detecting pressure in the first detection passage 29 on the side of the flow control valve 104 with respect to the throttle 50.

For example, in the first to sixth embodiments, the eleventh to thirteenth embodiments, and the modification of the seventh embodiment in FIG. 34, the accumulator 101, the negative pressure control valve 102, and the flow control valve 104 may be combined similarly to the tenth embodiment, and provided instead of the pump 14.

In the first to fifth embodiments and the thirteenth embodiment, the ECU 38 may detect exhaust of fuel vapor using the fuel sensor 70 similarly to the sixth embodiment, in addition to detecting exhaust of fuel vapor on the basis of the first pressure ΔPair or the minimum period Tair. In the second, fourth, fifth, and the thirteenth embodiments, the ECU 38 may detect exhaust of fuel vapor using the fuel sensor 70, instead of detecting exhaust of fuel vapor on the basis of the first pressure ΔPair. In the second, fourth, fifth, and the thirteenth embodiments, the ECU 38 may detect exhaust of fuel vapor in accordance with the minimum period Tair similarly to the third embodiment, instead of detecting exhaust of fuel vapor on the basis of the first pressure ΔPair. In the second, fourth, fifth, and the thirteenth embodiments, the ECU 38 may detect exhaust of fuel vapor in accordance with the minimum period Tair similarly to the third embodiment, and using the fuel sensor 70 similarly to the sixth embodiment, in addition to detecting exhaust of fuel vapor on the basis of the first pressure ΔPair.

In the second, third, seventh to ninth embodiments, and the tenth to thirteenth embodiments, the structure may be modified correspondingly to those of the fourth and fifth embodiments.

In the seventh and ninth embodiments, the ECU 38 may detect exhaust of fuel vapor using the fuel sensor 90 similarly to the eighth embodiment, in addition to detecting exhaust of fuel vapor on the basis of the first pressure ΔPair. In the ninth embodiment, the ECU 38 may detect exhaust of fuel vapor using the fuel sensor 90 similarly to the eighth embodiment, instead of detecting exhaust of fuel vapor on the basis of the first pressure ΔPair.

In the thirteenth embodiment, the ECU 38 may evaluate recovery of the absorption capacity of the second canister 13, which is in the breakthrough condition, in accordance with the purge amount similarly to the second embodiment. Alternatively, the ECU 38 may evaluate recovery of the absorption capacity of the second canister 13 in accordance with the estimated absorption amount E of the second canister 13, similarly to the eleventh embodiment. In the thirteenth embodiment, steps S2407 to S2410, which correspond to those in the twelfth embodiment, may be added between steps S2709, S2710, in which the ECU 38 conducts the purge process. In this case, the amount of fuel vapor purged from the first canister 12 can be enhanced.

The above processings such as calculations and determinations are not limited being executed by the ECU 38. The control unit may have various structures including the ECU 38 shown as an example.

The above structures of the embodiments can be combined as appropriate.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel vapor treatment apparatus comprising:

a first canister for removably absorbing fuel vapor produced in a fuel tank;

a purge passage through which fuel vapor removed from the first canister is purged into an intake passage of an engine;

a first detection passage communicating with the purge passage, the first detection passage having a throttle midway therethrough;

a second canister located on an opposite side of the purge passage with respect to the throttle, the second canister communicating with the first detection passage for removably absorbing fuel vapor flowing from the purge passage into the second canister through the first detection passage;

a second detection passage communicating with the second canister;

a gas flow generating unit for generating gas flow by reducing pressure in the second detection passage;

a pressure detecting unit for detecting pressure correlated with the throttle and the gas flow generating unit;

an exhaust detecting unit for detecting exhaust of fuel vapor from the second canister to the second detection passage; and a purge control unit for controlling purge of fuel vapor from the purge passage to the intake passage in accordance with a detection result of the pressure detecting unit and a detection result of the exhaust detecting unit.

2. The fuel vapor treatment apparatus according to claim 1, wherein when the exhaust detecting unit does not detect the exhaust, the purge control unit controls the purge in accordance with the detection result of the pressure detecting unit, and wherein when the exhaust detecting unit detects the exhaust, the purge control unit prohibits control of the purge in accordance with the detection result of the pressure detecting unit.

3. The fuel vapor treatment apparatus according to claim 2, wherein when the exhaust detecting unit does not detect the exhaust, the purge control unit calculates a fuel vapor condition in the purge passage in accordance with the detection result of the pressure detecting unit, and the purge control unit controls the purge in accordance with the fuel vapor condition.

4. The fuel vapor treatment apparatus according to claim 2, wherein when the exhaust detecting unit detects the exhaust, the purge control unit controls the purge by ignoring the detection result of the pressure detecting unit.

5. The fuel vapor treatment apparatus according to claim 2, wherein the purge control unit prohibits control of the purge in accordance with the detection result of the pressure detecting unit, until an absorbing capacity of the second canister recovers.

6. The fuel vapor treatment apparatus according to claim 5, wherein when a predetermined time elapses since the purge control unit removes fuel vapor from the second canister to purge the fuel vapor into the intake passage through the first detection passage and the purge passage, the purge control unit determines that the absorbing capacity recovers.

7. The fuel vapor treatment apparatus according to claim 5, wherein when the purge control unit removes fuel vapor from the second canister to purge the fuel vapor into the intake passage through the first detection passage and the purge passage by a predetermined amount, the purge control unit determines that the absorbing capacity recovers.

8. The fuel vapor treatment apparatus according to claim 1, further comprising:

an atmosphere passage opening to an atmosphere; and a passage switching unit for switching between the purge passage and the atmosphere passage to be communicated with the first detection passage, wherein the pressure detecting unit detects first pressure in a condition where:

the gas flow generating unit reduces pressure in the second detection passage; and the passage switching unit communicates the atmosphere passage with the first detection passage, wherein the pressure detecting unit detects second pressure in a condition where:

the gas flow generating unit reduces pressure in the second detection passage; and the passage switching unit communicates the purge passage with the first detection passage, wherein when the exhaust detecting unit does not detect the exhaust, the purge control unit controls the purge in accordance with the first pressure and the second pressure.

9. The fuel vapor treatment apparatus according to claim 8, further comprising:

a passage open/close unit for communicating and blocking a specific passage, which is at least one of the first detection passage and the second detection passage, wherein the pressure detecting unit detects shutoff pressure in a condition where:

the gas flow generating unit reduces pressure in the second detection passage; and the passage open/close unit blocks the specific passage, wherein when the exhaust detecting unit does not detect the exhaust, the purge control unit controls the purge in accordance with the first pressure, the second pressure, and the shutoff pressure.

10. The fuel vapor treatment apparatus according to claim 8, wherein the exhaust detecting unit detects the exhaust in accordance with the first pressure.

11. The fuel vapor treatment apparatus according to claim 10, wherein the first pressure is a first pressure reference, in a condition where the exhaust does not exist, wherein when a difference between the first pressure and the first pressure reference is equal to or greater than an allowable threshold, the exhaust detecting unit determines to detect the exhaust.

12. The fuel vapor treatment apparatus according to claim 11, wherein the first pressure reference is determined in accordance with the first pressure previously detected using the pressure detecting unit.

13. The fuel vapor treatment apparatus according to claim 12, wherein the first pressure reference is determined by averaging a plurality of values of the first pressure previously detected using the pressure detecting unit.

14. The fuel vapor treatment apparatus according to claim 8, wherein the exhaust detecting unit detects the exhaust in accordance with a minimum period needed until the first pressure becomes substantially constant.

15. The fuel vapor treatment apparatus according to claim 14, wherein when the exhaust does not exist, the minimum period of the first pressure is a minimum period reference, wherein when a difference between the minimum period and the minimum period reference is equal to or greater than an allowable threshold, the exhaust detecting unit determines to detect the exhaust.

16. The fuel vapor treatment apparatus according to claim 15, wherein the minimum period reference is determined in accordance with the minimum period of the first pressure previously detected using the pressure detecting unit.

17. The fuel vapor treatment apparatus according to claim 16, wherein the minimum period reference is determined by averaging a plurality of values of the minimum periods of the first pressure previously detected using the pressure detecting unit.

18. The fuel vapor treatment apparatus according to claim 1, further comprising:

a fuel detecting unit for detecting fuel vapor in the second detection passage, wherein the exhaust detecting unit detects the exhaust in accordance with a detection result of the fuel detecting unit.

19. The fuel vapor treatment apparatus according to claim 18, further comprising:

an atmosphere passage opening to an atmosphere; and a passage switching unit for switching between the purge passage and the atmosphere passage to be communicated with the first detection passage, wherein the exhaust detecting unit detects the exhaust in accordance with a detection result of the fuel detecting unit, in a condition where the passage switching unit communicates the atmosphere passage with the first detection passage.

20. The fuel vapor treatment apparatus according to claim 1, further comprising:

an atmosphere passage opening to an atmosphere;

a switching unit for switching between the purge passage and the atmosphere passage to be communicated with the first detection passage; and a first passage open/close unit for communicating and blocking the first detection passage, wherein when the exhaust detecting unit detects the exhaust, the first passage open/close unit blocks the first detection passage.

21. The fuel vapor treatment apparatus according to claim 1, further comprising:

a second passage open/close unit for communicating and blocking the second detection passage, wherein when the exhaust detecting unit detects the exhaust, the second passage open/close unit blocks the second detection passage.

22. The fuel vapor treatment apparatus according to claim 1, further comprising:

a pressure reduction control unit, wherein when the exhaust detecting unit detects the exhaust, the pressure reduction control unit prohibits the gas flow generating unit from reducing pressure in the second detection passage.

23. The fuel vapor treatment apparatus according to claim 22, wherein the gas flow generating unit has an exhaust port opening to an atmosphere, and the gas flow generating unit is adapted to exhausting gas, which is drawn from the second detection passage, through the exhaust port.

24. The fuel vapor treatment apparatus according to claim 22, wherein the pressure reduction control unit prohibits the gas flow generating unit from reducing pressure in the second detection passage, until an absorbing capacity of the second canister recovers.

25. The fuel vapor treatment apparatus according to claim 24, wherein when a predetermined time elapses since the purge control unit removes fuel vapor from the second canister to purge the fuel vapor into the intake passage through the first detection passage and the purge passage, the pressure reduction control unit determines that the absorbing capacity recovers.

26. The fuel vapor treatment apparatus according to claim 24, wherein when the purge control unit removes fuel vapor from the second canister to purge the fuel vapor into the intake passage through the first detection passage and the purge passage by a predetermined amount, the pressure reduction control unit determines that the absorbing capacity recovers.

27. A fuel vapor treatment apparatus comprising:

a canister for removably absorbing fuel vapor produced in a fuel tank;

a purge passage through which fuel vapor removed from the canister is purged into an intake passage of an engine;

a detection passage having a throttle midway therethrough;

a gas flow generating unit for generating gas flow by reducing pressure in the detection passage;

a pressure detecting unit for detecting pressure correlated with the throttle and the gas flow generating unit;

an open passage communicating with both an atmosphere and the canister;

an atmosphere passage communicating with the open passage;

a passage switching unit for switching between the purge passage and the atmosphere passage to be communicated with the detection passage;

an exhaust detecting unit for detecting exhaust of fuel vapor from the canister to the open passage; and a purge control unit for controlling purge of fuel vapor from the purge passage to the intake passage in accordance with a detection result of the pressure detecting unit and a detection result of the exhaust detecting unit.

28. The fuel vapor treatment apparatus according to claim 27, wherein the gas flow generating unit has an exhaust port communicating with the open passage, and the gas flow generating unit is adapted to exhausting gas, which is drawn from the detection passage, through the exhaust port.

29. The fuel vapor treatment apparatus according to claim 27, wherein when the exhaust detecting unit does not detect the exhaust, the purge control unit controls the purge in accordance with the detection result of the pressure detecting unit, wherein when the exhaust detecting unit detects the exhaust, the purge control unit prohibits control of the purge in accordance with the detection result of the pressure detecting unit.

30. The fuel vapor treatment apparatus according to claim 29, wherein when the exhaust detecting unit does not detect the exhaust, the purge control unit calculates a fuel vapor condition in the purge passage in accordance with the detection result of the pressure detecting unit, and the purge control unit controls the purge in accordance with the fuel vapor condition.

31. The fuel vapor treatment apparatus according to claim 29, wherein when the exhaust detecting unit detects the exhaust, the purge control unit controls the purge by ignoring the detection result of the pressure detecting unit.

32. The fuel vapor treatment apparatus according to claim 29, wherein the purge control unit prohibits control of the purge in accordance with the detection result of the pressure detecting unit, until fuel vapor is swept from the open passage.

33. The fuel vapor treatment apparatus according to claim 32, wherein when a predetermined time elapses since the purge control unit applies negative pressure to remove fuel vapor from the canister and purge the fuel vapor into the intake passage, the purge control unit determines that sweeping of fuel vapor is completed.

34. The fuel vapor treatment apparatus according to claim 32, wherein when the purge control unit applies negative pressure to remove fuel vapor from the canister and purge the fuel vapor into the intake passage by a predetermined amount, the purge control unit determines that sweeping of fuel vapor is completed.

35. The fuel vapor treatment apparatus according to claim 27, further comprising:

an atmosphere passage opening to an atmosphere; and a passage switching unit for switching between the purge passage and the atmosphere passage to be communicated with the detection passage, wherein the pressure detecting unit detects first pressure in a condition where:

the gas flow generating unit reduces pressure in the detection passage; and the passage switching unit communicates the atmosphere passage with the detection passage, wherein the pressure detecting unit detects second pressure in a condition where:

the gas flow generating unit reduces pressure in the detection passage; and the passage switching unit communicates the purge passage with the detection passage, wherein when the exhaust detecting unit does not detect the exhaust, the purge control unit controls the purge in accordance with the first pressure and the second pressure.

36. The fuel vapor treatment apparatus according to claim 35, wherein the exhaust detecting unit detects the exhaust in accordance with the first pressure.

37. The fuel vapor treatment apparatus according to claim 36, wherein when the exhaust does not exist, the first pressure is a first pressure reference, wherein when a difference between the first pressure and the first pressure reference is equal to or greater than an allowable threshold, the exhaust detecting unit determines to detect the exhaust.

38. The fuel vapor treatment apparatus according to claim 37, wherein the first pressure reference is determined in accordance with the first pressure previously detected using the pressure detecting unit.

39. The fuel vapor treatment apparatus according to claim 38, wherein the first pressure reference is determined by averaging a plurality of values of the first pressure previously detected using the pressure detecting unit.

40. The fuel vapor treatment apparatus according to claim 35, further comprising:

a passage open/close unit for communicating and blocking the detection passage, wherein the pressure detecting unit detects shutoff pressure in a condition where:

the gas flow generating unit reduces pressure in the detection passage; and the passage open/close unit blocks the detection passage, wherein when the exhaust detecting unit does not detect the exhaust, the purge control unit controls the purge in accordance with the first pressure, the second pressure, and the shutoff pressure.

41. The fuel vapor treatment apparatus according to claim 40, wherein the exhaust detecting unit detects the exhaust in accordance with the shutoff pressure.

42. The fuel vapor treatment apparatus according to claim 41, wherein when the exhaust does not exist, the shutoff pressure is a shutoff pressure reference, wherein when a difference between the shutoff pressure and the shutoff pressure reference is equal to or greater than an allowable threshold, the exhaust detecting unit determines to detect the exhaust.

43. The fuel vapor treatment apparatus according to claim 42, wherein the shutoff pressure reference is determined in accordance with the shutoff pressure previously detected using the pressure detecting unit.

44. The fuel vapor treatment apparatus according to claim 43, wherein the shutoff pressure reference is determined by averaging a plurality of values of the shutoff pressure previously detected using the pressure detecting unit.

45. The fuel vapor treatment apparatus according to claim 27, further comprising:

a fuel detecting unit for detecting fuel vapor in the open passage, wherein the exhaust detecting unit detects the exhaust in accordance with a detection result of the fuel detecting unit.

46. A fuel vapor treatment apparatus comprising:

a canister for removably absorbing fuel vapor produced in a fuel tank;

a purge passage through which fuel vapor removed from the canister is purged into an intake passage of an engine;

a detection passage communicating with the purge passage, the detection passage having a throttle midway therethrough;

a gas flow generating unit for generating gas flow by reducing pressure in the detection passage, the gas flow generating unit having an exhaust port for exhausting gas drawn from the detection passage;

a pressure detecting unit for detecting pressure correlated with the throttle and the gas flow generating unit;

an open passage communicating with an atmosphere, the canister, and the exhaust port;

an exhaust detecting unit for detecting exhaust of fuel vapor from the canister to the open passage; and a purge control unit for controlling purge of fuel vapor from the purge passage to the intake passage in accordance with a detection result of the pressure detecting unit and a detection result of the exhaust detecting unit.

47. The fuel vapor treatment apparatus according to claim 46, wherein when the exhaust detecting unit does not detect the exhaust, the purge control unit controls the purge in accordance with the detection result of the pressure detecting unit, wherein when the exhaust detecting unit detects the exhaust, the purge control unit prohibits control of the purge in accordance with the detection result of the pressure detecting unit.

48. The fuel vapor treatment apparatus according to claim 47, wherein when the exhaust detecting unit does not detect the exhaust, the purge control unit calculates a fuel vapor condition in the purge passage in accordance with the detection result of the pressure detecting unit, and the purge control unit controls the purge in accordance with the fuel vapor condition.

49. The fuel vapor treatment apparatus according to claim 47, wherein when the exhaust detecting unit detects the exhaust, the purge control unit controls the purge by ignoring the detection result of the pressure detecting unit.

50. The fuel vapor treatment apparatus according to claim 47, wherein the purge control unit prohibits control of the purge in accordance with the detection result of the pressure detecting unit, until fuel vapor is swept from the open passage.

51. The fuel vapor treatment apparatus according to claim 50, wherein when a predetermined time elapses since the purge control unit applies negative pressure to remove fuel vapor from the canister and purge the fuel vapor into the intake passage, the purge control unit determines that sweeping of fuel vapor is completed.

52. The fuel vapor treatment apparatus according to claim 50, wherein when the purge control unit applies negative pressure to remove fuel vapor from the canister and purge the fuel vapor into the intake passage by a predetermined amount, the purge control unit determines that sweeping of fuel vapor is completed.

53. The fuel vapor treatment apparatus according to claim 46, further comprising:

an atmosphere passage opening to an atmosphere; and a passage switching unit for switching between the purge passage and the atmosphere passage to be communicated with the detection passage, wherein the pressure detecting unit detects first pressure in a condition where:

the gas flow generating unit reduces pressure in the detection passage; and the passage switching unit communicates the atmosphere passage with the detection passage, wherein the pressure detecting unit detects second pressure in a condition where:

the gas flow generating unit reduces pressure in the detection passage; and the passage switching unit communicates the purge passage with the detection passage, wherein when the exhaust detecting unit does not detect the exhaust, the purge control unit controls the purge in accordance with the first pressure and the second pressure.

54. The fuel vapor treatment apparatus according to claim 53, wherein the exhaust detecting unit detects the exhaust in accordance with the first pressure.

55. The fuel vapor treatment apparatus according to claim 54, wherein when the exhaust does not exist, the first pressure is a first pressure reference, wherein when a difference between the first pressure and the first pressure reference is equal to or greater than an allowable threshold, the exhaust detecting unit determines to detect the exhaust.

56. The fuel vapor treatment apparatus according to claim 55, wherein the first pressure reference is determined in accordance with the first pressure previously detected using the pressure detecting unit.

57. The fuel vapor treatment apparatus according to claim 56, wherein the first pressure reference is determined by averaging a plurality of values of the first pressure previously detected using the pressure detecting unit.

58. The fuel vapor treatment apparatus according to claim 53, further comprising:

a passage open/close unit for communicating and blocking the detection passage, wherein the pressure detecting unit detects shutoff pressure in a condition where:

the gas flow generating unit reduces pressure in the detection passage; and the passage open/close unit blocks the detection passage, wherein when the exhaust detecting unit does not detect the exhaust, the purge control unit controls the purge in accordance with the first pressure, the second pressure, and the shutoff pressure.

59. The fuel vapor treatment apparatus according to claim 58, wherein the exhaust detecting unit detects the exhaust in accordance with the shutoff pressure.

60. The fuel vapor treatment apparatus according to claim 59, wherein when the exhaust does not exist, the shutoff pressure is a shutoff pressure reference, wherein when a difference between the shutoff pressure and the shutoff pressure reference is equal to or greater than an allowable threshold, the exhaust detecting unit determines to detect the exhaust.

61. The fuel vapor treatment apparatus according to claim 60, wherein the shutoff pressure reference is determined in accordance with the shutoff pressure previously detected using the pressure detecting unit.

62. The fuel vapor treatment apparatus according to claim 61, wherein the shutoff pressure reference is determined by averaging a plurality of values of the shutoff pressure previously detected using the pressure detecting unit.

63. The fuel vapor treatment apparatus according to claim 46, further comprising:

a fuel detecting unit for detecting fuel vapor in the open passage, wherein the exhaust detecting unit detects the exhaust in accordance with a detection result of the fuel detecting unit.

64. A fuel vapor treatment apparatus comprising:

a first canister for removably absorbing fuel vapor produced in a fuel tank;

a purge passage through which fuel vapor removed from the first canister is purged into an intake passage of an engine;

a first detection passage communicating with the purge passage, the first detection passage having a throttle midway therethrough;

a second canister located on an opposite side of the purge passage with respect to the throttle, the second canister communicating with the first detection passage for removably absorbing fuel vapor flowing from the purge passage into the second canister through the first detection passage;

a second detection passage communicating with the second canister;

a gas flow generating unit for generating gas flow by reducing pressure in the second detection passage;

a pressure detecting unit for detecting pressure correlated with the throttle and the gas flow generating unit in a condition where the gas flow generating unit reduces pressure in the second detection passage;

a purge control unit for controlling purge of fuel vapor from the purge passage to the intake passage in accordance with a detection result of the pressure detecting unit;

an estimating unit for estimating an amount of fuel vapor absorbed in the second canister; and an allow/prohibit determining unit for allowing the gas flow generating unit to reduce pressure in the second detection passage, and prohibiting the gas flow generating unit from reducing pressure in the second detection passage, in accordance with an estimation result of the estimating unit.

65. The fuel vapor treatment apparatus according to claim 64, wherein the gas flow generating unit has an exhaust port opening to an atmosphere, and the gas flow generating unit is adapted to exhausting gas, which is drawn from the second detection passage, through the exhaust port.

66. The fuel vapor treatment apparatus according to claim 64, wherein the estimating unit calculates a fuel vapor condition in the purge passage in accordance with the detection result of the pressure detecting unit, and the estimating unit estimates the amount of fuel vapor absorbed in the second canister in accordance with the fuel vapor condition.

67. The fuel vapor treatment apparatus according to claim 64, wherein the estimating unit estimates the amount of fuel vapor absorbed in the second canister in accordance with an amount of fuel vapor removed from the second canister and purged into the intake passage using the purge control unit.

68. The fuel vapor treatment apparatus according to claim 64, wherein when the estimation result of the estimating unit becomes equal to or less than an allowable threshold, the allow/prohibit determining unit allows the gas flow generating unit to reduce pressure in the second detection passage, wherein when the estimation result of the estimating unit becomes greater than the allowable threshold, the allow/prohibit determining unit prohibits the gas flow generating unit from reducing pressure in the second detection passage.

69. The fuel vapor treatment apparatus according to claim 68, wherein when the estimation result of the estimating unit becomes equal to or less than the allowable threshold, the purge control unit controls the purge in accordance with the detection result of the pressure detecting unit, wherein when the estimation result of the estimating unit becomes greater than the allowable threshold, the purge control unit controls the purge by ignoring the detection result of the pressure detecting unit.

70. The fuel vapor treatment apparatus according to claim 69, wherein when the estimation result of the estimating unit becomes equal to or less than the allowable threshold, the purge control unit calculates a fuel vapor condition in the purge passage in accordance with the detection result of the pressure detecting unit, and the purge control unit controls the purge in accordance with the fuel vapor condition.

71. The fuel vapor treatment apparatus according to claim 64, wherein the purge control unit is adapted to executing a first purge process for removing fuel vapor from both the first canister and the second canister to purge the fuel vapor into the intake passage, and the purge control unit is adapted to executing a second purge process for removing fuel vapor from the first canister of the first canister and the second canister to purge the fuel vapor into the intake passage, wherein when the estimation result of the estimating unit becomes equal to or less than a recovery threshold, the purge control unit switches the first purge process to the second purge process.

72. The fuel vapor treatment apparatus according to claim 64, further comprising:

an exhaust detecting unit for detecting exhaust of fuel vapor from the second canister to the second detection passage; and a correcting unit for correcting the estimation result of the estimating unit in accordance with a detection result of the exhaust detecting unit.

73. The fuel vapor treatment apparatus according to claim 72, wherein when the exhaust detecting unit detects the exhaust, the correcting unit corrects the estimation result of the estimating unit, and the purge control unit controls the purge by ignoring the detection result of the pressure detecting unit.

* * * * *